US012398506B2

(12) United States Patent
Bae

(10) Patent No.: US 12,398,506 B2
(45) **Date of Patent: *Aug. 26, 2025**

(54) LAUNDRY TREATING APPARATUS

(71) Applicant: LG Electronics Inc., Seoul (KR)

(72) Inventor: Yeeseok Bae, Seoul (KR)

(73) Assignee: LG Electronics Inc., Seoul (KR)

( * ) Notice: Subject to any disclaimer, the term of this patent is extended or adjusted under 35 U.S.C. 154(b) by 782 days.

This patent is subject to a terminal disclaimer.

(21) Appl. No.: 17/667,089

(22) Filed: Feb. 8, 2022

(65) Prior Publication Data

US 2022/0251769 A1 Aug. 11, 2022

(30) Foreign Application Priority Data

Feb. 8, 2021 (KR) ..... 10-2021-0017559

(51) Int. Cl.
*D06F 58/24* (2006.01)

(52) U.S. Cl.
CPC ..... *D06F 58/24* (2013.01)

(58) Field of Classification Search
CPC ..... D06F 58/24
USPC ..... 34/73
See application file for complete search history.

(56) References Cited

U.S. PATENT DOCUMENTS 2,114,776 A * 4/1938 Davis ..... D06F 43/08 68/19.2
7,987,616 B2 * 8/2011 Bae ..... D06F 58/203 68/5 R
8,984,767 B2 * 3/2015 Grunert ..... D06F 58/45 68/5 R
9,096,079 B2 * 8/2015 Priebe ..... B41J 11/0022
9,335,095 B2 * 5/2016 Bison ..... D06F 39/12
9,605,375 B2 * 3/2017 Frank ..... D06F 58/44
(Continued)

FOREIGN PATENT DOCUMENTS

AU 2014414434 5/2017
CN 101796243 8/2010
(Continued)

OTHER PUBLICATIONS

Extended European Search Report in European Appln. No. 22154681.5, dated May 30, 2022,.
(Continued)

*Primary Examiner* — Stephen M Gravini
(74) *Attorney, Agent, or Firm* — Fish & Richardson P.C.

(57) ABSTRACT

A laundry treating apparatus includes a cabinet, a drum, a base, and a motor. The base is disposed under the drum and guides air circulating to the drum. The base includes an air circulating channel, a heat exchanger, a water collector body, a cleaning water channel, a pump, and a channel switching valve. The channel switching valve is connected to the pump and receives water from the pump and delivers the water to the cleaning water channel. The channel switching valve includes a water receiving portion connected to the pump and a connective portion connected to the water receiving portion and coupled to the air circulating channel to deliver the water to the cleaning water channel. The connective portion is disposed at a side of the air circulating channel. At least a portion of the connective portion is positioned lower than a top surface of the air circulating channel.

20 Claims, 25 Drawing Sheets

(56) References Cited

U.S. PATENT DOCUMENTS

| | | | | |
|---|---|---|---|---|
| 9,863,704 | B2 * | 1/2018 | Vild | F26B 25/005 |
| 10,273,627 | B2 | 4/2019 | Yoon et al. | |
| 10,544,539 | B2 * | 1/2020 | Bocchino | D06F 58/22 |
| 12,000,073 | B2 * | 6/2024 | Kellow | D06F 33/60 |
| 12,000,081 | B2 * | 6/2024 | Ekbundit | D06F 58/32 |
| 2009/0071033 | A1 | 3/2009 | Ahn et al. | |
| 2017/0350064 | A1 | 12/2017 | Shin et al. | |
| 2020/0063329 | A1 | 2/2020 | Bocchino et al. | |
| 2021/0017697 | A1 | 1/2021 | Soek et al. | |
| 2021/0187559 | A1 | 6/2021 | Kim et al. | |
| 2022/0251766 | A1 * | 8/2022 | Bae | D06F 58/24 |
| 2022/0251767 | A1 * | 8/2022 | Bae | D06F 58/206 |
| 2022/0251769 | A1 * | 8/2022 | Bae | D06F 58/24 |
| 2024/0052550 | A1 | 2/2024 | Kim et al. | |

FOREIGN PATENT DOCUMENTS

| | | | | |
|---|---|---|---|---|
| CN | 106103834 | | 11/2016 | |
| CN | 106868825 | | 6/2017 | |
| CN | 107923115 | | 4/2018 | |
| CN | 112074638 | | 12/2020 | |
| CN | 112088231 | | 12/2020 | |
| CN | 114908532 | B * | 12/2023 | D06F 58/02 |
| DE | 102006061211 | | 6/2008 | |
| EP | 2719819 | | 4/2014 | |
| EP | 2799612 | | 11/2014 | |
| EP | 3090093 | | 11/2016 | |
| EP | 4039874 | B1 * | 12/2024 | D06F 58/02 |
| JP | 55081914 | | 6/1980 | |
| JP | 55115455 | | 9/1980 | |
| JP | 57063724 | | 4/1982 | |
| JP | 57124674 | | 8/1982 | |
| KR | 20120110498 | | 10/2012 | |
| KR | 10-2019-0128468 | | 11/2019 | |
| KR | 20190128471 | | 11/2019 | |
| KR | 20220114268 | A * | 8/2022 | |
| WO | WO 2014041097 | | 3/2014 | |
| WO | WO2014169955 | | 10/2014 | |
| WO | WO2015101387 | | 7/2015 | |
| WO | WO2016095968 | | 6/2016 | |
| WO | WO 2016/003066 | | 7/2016 | |
| WO | WO2016186235 | | 11/2016 | |
| WO | WO2019216639 | | 11/2019 | |
| WO | WO-2022169326 | A1 * | 8/2022 | D06F 58/02 |

OTHER PUBLICATIONS

International Search Report and Written Opinion in International Appln. No. PCT/KR2022/001805, dated May 2022, 9 pages.

Office Action in Taiwanese Appln. No. 111104435, mailed on Mar. 31, 2023, 9 pages(with English translation).

Office Action in Chinese Appln. No. 202210119591.9, mailed on Apr. 22, 2023, 17 pages (with English translation).

Notice of Allowance in Chinese Appln. No. 202210119591.9, mailed on Feb. 22, 2024, 7 pages (with English translation).

Office Action in Australian Appln. No. 2022215409, mailed on Apr. 16, 2025, 6 pages.

* cited by examiner

Related art

LAUNDRY TREATING APPARATUS

CROSS-REFERENCE TO RELATED APPLICATIONS

This application claims the benefit of Korean Patent Application Nos. 10-2021-0017559, filed on Feb. 8, 2021, the disclosure of which is hereby incorporated by reference as if fully set forth herein.

TECHNICAL FIELD

The present disclosure relates to a laundry treating apparatus.

BACKGROUND

A laundry treating apparatus may remove dust or foreign substances from laundry by applying physical force to the laundry. For example, the laundry treating apparatus may include a washing machine, a dryer, and a refresher (styler).

The washing machine may perform a washing cycle for separating and removing foreign substances from the laundry by supplying water and detergent to the laundry.

The dryer may be classified into an exhaust type dryer or a circulation type dryer which is configured to produce high-temperature hot air through a heater and perform a drying cycle to remove moisture contained in the laundry by exposing the hot air to the laundry.

In some cases, the dryer may omit a component for supplying or draining water to or from an inside of the laundry and a tub for accommodating the water so that a drying cycle may be performed without those components. This may simplify an internal structure of the laundry dryer, and may directly supply the hot air to the drum accommodating the laundry to improve drying efficiency.

For example, the dryer may include a drum to accommodate the laundry, a hot air supply to supply hot air to the drum, and a driver to rotate the drum. Accordingly, the dryer supplies hot air to the inside of the drum to dry the laundry accommodated in the drum, and rotates the drum such that a surface of the laundry may be evenly exposed to the hot air. As a result, an entire surface of the laundry may evenly contact the hot air to complete drying.

In some cases, the driver may be fixed inside the cabinet in order to rotate the drum. The driver may be configured to rotate a rotation shaft coupled to the drum, and the driver may be coupled to the rotation shaft in a parallel manner. In some cases, the dryer may not have a fixed tub inside the cabinet, and thus the driver may not be fixed to the tub, which is typically included in a washing machine.

In some cases, a dryer may include a driver that is fixed to a rear face of the cabinet.

FIG. 1 shows a structure of a conventional dryer in which the driver is coupled to the rear face of the cabinet in related art.

The dryer may include a cabinet 1 constituting an outer shape, a drum 2 rotatably disposed inside the cabinet 1 to accommodate laundry, and a driver 3 configured to rotate the drum 2.

The driver 3 may be disposed on a rear face of the drum 2 and configured to rotate the drum 2, and coupled to and fixed to a rear panel 11 constituting the rear face of the cabinet 1. In this way, the driver 3 is fixed to the cabinet 1 so that the drum 2 may be rotated.

The driver 3 of a conventional dryer as described above includes a stator 31 fixed to the rear panel 11, a rotor 32 rotating by the stator 31, and a rotation shaft 33 coupled to the rotor 32 to rotate the drum 2. The dryer further includes a speed reducer 37 configured to rotate the drum 2 while increasing a torque by decreasing a RPM of the rotation shaft 33.

Further, the conventional dryers may include fixing means 4 for fixing the driver 3 to the rear panel 11. The fixing means 4 may include one or more of first fixing means 41 for fixing the stator 31 to the rear panel 11 and second fixing means 42 for fixing the rotation shaft 33 to the rear panel 11. As a result, in the conventional dryers, the rotation shaft 33 and the driver 3 coupled to the drum 2 are arranged side by side to rotate the drum 2 stably.

In some cases, where the rear panel 11 of the cabinet is made of a thin steel plate, which may be easily deformed or vibrated even with a fairly small external force. Moreover, the rear panel 11 receives a load of the driver 3 as well as a load of the drum 2 via the rotation shaft 33 and thus may not maintain its shape.

Further, when the laundry is eccentric inside the drum 2 or repeatedly falls into the drum 2 during rotation, a repeated external force is transmitted to the rear panel 11 and the rear panel 11 may vibrate.

When vibration or external force is transmitted to the rear panel 11 and thus the rear panel 11 is bent or deformed even temporarily, the rotation shaft 33 connecting the driver 3 and the drum 2 may be distorted. Accordingly, vibration or noise may occur in the driver 3, and in severe cases, the rotation shaft 33 may be damaged. Further, there is a problem that noise is generated while the rear panel 11 is bent or deformed.

Further, while the rear panel 11 vibrates, a distance between the rotor 32 and the stator 31 may temporarily change, causing the rotor 32 to collide with the stator 31 or generate vibration and noise.

In some cases, when the driver 3 further includes the speed reducer 37, the rotation shaft 33 coupled to the speed reducer 37 and a speed reducing shaft 33*a* extending from the speed reducer 37 to the drum 2 are separated from each other. In some examples, the speed reducer 37 is supported on the rear panel 11 via the stator 31 or the rotation shaft 33. Thus, when the rear panel 11 is deformed even a little, the speed reducing shaft 33*a* and the rotation shaft 33 may be distorted or misaligned with each other.

In other words, the speed reducing shaft 33*a* connected to the drum 2 may have a smaller displacement amount due to the load of the drum 2 than that of the rotation shaft 33 connected to the driver 3. Therefore, when the rear panel 11 is temporarily bent or deformed, inclinations of the rotation shaft 33 and the speed reducing shaft 33*a* are different from each other, and thus, the rotation shaft 33 and the speed reducing shaft 33*a* are misaligned with each other.

Therefore, in the conventional laundry treating apparatus, when the driver 3 operates, the rotation shaft 33 and the speed reducing shaft 33*a* may be misaligned with each other. Thus, reliability of the speed reducer 37 may be not ensured, and the speed reducer 37 may be damaged.

Further, the conventional dryer may not include a channel through which the air of the drum flows in the base located below the drum or a structure to treat condensate condensed in the channel.

SUMMARY

The present disclosure describes a laundry treating apparatus including a channel switching valve disposed on a side surface of a duct cover such that it is easy to repair and maintain the channel switching valve.

The present disclosure describes a laundry treating apparatus including a channel switching valve that is integrally formed with the duct cover such that an extension length of the channel switching portion can be reduced.

The present disclosure describes a laundry treating apparatus capable of increasing a pressure of water discharged to an evaporator by reducing a distance between the channel switching valve and a water collector body.

The present disclosure describes a laundry treating apparatus that can simplify an assembly process of an air circulating channel that defines a passage configured to carry air discharged from the drum.

The present disclosure describes a laundry treating apparatus including a cleaning water channel that is defined on a top of the duct cover, thereby simplifying production and assembly processes of the apparatus.

According to one aspect of the subject matter described in this application, a laundry treating apparatus includes a cabinet having an opening defined at a front surface thereof, a drum rotatably that is disposed in the cabinet and has a laundry inlet defined at a front surface thereof and configured to introduce laundry into the drum, a base that is disposed below the drum and defines a space configured to receive air discharged from the drum and to guide the air to the drum, and a motor configured to rotate the drum. The base includes an air circulating channel configured to fluidly communicate with the drum, where the air circulating channel is configured to receive the air discharged from the drum and to guide the air to the drum, a heat exchanger including (i) a first heat exchanger disposed inside the air circulating channel and configured to cool the air discharged from the drum and (ii) a second heat exchanger spaced apart from the first heat exchanger and configured to heat the air cooled by the first heat exchanger, a water collector body that is disposed outside the air circulating channel and in fluid communication with the air circulating channel, where the water collector body is configured to collect water condensed from the air in the first heat exchanger, a cleaning water channel disposed above the air circulating channel and configured to receive the water from the water collector body and to discharge the received water to the first heat exchanger, a pump configured to move the water collected in the water collector body to the cleaning water channel, and a channel switching valve connected to the pump and configured to selectively supply the water from the pump to the cleaning water channel. The channel switching valve includes a water receiving portion connected to the pump and configured to receive the water from the pump, and a connective portion connected to the water receiving portion and disposed at a lateral side of the air circulating channel, where the connective portion is configured to deliver the water from the water receiving portion to the cleaning water channel, and at least portion of the connective portion is located lower than a top surface of the air circulating channel.

Implementations according to this aspect can include one or more of the following features. For example, the air circulating channel can include an air flow duct that extends upward from the base and accommodates the first heat exchanger and the second heat exchanger, and a duct cover that is coupled to the air flow duct and covers the first heat exchanger and the second heat exchanger, the cleaning water channel being disposed at a top surface of the duct cover. The connective portion can be disposed at a side surface of the duct cover, the at least portion of the connective portion being located lower than the top surface of the duct cover. In some examples, the duct cover can define a cover through-hole that passes through the top surface of the duct cover and faces at least a portion of the first heat exchanger; and a valve communication hole that passes through a surface of the cleaning water channel and fluidly communicates the cleaning water channel with the connective portion. The cleaning water channel can extend from the valve communication hole to the cover through-hole and be configured discharge the water toward the first heat exchanger through the cover through-hole.

In some examples, the connective portion can be integrally formed with the duct cover such that the water is delivered to the cleaning water channel without leakage at the connective portion. In some examples, the connective portion can define a supply hole connected to the water receiving portion and configured to receive the water from the water receiving portion, and a valve communication hole that passes through a bottom surface of the cleaning water channel and is configured to deliver the water supplied from the supply hole to the cleaning water channel. The supply hole and the valve communication hole can be spaced apart from each other and face different directions from each other.

In some implementations, the connective portion can further include a receiving channel configured to guide the water from the water receiving portion to the cleaning water channel, where the receiving channel has a first end that defines the supply hole and a second end that defines the valve communication hole, and the receiving channel extends in an inclined direction with respect to the top surface of the duct cover.

In some implementations, the laundry treating apparatus can include a water storage tank spaced from the base and connected to the connective portion, where the water storage tank is configured to receive the water from the water collector body. The connective portion can further define a water receiving hole connected to the water receiving portion and configured to receive the water from the water receiving portion, and a water discharge hole connected to the water storage tank and configured to discharge the water received through the water receiving hole toward the water storage tank. The water discharge hole can be spaced apart from the water receiving hole and facing away from the water receiving hole. In some examples, the connective portion can further define a connective transfer channel that has a first end defining the water receiving hole and a second end defining the water discharge hole, where the connective transfer channel is configured to guide the water from the water receiving portion to the water storage tank, and the connective transfer channel and the receiving channel are defined in a single body.

In some implementations, the channel switching valve can further include a water delivering portion disposed between the water receiving portion and the connective portion and configured to guide the water supplied from the water receiving portion to the connective portion, where the connective portion is coupled to the water delivering portion and configured to receive the water from the water receiving portion through the water delivering portion. In some examples, the channel switching valve can further include a sealing member disposed between the connective portion and the water delivering portion and configured to block the water guided from the water delivering portion from leaking out between the connective portion and the water delivering portion.

In some implementations, the laundry treating apparatus can include a nozzle cover that is coupled to the top surface of the duct cover and covers the cleaning water channel, where the nozzle cover can include a fastening part that protrudes from a top surface of the nozzle cover and is coupled to the water delivering portion. The water delivering portion can include a first fastening portion that extends from one side of the water delivering portion and is coupled to the fastening part of the nozzle cover, and a second fastening portion that extends from another side of the water delivering portion and is coupled to the connective portion. In some examples, the connective portion can include a first fixing protrusion that protrudes upward from a top of the connective portion and a second fixing protrusion that protrudes downward from a bottom of the connective portion. The water delivering portion can include a first fastening portion that extends from one side of the water delivering portion and receives the first fixing protrusion, and a second fastening portion that extends from another side of the water delivering portion and receives the second fixing protrusion.

In some implementations, the cabinet can include a first side panel that defines a first side of the cabinet and faces one side of the drum, and a second side panel that defines a second side of the cabinet and faces another side of the drum, where the air flow duct and the duct cover are located closer to the second side panel than to the first side panel, and the connective portion extends from the duct cover toward the first side panel. In some examples, the connective portion can extend toward the first side panel along an inclined direction relative to an extension direction of the duct cover. In some examples, the water collector body can be located between the first side panel and the air flow duct, and the channel switching valve can be located between the drum and the water collector body and overlap with the water collector body along a vertical direction.

In some implementations, a top of the water receiving portion can be located lower than a bottom of the drum and is spaced apart from the bottom of the drum. In some examples, the cleaning water channel can include a plurality of cleaning water channels, and the receiving channel can include a plurality of receiving channels that are connected to the plurality of cleaning water channels, respectively, where a number of the plurality of receiving channels is equal to a number of the plurality of cleaning water channels.

In some implementations, the channel switching valve can further include a scroll accommodated in the water receiving portion and configured to selectively supply the water in the water receiving portion to the receiving channel, where the scroll is configured to, based on rotating about an axis, selectively communicate the water receiving portion with one of the plurality of receiving channels. In some examples, the water receiving portion can include a valve rotatable shaft coupled to the scroll and configured to rotate the scroll, and a valve driver coupled to the valve rotatable shaft and configured to rotate the valve rotatable shaft.

The scroll can define a scroll communication hole, where a width of the scroll communication hole is equal to a diameter of one of the plurality of receiving channels, and the scroll communication hole is configured to selectively communicate with one of the plurality of receiving channels based on a rotation angle of the valve rotatable shaft. In some implementations, the scroll can include a scroll plate that defines the scroll communication hole and a scroll coupling groove, the scroll coupling groove being defined at a rotation center of the scroll plate and coupled to the valve rotatable shaft.

In some implementations, the channel switching valve can be disposed at a side face of an air circulating channel so that the channel switching valve is disposed closer to a water collector body.

In some implementations, the duct cover and the nozzle cover can be coupled to each other to define a cleaning water channels such that a separate washing pipe is omitted.

DETAILED DESCRIPTIONS

Figure 3:
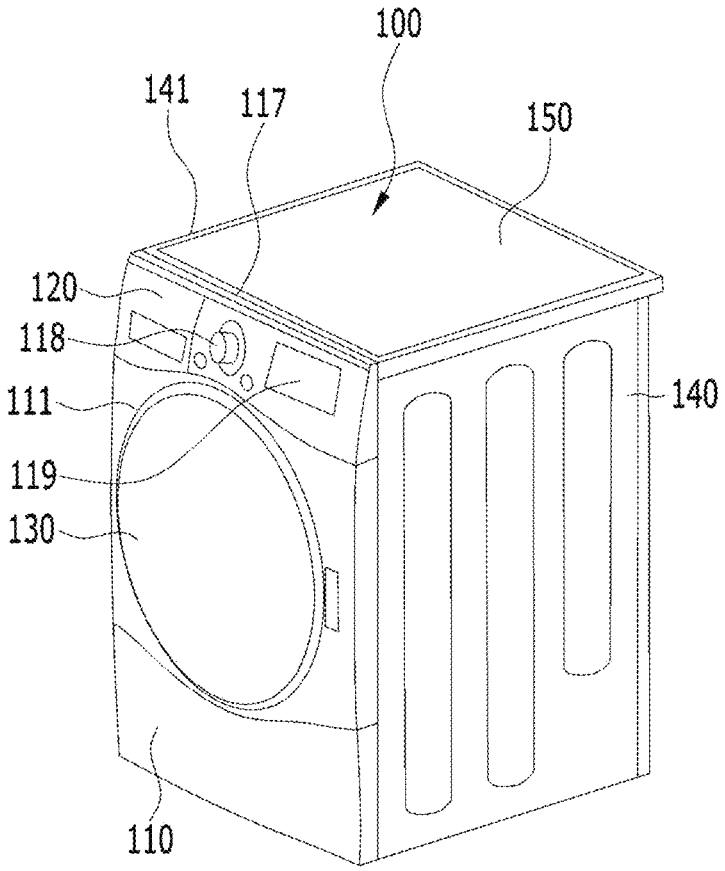
FIG. 3 shows an outer shape of an example of a laundry treating apparatus according to the present disclosure.

FIG. 3 shows an outer shape of an example of a laundry treating apparatus according to the present disclosure.

In some implementations, the laundry treating apparatus can include a cabinet 100 that defines an outer shape of the laundry treating apparatus.

For instance, the cabinet 100 can include a front panel 110 that defines a front surface of the laundry treating apparatus, a top panel 150 that defines a top surface thereof, and a side panel 140 that defines a side surface thereof. The side panel 140 can include a first side panel 141 defining a left side face. The front panel 110 can include an opening 111 communicating with an interior of the cabinet 100 and a door 130 pivotably coupled to the cabinet 100 to open and close the opening 111.

In some implementations, the front panel 110 can be equipped with a manipulating panel 117. The manipulating panel 117 can include an input unit 118 that receives a control command from a user, and a display 119 that outputs information such as a control command selectable by the user. The control commands can include a drying course or a drying option that can perform a series of drying cycles. Inside the cabinet 100, a control box (see FIG. 12) that controls internal components to execute the control commands input through the input unit 118 can be installed. The control box can be connected to components inside the laundry treating apparatus to control the components to perform an input command.

The input unit 118 includes a power supply request unit that requests a power supply of the laundry treating apparatus, a course input unit that enables a user to select a course among a plurality of courses, and an execution request unit that requests start of a course selected by the user.

The display 119 can be configured to include at least one of a display panel capable of outputting texts and figures, and a speaker capable of outputting a voice signal and sound.

In some implementations, the laundry treating apparatus can include a water storage tank 120 configured to separately store moisture generated in a process of drying the laundry. The water storage tank 120 can include a handle which the user can grip to withdraw the water storage tank 120 from one side of the front panel 110 to an outside. The water storage tank 120 can be configured to collect the condensate generated during a drying cycle. Thus, the user can withdraw the water storage tank 120 from the cabinet 100, remove the condensate therefrom, and put the water storage tank 120 back into the cabinet 100. Accordingly, the laundry treating apparatus can be disposed in a place where a sewer or the like is not installed.

In some examples, the water storage tank 120 can be disposed on top of the door 130. Accordingly, when the user withdraws the water storage tank 120 from the front panel 110, the user can bend a waist in a relatively smaller amount, thereby increasing the user's convenience.

Figure 4:
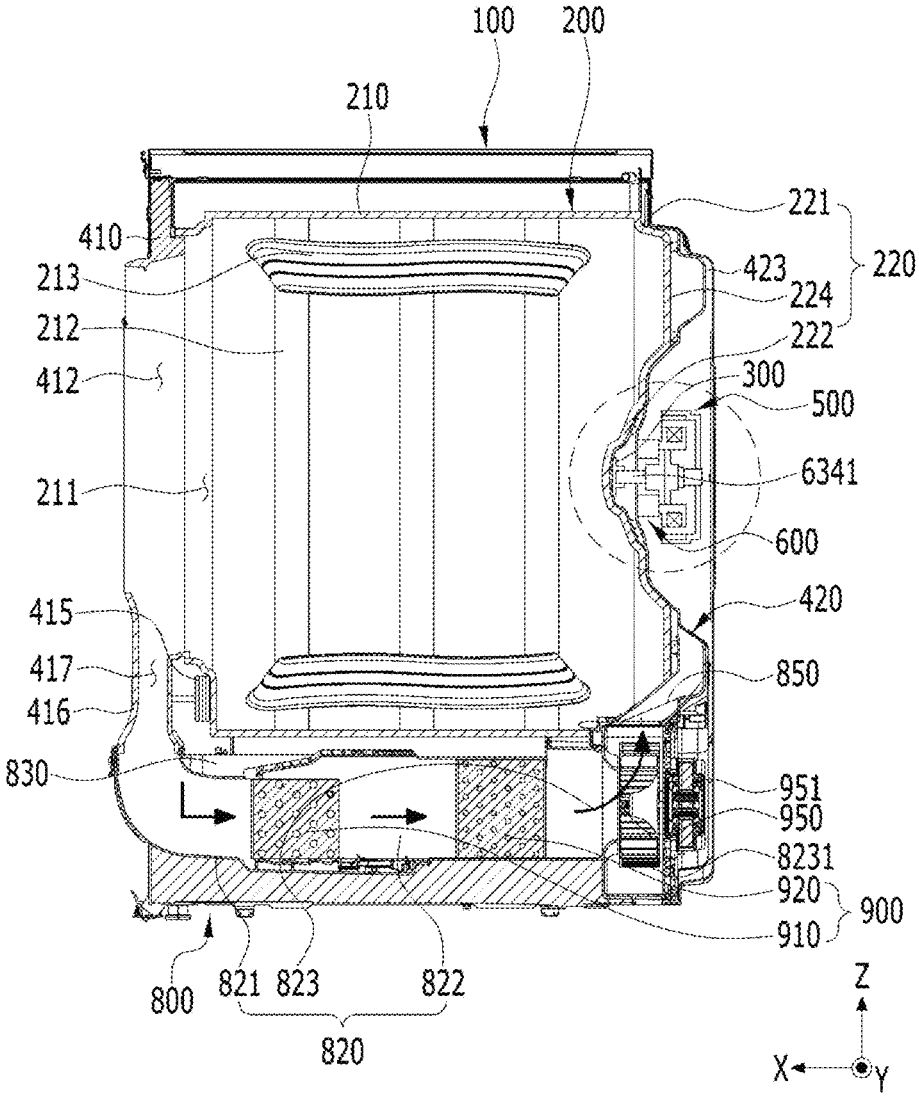
FIG. 4 briefly shows an inside of the laundry treating apparatus.

FIG. 4 briefly shows an inside of the laundry treating apparatus.

The laundry treating apparatus includes a drum 200 accommodated inside the cabinet 100 to accommodate the laundry, a driver for rotating the drum 200, and a heat exchanger 900 configured to supply hot air to the drum 200, and a base 800 having an air circulating channel 820. The air circulating channel 820 is communicating with the drum 200. Air discharged from the drum 200 can be supplied to the air circulating channel 820. Further, the air discharged from the air circulating channel 820 can be supplied to the drum 200 again.

The driver can include a motor 500 that provides power to rotate the drum 200. The driver can be in direct connection with the drum 200 to rotate the drum 200. For example, the driver can be implemented as a Direct Drive (DD) type driver. Accordingly, the driver can control a rotation direction of the drum 200 or a rotation speed of the drum 200 by directly rotating the drum 200 while the driver is free of a belt and a pulley.

The motor 500 can rotate at high revolutions per minute (RPM). For example, the laundry inside the drum 200 can rotate at a much higher RPM than RPM at which it can rotate while being coupled to an inner wall of the drum 200.

However, when the laundry inside the drum 200 rotates while being continuously coupled to the inner wall of the drum 200, there is a problem in that drying efficiency decreases because a portion of the laundry coupled to the inner wall of the drum is not exposed to hot air.

When the motor 500 is rotated at a low RPM in order that the laundry roll or are mixed with each other inside the drum 200 without being coupled to the inner wall of the drum 200, there can be a problem that an output or torque that can be generated by the driver may not be properly utilized.

Therefore, the driver of the laundry treating apparatus can further include a speed reducer 600 that can reduce the RPM to increase the torque while taking advantage of a maximum output of the motor 500.

Further, the driver can include a drum rotation shaft 6341 connected to the drum 200 to rotate the drum 200.

The drum 200 can be formed in a cylindrical shape to accommodate the laundry therein. Further, unlike the drum used for washing, water may not be put inside the drum 200 used only for drying, and liquid water condensed inside the drum 200 may not be discharged out of the drum 200. Therefore, through-holes defined in a circumferential face of the drum 200 can be omitted. That is, the drum 200 used only for drying can be different from the drum 200 used for washing.

The drum 200 can be formed in an integral cylindrical shape, or can be manufactured in a structure in which a drum body 210 including a circumferential face and a drum rear face 220 constituting a rear face are coupled to each other.

A laundry inlet 211 through which laundry enters and exits can be defined in a front face of the drum body 210. The driver that rotates the drum can be connected to the drum rear face 220. The drum body 210 and the drum rear face 220 can be coupled to each other via a fastener such as a bolt. The disclosure is not limited thereto. As long as the drum body 210 and the drum rear face 220 are coupled to each other while both rotate together, they can be coupled to each other using various methods.

The drum body 210 can have a lift 213 for lifting the laundry up so that the laundry accommodated therein can be mixed with each other under the rotation. When the drum 200 rotates, the laundry accommodated therein can repeatedly rise up and fall due to the lift 213. The laundry accommodated inside the drum 200 can be in contact with hot air while the laundry repeatedly rise up and fall. Therefore, the drying efficiency increases, and the drying time is shortened.

A reinforcing bead 212 can be formed on a circumferential face of the drum body 210. The reinforcing bead 212 can be configured to be recessed into or protrude from the circumferential face of the drum 200. The reinforcing bead can include a plurality of beads which can be configured to be spaced apart from each other. The reinforcing beads can form a certain pattern and can be recessed into or protrude from the circumferential face.

Rigidity of the drum body 210 can increase due to the reinforcing bead 212. Accordingly, even when a large amount of laundry is accommodated in the drum body 210 or a sudden rotation force is transmitted via the driver, the drum body 210 can be prevented from being distorted. Further, when the reinforcing bead 212 is provided, a spacing between the laundry and an inner circumferential face of the drum body can increase, compared to a case where the circumferential face of the drum body 210 is a flat face, so that the hot air supplied to the drum 200 is more effectively introduced between the laundry and the drum 200. Durability of the drum increases due to the reinforcing bead, and the drying efficiency of the laundry treating apparatus increases due to the bead.

In general, in a DD-type washing machine, the driver can be fixed to a tub that accommodates the drum 200, and the drum 200 can be coupled to the driver and supported on the tub. However, because a laundry treating apparatus can be configured to intensively perform a drying cycle, a tub fixed to the cabinet 100 to accommodate the drum 200 is omitted.

Accordingly, the laundry treating apparatus can further include a support 400 configured to fix or support the drum 200 or the driver inside the cabinet 100.

The support 400 can include a front plate 410 disposed in front of the drum 200 and a rear plate 420 disposed in rear of the drum 200. The front plate 410 and the rear plate 420 can have a plate shape and can be disposed to respectively face front and rear faces of the drum 200. A distance between the front plate 410 and the rear plate 420 can be set to be equal to a length of the drum 200 or be larger than the length of the drum 200. The front plate 410 and the rear plate 420 can be fixedly supported on the bottom face of the cabinet 100 or the base 800.

The front plate 410 can be disposed between the front panel constituting the front face of the cabinet and the drum 200. Further, the front plate 410 can have an inlet-communication hole 412 communicating with the laundry inlet 211. Because the front plate 410 has the inlet-communication hole 412, the front face of the drum 200 is supported thereon, laundry can be put into or taken out from the drum 200.

The front plate 410 can include a duct connector 416 disposed below the inlet-communication hole 412. The duct connector 416 can constitute a lower portion of the front plate 410.

The front plate 410 can include a duct communication hole 417 extending through the duct connector 416. The duct communication hole 417 can have a hollow shape to guide the air discharged through the laundry inlet 211 of the drum to a bottom of the drum 200. Further, the air discharged through the laundry inlet 211 can be guided to the air circulating channel 820 positioned under the drum 200.

In some implementations, a filter can be installed in the duct communication hole 417 to filter foreign substances such as large lint or large particles generated from the laundry. The filter filters the air discharged from the drum 200 to prevent foreign substances from accumulating inside the laundry treating apparatus, and to prevent foreign substances from accumulating and thus interfering with circulation of the air.

Because the laundry inlet 211 can be disposed in a front face, the driver can be installed on the rear plate 420 rather than the front plate 410. The driver can be configured to be supported and mounted on the rear plate 420. This allows the driver to rotate the drum 200 while the position of the driver is stably fixed due to the rear plate 420.

At least one of the front plate 410 and the rear plate 420 can support the drum 200 such that the drum can rotate. At least one of the front plate 410 and the rear plate 420 can accommodate a front or rear end of the drum 200 such that the drum can rotate.

For example, a front portion of the drum 200 can be rotatably supported on the front plate 410, and a rear portion of the drum 200 can be spaced apart from the rear plate 420 and can be connected to the motor 500 mounted on the rear plate 420 and thus can be indirectly supported on the rear plate 420. In this way, an area where the drum 200 contacts or rubs against the support 400 can be minimized and noise or vibration can be prevented from occurring.

In another example, the drum 200 can be configured to be rotatably supported on both the front plate 410 and the rear plate 420.

One or more support wheels 415 supporting the front portion of the drum 200 can be disposed at a lower portion of the front plate 410. The support wheel 415 can be rotatably disposed on a rear face of the front plate 410. The support wheel 415 can be rotated while in contact with a lower portion of the drum 200.

When the drum 200 is rotated by the driver, the drum 200 can be supported on the drum rotation shaft 6341 connected to the rear portion of the drum. When the laundry is accommodated in the drum 200, a load imposed to the drum rotation shaft 6341 due to the laundry can increase. Therefore, there is a risk of the drum rotation shaft 6341 being bent by the load.

When the support wheel 415 supports the front and lower portion of the drum 200, the load on the drum rotation shaft 6341 can be reduced. This can prevent the drum rotation shaft 6341 from being bent and prevent noise from being generated due to the vibration.

The support wheels 415 can be disposed at positions symmetrical to each other around a center of rotation of the drum 200 so as to support the load of the drum 200. The support wheels 415 can be disposed at left and right sides of the lower portion of the drum 200 to support the drum 200 thereon. However, the present disclosure is not limited thereto, and a larger number of support wheels 415 can be included according to an operating environment of the drum 200.

The air circulating channel 820 disposed in the base 800 can circulate the air inside the drum 200 such that the air is input back into the drum 200.

The air circulating channel 820 can include an inflow duct 821 into which the air discharged from the drum 200 flows, an air discharge duct 823 that supplies the air to the drum 200, and an air flow duct 822 connecting the inflow duct 821 and the air discharge duct 823 to each other.

When air is discharged from the front face of the drum 200, the air flow duct 822 can be located at a front side of the air circulating channel 820. The air discharge duct 823 can be located at a rear side of the air circulating channel 820.

The air discharge duct 823 can further include a blower 8231 that discharges air out of the air circulating channel 820. The blower 8231 can be disposed at the rear side of the air discharge duct 823. Air exhausted through the blower 8231 can flow to the drum 200.

A duct cover 830 can be coupled to a top of the air circulating channel 820, so that an open top face of the air circulating channel 820 can be partially shielded therewith. The duct cover 830 can prevent air from leaking out of the air circulating channel 820. In other words, the duct cover 830 can constitute one face of a channel through which air is circulated.

Further, a heat exchanger 900 disposed in the base 800 can include a first heat exchanger 910 disposed inside the air circulating channel 820 to cool the air, and a second heat exchanger 920 disposed inside the air circulating channel 820 to heat the air cooled in the first heat exchanger 910.

The first heat exchanger 910 dehumidifies the air discharged from the drum 200, and the second heat exchanger 920 can heat the dehumidified air. The heated air is supplied to the drum 200 again to dry the laundry accommodated in the drum 200.

Each of the first heat exchanger 910 and the second heat exchanger 920 can be implemented as a heat exchanger through which refrigerant flows. When being implemented as a heat exchanger through which the refrigerant flows, the first heat exchanger 910 can be implemented as an evaporator, and the second heat exchanger 920 can be implemented as a condenser. The refrigerant flowing along the first heat exchanger 910 and the second heat exchanger 920 can exchange heat with air discharged from the drum 200.

The heat exchanger 900 can include an air circulating channel fan 950 that is installed in the air circulating channel 820 to generate air flow inside the air circulating channel 820. Further, the heat exchanger 900 can further include an air circulating channel fan motor 951 that rotates the air circulating channel fan 950. The air circulating channel fan 950 can be rotated upon receiving rotation power from the air circulating channel fan motor 951. When the air circulating channel fan 950 operates, the air dehumidified by the first heat exchanger 910 and then heated by the second heat exchanger 920 can flow to the rear portion of the drum 200.

The air circulating channel fan 950 can be installed in one of the inflow duct 821, the air flow duct 822, and the air discharge duct 823. Because the air circulating channel fan 950 can be configured to rotate, noise can be generated when the air circulating channel fan 950 operates. Therefore, the air circulating channel fan 950 can be disposed in rear of the air circulating channel 820.

The air circulating channel fan 950 can be installed at the blower 8231. Further, the air circulating channel fan motor 951 can be located in rear of the blower 8231. When the air circulating channel fan 950 is rotated by the air circulating channel fan motor 951, air inside the air circulating channel 820 can be discharged out of the air circulating channel 820 via the blower 8231.

Because the laundry inlet 211 of the drum 200 can be disposed at a relatively higher position in order for the user to easily withdraw the laundry located inside the drum 200, the air circulating channel 820 and the heat exchanger 900 can be disposed below the drum 200.

The rear plate 420 can be disposed in rear of the drum 200 to guide the air discharged from the air circulating channel 820 to the drum 200. The rear plate 420 can be configured to be spaced apart from the drum rear face 220. The air circulating channel 820 can receive air inside the drum 200 through the front plate 410 and supply air to the drum 200 through the rear plate 420. Air discharged from the air circulating channel 820 can be guided to the drum 200 through the rear plate 420.

The base 800 can further include a connector 850 that guides the air discharged from the air circulating channel 820 to the rear plate 420. The connector 850 can guide the exhaust air to spread evenly throughout the rear plate 420.

The connector 850 can be installed at the blower 8231. That is, the connector 850 can guide the air discharged from the blower 8231 to the rear plate 420. The hot air supplied to the rear plate 420 can flow into the drum 200 through the drum rear face 220.

The drum 200 of the laundry treating apparatus can be rotated while being directly connected to the driver positioned in rear of the drum 200, rather than being indirectly rotated while being coupled to a belt. Therefore, unlike a drum of a conventional dryer that has a cylindrical shape in which front and rear faces are open, a rear face of the drum of the laundry treating apparatus can be shielded and can be directly coupled to the driver.

As described above, the drum 200 can include the drum body 210 having a cylindrical shape to accommodate laundry and the drum rear face 220 coupled to the rear portion of the drum body 210 to define a rear face of the drum.

The drum rear face 220 can be configured to shield the rear face of the drum body 210, and provide a coupling face for direct engagement with the driver. That is, the drum rear face 220 can be connected to the driver and receive the rotation power to rotate an entirety of the drum 200. As a result, the front face of the drum body 210 can have the laundry inlet 211 into which laundry is put, and the rear face thereof can be shielded with the drum rear face 220.

The drum rear face 220 can be equipped with a bushing 300 connecting the driver and the drum rear face 220 to each other. The bushing 300 can be disposed at the drum rear face 220 to define a center of rotation of the drum 200. The bushing 300 can be formed integrally with the drum rear face 220, or can be made of a material with greater rigidity and durability than that of the drum rear face 220 in order to be firmly coupled to the rotation shaft that transmits power. The bushing 300 can be seated on and coupled to the drum rear face 220 so as to be coaxial with the center of rotation of the drum rear face 220.

The drum rear face 220 can include a circumferential portion 221 coupled to an outer circumferential face of the drum body 210, and a mount plate 222 that can be disposed inwardly of the circumferential portion 221 and can be coupled to the driver. The bushing 300 can be seated on the mount plate 222 and can be coupled thereto. The rotation shaft that rotates the drum can be coupled to the mount plate 222 via the bushing 300, and thus can be more firmly coupled thereto. Further, this can prevent deformation of the drum rear face 220 from occurring.

The drum rear face 220 can include an intake hole 224 extending through a portion between the circumferential portion 221 and the mount plate 222, and air-communicating in a front and rear direction of the drum rear face 220. The hot air supplied through the air circulating channel 820 can be introduced into the drum body 210 through the intake hole 224. The intake hole 224 can include a plurality of holes extending through the drum rear face 220 or as a mesh.

The driver that rotates the drum 200 can be located in rear of the rear plate 420. The driver can include a motor 500 that generates rotation power and a speed reducer 600 that reduces the rotation force of the motor 500 and transmits the reduced force to the drum 200.

The motor 500 can be disposed in rear of the rear plate 420. The motor 500 can be coupled to the rear face of the rear plate 420 via the speed reducer 600.

The speed reducer 600 can be fixed to the rear face of the rear plate 420, and the motor 500 can be coupled to the rear face of the speed reducer 600. That is, the rear plate 420 can provide a support face on which the speed reducer 600 or the motor 500 is supported. However, the present disclosure is not limited thereto, and the motor 500 can be coupled to the rear plate 420.

Figure 5:
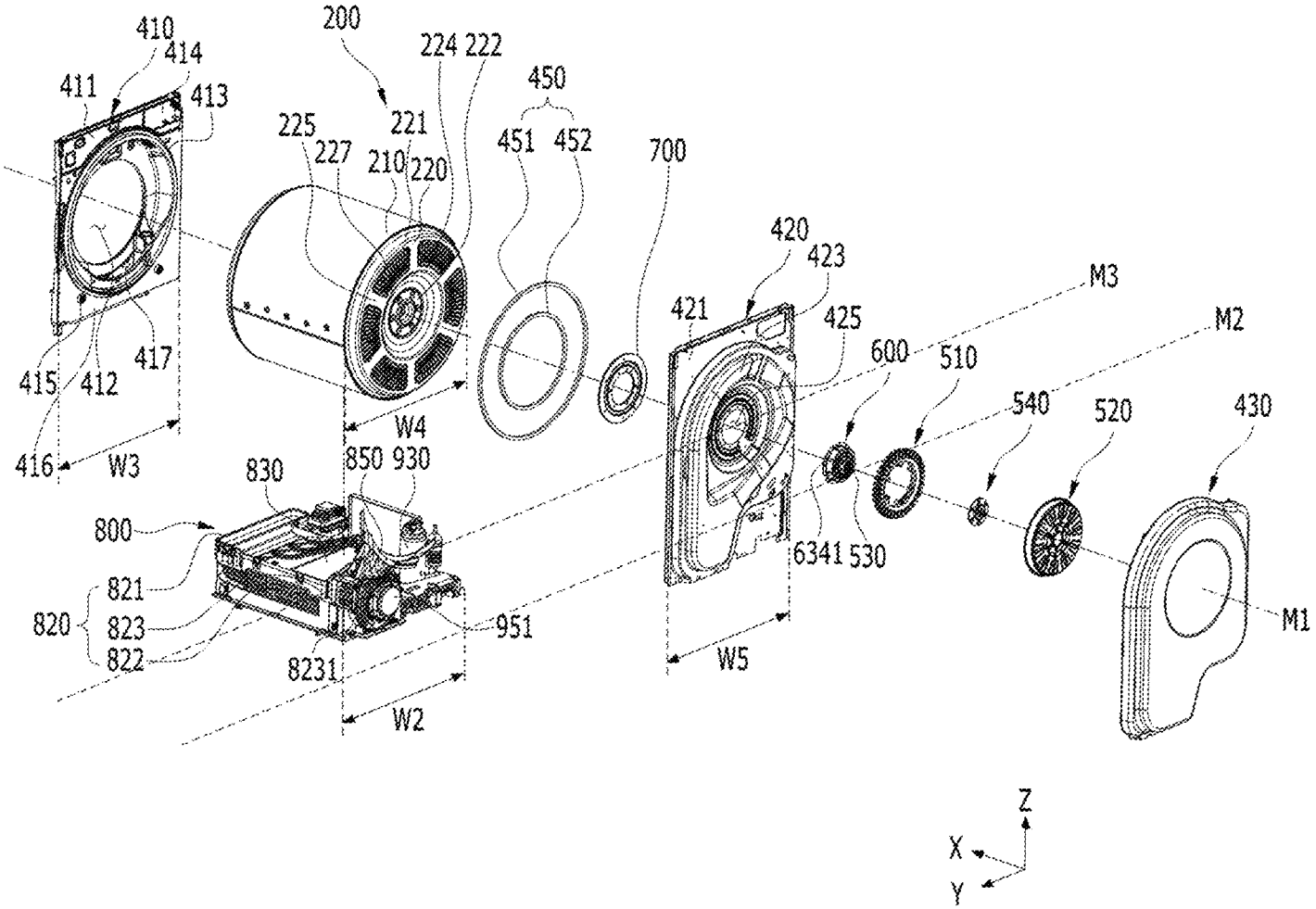
FIG. 5 is an exploded perspective view showing example of internal components of the laundry treating apparatus.

FIG. 5 is an exploded perspective view showing internal components constituting the laundry treating apparatus in a separated state from each other.

The laundry treating apparatus can include the drum 200 for accommodating the laundry, the front plate 410 for supporting the front face of the drum, the rear plate 420 located in rear of the drum, and the base 800 disposed below the drum to provide a space in which the air inside the drum is circulating or moisture contained in the air is condensed, and the motor 500, which is located in rear of the drum and provides the rotation power to the drum, the speed reducer 600 to reduce the rotation speed of the motor and deliver the rotation power to the drum, and a rear cover 430 that can be coupled to the rear plate 420 to prevent the motor from being exposed to the outside.

The base 800 can include the air circulating channel 820 which communicates with the drum 200, and receives the air from the drum or discharges the air to the drum.

The front plate 410 can include a front panel 411 constituting a front face thereof, and the inlet-communication hole 412 that is formed to extend through the front panel 411 and communicates with the drum 200. The front plate 410 can have a front gasket 413 which can be disposed on the rear face of the front panel 411 and can be configured to surround a radially outer side of the inlet-communication hole 412 and can accommodate a portion of the drum body 210.

The front gasket 413 can support the drum body 210 such that the drum body can rotate, and can be in contact with the outer circumferential face or an inner circumferential face of the laundry inlet 211. The front gasket 413 can prevent the hot air inside the drum 200 from leaking into a space between the drum body 210 and the front plate 410. The front gasket 413 can be made of a plastic resin or an elastic body. A separate sealing member can be additionally coupled to the front gasket 413 to prevent laundry or the hot air from escaping from the drum body 210 to the front plate 410.

In some examples, the front plate 410 can include a duct communication hole 417 extending through an inner circumferential face of the inlet-communication hole 412. Further, the front plate 410 can include a duct connector 416 extending downwardly of the duct communication hole 417 to define a channel communicating the drum body 210 and the air circulating channel 820 to each other.

The duct connector 416 can communicate with the drum body 210 through the duct communication hole 417, and the air discharged from the drum body 210 can flow into the duct connector 416 through the duct communication hole 417 and can be guided to the air circulating channel 820. Because the air discharged from the drum body 210 is guided to the air circulating channel 820 via the duct connector 416, this can prevent the air inside the drum from leaking out.

A filter member that filters foreign substances or lint from the air discharged from the drum 200 and prevents foreign substances from entering the air circulating channel 820 can be installed in the duct connector 416.

The support wheels 415 supporting the lower portion of the drum 200 and being rotatably installed on the rear face of the front panel 411 can be installed on the front plate 410. The support wheel 415 supports the front face of the drum 200 and thus prevents the rotation shaft connected to the drum from being bent.

The front plate 410 can have a water storage tank support hole 414 which can be configured to extend through the front panel 411, and which the water storage tank 120 (see FIG. 3) in which the condensate generated in the drying process is stored can be withdrawn through or supported on. When the water storage tank support hole 414 can be disposed a top level, the user may not have to bend his back when withdrawing the water storage tank, so that the user's convenience increases.

The drum 200 for accommodating the laundry therein can include the drum body 210 having the laundry inlet 211 defined in a front portion thereof through which the laundry is input or output, and the drum rear face 220 constituting a rear face thereof.

The drum rear face 220 can include the circumferential portion 221 connected to the drum body 210, the intake hole 224 defined inwardly of the circumferential portion 221 and extending through the drum rear face 220, and the mount plate 222 disposed at the center of rotation of the drum rear face 220, and coupled to the rotation shaft. Air can be introduced to the rear face of the drum through the intake hole 224.

The drum rear face 220 can further include a reinforcing rib 225 extending from the circumferential portion 221 toward the center of rotation. The reinforcing rib 225 can extend while bypassing the intake hole 224. The reinforcing rib 225 has the effect of preventing the rigidity of the drum rear face 220 from being reduced due to the intake hole 224. The reinforcing rib 225 can be configured to extend radially from the outer circumferential face of the mount plate 222 toward an inner circumferential face of the circumferential portion 221.

Further, the drum rear face 220 can further include a circumferential rib 227 extending in the circumferential direction of the drum rear face 220 to connect the reinforcing ribs 225 to each other. The intake holes 224 can be respectively disposed between adjacent ones of the reinforcing rib 225, the circumferential rib 227, and the circumferential portion 221. The reinforcing rib 225 and the circumferential rib 227 have the effect of preventing the drum rear face 220 from being deformed upon receiving the rotation force from the motor 500.

The inflow duct 821 can communicate with the duct communication hole 417 of the front plate 410 to communicate with a channel installed inside the front plate 410. The air flow duct 822 can extend from a distal end of the inflow duct 821 toward the rear face of the drum 200, and the air discharge duct 823 can be disposed at a distal end of the air flow duct 822 to direct the air to the drum 200.

The blower 8231 can be located downstream of the air discharge duct 823, and the blower 8231 can provide a space where the air circulating channel fan is installed. When the circulation fan channel fan operates, the air introduced into the inflow duct 821 can be discharged upwardly of the blower 8231.

In some examples, the base 800 can be equipped with the heat exchanger 900 that can cool and heat the air circulating inside the drum 200. The heat exchanger 900 can include a compressor 930 connected to the first heat exchanger and the second heat exchanger to supply compressed refrigerant. The compressor 930 can be configured so as not to directly exchange heat with the circulating air, and thus can be located out of the air circulating channel 820.

Further, the heat exchanger can include the air circulating channel fan motor 951 supported on a rear face of the blower 8231 to rotate the air circulating channel fan. The air circulating channel fan motor 951 can be coupled to the rear face of the blower 8231.

In some examples, the laundry treating apparatus can further include the connector 850 which can be coupled to the air circulating channel 820 for guiding the hot air discharged from the air circulating channel 820 to the rear portion of the drum 200 or the rear plate 420.

The connector 850 can be disposed on top of the air discharge duct 823 and be configured to guide the hot air heated through the second heat exchanger 920 upwards beyond the air discharge duct 823. Further, the connector 850 can be coupled to an opening disposed above the blower 8231.

The connector 850 can be configured to have a channel defined therein. The connector 850 can be configured to evenly guide the flow of air generated by the air circulating channel fan to the rear plate 420. That is, the connector 850 can be configured so that an area of the channel therein increases as a distance thereof from the blower 8231 increases.

The rear plate 420 can be coupled to the base 800 or supported on the base 800 and be positioned in rear of the drum 200. The rear plate 420 can be configured to include the rear panel 421 positioned to face toward the front plate 410, and a duct portion 423 recessed in the rear panel 421 to define a channel through which air flows and to guide the air discharged from the air circulating channel 820 to the drum.

The rear plate 420 can include a mount 425 to or on which the driver is coupled or supported. The mount 425 can be configured to extend through the rear panel 421 and disposed on an inner circumferential face of the duct portion 423. The mount 425 can be configured to be spaced apart from an inner circumferential face of the duct portion 423 inwardly in a radial direction.

In some implementations, the driver can include a combination of the speed reducer 600 and the motor 500 as described above. In some examples, the driver can include only the motor 500. That is, a component that generates power and transmits the rotation power to the drum can be referred to as a driver.

The driver can be mounted on the mount 425. The mount 425 can support the driver's load. The driver can be connected to the drum 200 while supported on the mount 425.

The duct portion 423 can be configured to receive a portion of the drum rear face 220. The duct portion 423 can have the channel defined therein through which air flows together with the drum rear face 220.

The driver can be installed on the mount 425 so as not to interfere with the duct portion 423. In other words, the driver can be radially inwardly spaced away from an inner circumferential face of the duct portion 423. The driver can be installed on the mount 425, while a rear portion thereof can be exposed to the outside so that it can be cooled by external air.

The driver can include the motor 500 that provides power to rotate the drum 200. The motor 500 can include a stator 510 that generates a rotating magnetic field, and a rotor 520 that can be configured to rotate by the stator 510.

The rotor 520 accommodates the stator 510 and can be equipped with an outer rotor type configured to rotate along the circumference of the stator 510. In some examples, the rotor 520 can be coupled to a drive shaft and can be directly connected to the drum 200 through the stator 510 and the mount 425. In this case, the rotor 520 can directly transmit the power to rotate the drum 200.

The rotor 520 can be coupled to the drive shaft via a washer 540. The washer 540 can perform a function of connecting the drive shaft and the rotor 520 to each other. Because a contact area between the rotor 520 and the drive shaft can increase due to the washer 540, the rotation of the rotor 520 can be transmitted more effectively.

The speed reducer 600 can be configured to connect the motor 500 and the drum 200 to each other. The speed reducer 600 can convert the power of the motor 500 to rotate the drum 200. The speed reducer 600 can be disposed between the motor 500 and the drum 200 to receive the power of the motor 500, convert the same, and transmit the same to the drum 200. The speed reducer 600 can be configured to convert the RPM of the rotor to a small RPM but increase a torque value thereof and transfer the converted RPM to the drum 200.

Specifically, the speed reducer 600 can be coupled to the rotor 520 and the drive shaft that rotates with the rotor 520. The speed reducer 600 can include a gear assembly that can be engaged with the drive shaft and rotates therewith to reduce the RPM of the drive shaft but increase the torque thereof. The gear assembly can be coupled to the drum 200 and can be connected to the drum rotation shaft to rotate the drum. Thus, when the drive shaft 530 rotates, the drum rotation shaft rotates at a slower RPM than that of the drive shaft, but with the increased torque.

The performance of this speed reducer 600 depends on whether the drive shaft and the drum rotation shaft can be kept coaxial with each other. That is, when the drive shaft and the drum rotation shaft are misaligned with each other, there is a risk that coupling between the parts constituting the gear assembly inside the speed reducer 600 and at least one of the drive shaft and the drum rotation shaft can loosen or can be disengaged. Therefore, the power of the drive shaft may not be properly transmitted to the drum rotation shaft, or the drive shaft can rotate in vain.

Further, when the drive shaft and the drum rotation shaft are misaligned with each other even temporarily, the gears inside the speed reducer 600 can be misaligned with each other and collide with each other, resulting in vibration or noise.

Further, there is a risk that the speed reducer 600 can completely deviate from its correct position or be damaged when an angle by which the drive shaft and the drum rotation shaft are misaligned with each other increases even temporarily.

In some implementations, in the laundry treating apparatuses having the speed reducer, the speed reducer 600 and the motor 500 can be fixed to a support that maintains its original state without deformation even when an external force is applied thereto.

For example, in a washing machine, the tub accommodating the drum can be first fixed to the cabinet, and then the motor and the speed reducer can be second fixed to a bearing housing made of a rigid body built into the tub by injection molding. This allows the speed reducer and the driver to tilt or vibrate together with the bearing housing or the fixing steel plate, even when significant vibrations occur in the tub. As a result, the speed reducer and the driver themselves can maintain a combined state therewith, and the drive shaft and the rotation shaft can be kept coaxial.

In some implementations, the laundry treating apparatus is a dryer, the tub fixed inside the cabinet can be omitted.

Further, because the rear panel of the cabinet is made of a relatively thin plate, even when the stator 510 is fixed thereto, the rear panel can easily vibrate or be bent due to a repulsive force when the rotor 520 rotates. When the rear panel vibrates or bends even temporarily, the rotation centers of the speed reducer 600 and the motor 500 which are in combination with the drum 200 can be misaligned with each other.

Further, because the rear panel is made of a thin steel plate, the real panel may not support both the speed reducer 600 and the motor 500. For example, when the speed reducer 600 and the motor 500 are coupled to the rear panel and are arranged side by side, a rotational moment can be generated due to a total length and weight of the speed reducer 600 and the motor 500, such that the speed reducer 600 sags downwards. As a result, the drum rotation shaft itself coupled to the drum can be misaligned with the speed reducer 600. Thus, the drum rotation shaft and the drive shaft may not be maintained at the coaxial state.

In some examples, a configuration can be considered that the stator 510 can be coupled to the rear plate 420 to support the motor 500. When a large amount of laundry is accommodated inside the drum 200, or when eccentricity occurs, the drum rotation shaft can be distorted according to the displacement of the laundry whenever the drum 200 rotates. In some examples, the stator 510 can be separated from the drum 200 and fixed to the rear plate 420, so that the drum rotation shaft can vibrate at a different dimension or tilt at a different angle than the stator 510 can do. Therefore, the coaxiality of the drum rotation shaft and the drive shaft may not be maintained.

From another point of view, the drum 200 can be supported on the front plate 410 and the rear plate 420 so that an installed position thereof can be fixed to a certain degree. Therefore, the position of the drum rotation shaft coupled to the drum 200 can be fixed to a certain degree. Therefore, even when vibration occurs in the drum 200, the vibration can be buffered by at least one of the front plate 410 or the rear plate 420.

However, when the vibration generated in the drum 200 is transmitted to the motor 500, and even when the speed reducer 600 and the motor 500 are fixed to the rear plate 420, the vibration amplitude of the drum rotation shaft is larger than the vibration amplitude of the motor 500 and the rear plate 420. Thus, there can be a problem that the drive shaft and the drum rotation shaft cannot be maintained in a coaxial relationship with each other.

In order to solve this problem, in the laundry treating apparatus, the motor 500 can be fixedly coupled to the speed reducer 600. In other words, the speed reducer 600 itself can serve as a reference point of an entirety of the driver. In other words, the speed reducer 600 can serve as a reference of the overall vibration amplitude and tilting angle of the driver.

The motor 500 is not fixed to other components of the laundry treating apparatus, but is fixed only to the speed reducer 600. Thus, when vibration is transmitted to the driver or external force is transmitted thereto, the motor 500 can tilt or vibrate simultaneously together with the speed reducer 600 when the speed reducer 600 tilts or vibrates.

As a result, the speed reducer 600 and the motor 500 can constitute one vibration system, and the speed reducer 600 and the motor 500 can be maintained in a fixed state with each other while not performing relative motion with respect to each other.

The stator 510 of the motor 500 can be directly coupled to the speed reducer 600 and fixed thereto. In this way, the installed position of the drive shaft 530 relative to the speed reducer 600 may not be changed. A center of the drive shaft 530 and a center of the speed reducer 600 can coincide with each other, and thus the drive shaft 530 can rotate in the coaxial state with the center of the speed reducer 600.

A first axis M1 can refer to an imaginary line extending in a front-rear direction along the center of rotation of the drum 200. That is, the first axis M1 can extend in parallel to an X axis.

Each of a second axis M2 and a third axis M3 can refer to an imaginary line extending in a left and right direction of the laundry treating apparatus. That is, each of the second axis M2 and the third axis M3 can be orthogonal to an XZ plane and parallel to a Y axis.

The first axis M1 and the second axis M2 can intersect each other at the speed reducer 600. Further, the first axis M1 and the third axis M3 can intersect with each other at the mount 425.

The speed reducer 600 and the motor 500 can be designed to be arranged along the first axis M1 parallel to a ground when there is no load on the drum 200 or when the motor 500 is not running.

However, when vibration occurs in the drum 200 or the motor 500, the vibration is transmitted to the speed reducer 600 and thus the speed reducer 600 is tilted, thereby causing the speed reducer 600 to temporarily tilt along the second axis M2.

In some examples, the motor 500 can be coupled to the speed reducer 600, and thus can vibrate or tilt together with the speed reducer 600. Thus, the motor 500 and the speed reducer 600 can be arranged side by side along the second axis M2. Thus, the drive shaft and the drum rotation shaft can be arranged side by side along the second axis M2.

As a result, even when the speed reducer 600 is tilted, the motor 500 can move integrally with the speed reducer 600, and thus the drive shaft and the drum rotation shaft can be maintained in a coaxial state with each other.

The speed reducer 600 can be fixedly coupled to the rear plate 420. In this case, the speed reducer 600 will tilt or vibrate while being coupled to the rear plate 420, so that the rear plate 420 plays the role of the center of the vibration system including the speed reducer 600, the motor 500, and the drum 200. Even in this case, the motor 500 can be not directly coupled to the rear plate 420, but can be only coupled to the speed reducer 600 and fixed thereto.

The speed reducer 600 and the motor 500 and the drum 200 can be arranged side by side along the first axis M1. However, the vibration of the drum 200 or the motor 500 causes the speed reducer 600 to be inclined in parallel to the third axis M3. The third axis M3 can extend through the speed reducer 600 coupled to the rear plate 420. In some examples, the speed reducer 600 and the motor 500 are coupled to each other, so that the motor 500 can be tilted in parallel to the third axis M3, just like the speed reducer 600.

Eventually, the motor 500 and the drum 200 can be coupled to the speed reducer 600, so that the motor 500 and the drum 200 can be tilted in parallel manner with respect to the speed reducer 600 or vibrate at the same time with the vibration of the speed reducer.

The coaxiality and the coincidence as above-mentioned may not mean physically perfect coaxiality and coincidence, but can allow an error range acceptable in mechanical engineering or as recognized as coaxiality or coincidence by a person skilled in the art. For example, a state in which the drive shaft 530 and the drum rotation shaft 6341 are misaligned with each other by a range within 5 degrees can be defined as being coaxial or coincident. However, the angle value is only an example, and the allowable error in design can be changed.

Because the drive shaft 530 rotates relative to the speed reducer 600 but is fixed thereto to prevent tilting of the drive shaft 530, and the stator 510 is fixed to the speed reducer 600, a distance between the stator 510 and the rotor 520 can be maintained to be constant. As a result, the collision between the stator 510 and the rotor 520 can be prevented. The noise or vibration that can occur due to the change of the rotation center as the rotor 520 rotates the stator 510 can be fundamentally blocked.

The drum rotation shaft 6341 can be configured to extend from the inside of the speed reducer 600 toward the drum 200, and can vibrate together with the speed reducer 600 and tilt tougher with the speed reducer 600. That is, the drum rotation shaft 6341 can be only configured to be rotatably coupled to the speed reducer 600, but the installed position thereof can be fixed. As a result, the drum rotation shaft 6341 and the drive shaft 530 can be arranged side by side and coaxial with each other. In other words, the center of the drum rotation shaft 6341 and the center of the drive shaft 530 can be maintained in a coinciding manner with each other.

In some examples, a sealing portion 450 can be disposed between the drum rear face 220 and the rear plate 420. The sealing portion 450 can seal between the drum rear face 220 and the rear plate 420 so that the air introduced into the duct portion 423 of the rear plate 420 may not flow out thereof and flows into the intake hole 224.

The sealing portion 450 can be disposed on each of an outer side face and an inner side face of the duct portion 423. A first sealing 451 can be disposed at a radially outer side of the duct portion 423, and a second sealing 452 can be disposed at a radially inner side. The first sealing 451 can prevent hot air between the drum rear face 220 and the duct portion 423 from leaking radially outwardly. The second sealing 452 can prevent hot air between the drum rear face 220 and the duct portion 423 from leaking radially inwardly.

In other words, the sealing portions 450 can be disposed at the radially outer and inner sides of the intake hole 224, respectively. The first sealing 451 can be disposed at the radially outer side of the intake hole 224, and the second sealing 452 can be disposed at the radially inner side of the intake hole 224.

The sealing portion 450 can be configured to be in contact with both the drum rear face 220 and the rear plate 420 in order to prevent the hot air from leaking out. Because the drum 200 rotates during the operation of the laundry treating apparatus, continuous friction from the drum rear face 220 is applied to the sealing portion 450. Therefore, the sealing portion 450 can be made of a material that can seal between the drum rear face 220 and the duct portion 423 without deterioration in performance even due to the frictional force and frictional heat generated according to rotation.

In some examples, the motor 500 or the speed reducer 600 can be coupled to the rear face of the rear plate 420, and the rear plate 420 can be made of a thin sheet metal, so that the rear plate 420 can be bent or deformed due to the load transmitted to the speed reducer 600 via the speed reducer 600 and the drum 200. That is, the rigidity of the rear plate 420 can be secured to install the speed reducer 600 and the motor 500 thereon.

In some implementations, the rear plate 420 can further include a bracket 700 to reinforce coupling rigidity. The rear plate 420 can additionally be coupled to the bracket 700 and the speed reducer 600 and the motor 500 can be coupled to the rear plate 420 via the bracket 700.

The speed reducer 600 can be coupled simultaneously to the bracket 700 and the rear plate 420. The fastener can simultaneously extend through and couple the speed reducer 600, the rear plate 420, and the bracket 700 to each other. The rear plate 420 can be coupled to the bracket 700 to ensure rigidity thereof. The speed reducer 600, the motor 500, etc. can be coupled to the rear plate 420 with the secured rigidity.

The fastening can be made in such a way that the speed reducer 600 is first coupled to the bracket 700 and the bracket 700 is then coupled to the rear plate 420. That is, the speed reducer may not be directly coupled to the rear plate 420, but can be fixed to the rear plate 420 via the bracket 700.

In some examples, when the motor 500 or the speed reducer 600 can be coupled to the rear face of the rear plate 420, the motor 500 and the speed reducer 600 can be exposed to the outside. In some examples, the motor 500 can be avoided from being exposed to the outside while being coupled to the rear face of the rear plate 420. Further, the duct portion 423 can be heated by the hot air. Therefore, the rear face of the duct portion 423 can be thermally insulated.

The rear cover 430 can be coupled to the rear face of the rear plate 420 to prevent the duct portion 423 and the motor 500 or the speed reducer 600 from being exposed to the outside. The rear cover 430 can be spaced apart from the duct portion 423 and the driver.

The rear cover 430 has the effect of preventing the motor 500 from being damaged due to external interference, or preventing the drying efficiency from being lowered due to heat loss through the duct portion 423.

Figure 6A:
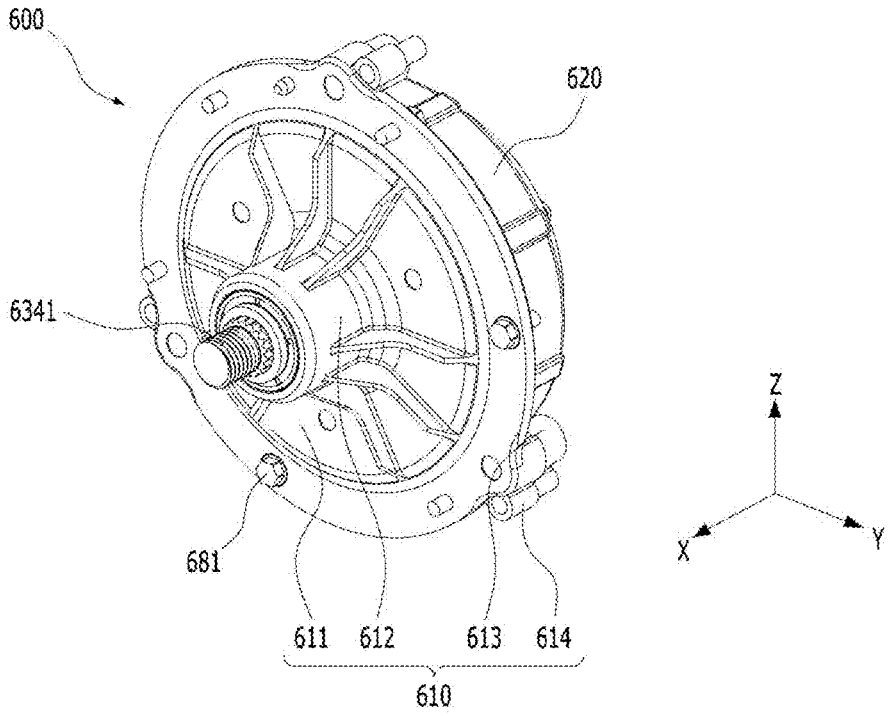
FIGS. 6A and 6B show an outer shape of an example of a speed reducer.
Figure 6B:
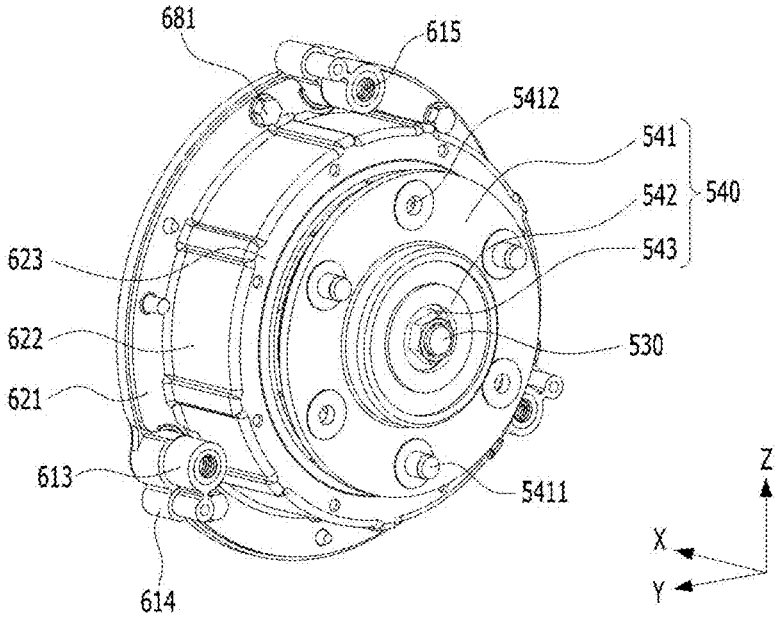

FIGS. 6A and 6B show examples of an outer shape of the speed reducer.

The speed reducer 600 can include a speed reducer housing 610 and 620 constituting an outer shape thereof. The speed reducer housing can include a first housing 610 configured to face toward the drum and a second housing 620 to face toward the motor.

The speed reducer 600 can include a gearbox. The gearbox can be configured to receive power from the motor and convert the motor's RPM to a small RPM but increase the torque value and transmit the converted rotation force to the drum. A significant portion of the gearbox can be housed inside the second housing 620, and the first housing 610 can be configured to shield the inside of the speed reducer 600. In this way, an overall thickness of the speed reducer 600 can be reduced. The detailed configuration of the gearbox will be described later.

The first housing 610 can include a first housing shielding body 611 configured to shield the second housing 620 and a first housing shaft receiving portion 612 extending from the first housing shielding body 611 in a direction away from the second housing 620. The first housing shaft receiving portion 612 can receive the drum rotation shaft 6341 and can support the drum rotation shaft 6341 such that the drum rotation shaft 6341 can rotate.

The first housing 610 can include a stator coupling portion 613 configured to support the motor. The stator coupling portion 613 can extend from a circumferential face of the first housing shielding body 611 in a direction away from the first housing shaft receiving portion 612.

The stator coupling portion 613 can include a stator fastening hole 615 to which the motor can be fastened. The stator fastening hole 615 can be recessed in the stator coupling portion 613. A separate fastener can be inserted into the stator fastening hole 615. The stator coupling portion 613 and the motor can be coupled to each other using the fastener.

The first housing 610 can further include a coupling guide 614 to guide the coupling of the motor. The coupling guide 614 can extend from the circumferential face of the first housing shielding body 611 in a direction away from the first housing shaft receiving portion 612. The coupling guide 614 can extend from the first housing shielding body 611 so as to be connected to the stator coupling portion 613. The coupling guide 614 can guide a position of the stator 510 when the stator 510 can be coupled to the stator coupling portion 613. Thus, the assembility can be improved.

Referring to FIGS. 6A and 6B, the second housing 620 can house the gear assembly therein. In general, the gearbox coupled to the speed reducer 600 can include a sun gear, a planetary gear orbiting the sun gear, and a ring gear that accommodates the planetary gear and allows the planetary gear to rotate. The second housing 620 can include a second housing coupling body 621 coupled to the first housing 610, a second housing shielding body 622 extending from the second housing coupling body 621 in a direction away from the first housing 610 and defining a space in which the gearbox is accommodated, and a second housing shaft receiving portion extending from an inner circumferential face of the second housing shielding body 622 in a direction away from the first housing 610 to support the drive shaft 530.

In some implementations, a center of the first housing 610 and a center of the second housing 620 can be designed to be coaxial with each other. When the drive shaft 530 and the drum rotation shaft 6341 are coaxial with each other, this is advantageous for power transmission. Accordingly, the first housing shaft receiving portion 612, which rotatably supports the drum rotation shaft 6341, and the second housing shaft receiving portion, which rotatably supports the drive shaft 530, can be coupled to each other so as be coaxial with each other.

The drive shaft 530 can be inserted into the second housing 620 and rotatably supported within the second housing 620. The drive shaft 530 can be coupled to the washer 540 that rotatably supports the rotor 520. The washer 540 can include a receiving body 542 having a shaft support hole 543 defined in a center thereof for receiving the drive shaft 530, and a washer coupling body 541 extending radially from an outer circumferential face of the receiving body 542 to define a face to which the rotor is coupled. The shaft support hole 543 can be formed in a groove shape corresponding to a protrusion formed on an outer circumferential face of the drive shaft 530 such that the protrusion can be received in the groove.

The washer 540 can include at least one washer coupling protrusion 5411 configured to protrude from the washer coupling body 541 in a direction away from the speed reducer. Further, the washer 540 can include one or more washer coupling holes 5412 extending through the washer coupling body 541.

The washer coupling protrusion 5411 can be coupled to a receiving groove formed in the rotor. A fastener passing through the rotor can be inserted into the washer coupling hole 5412 to couple the rotor and the washer 540 to each other.

A plurality of washer coupling protrusions 5411 and a plurality of washer coupling holes 5412 can be alternately arranged along a circumferential direction and can be disposed on a surface of the washer coupling body 541.

Figure 7:
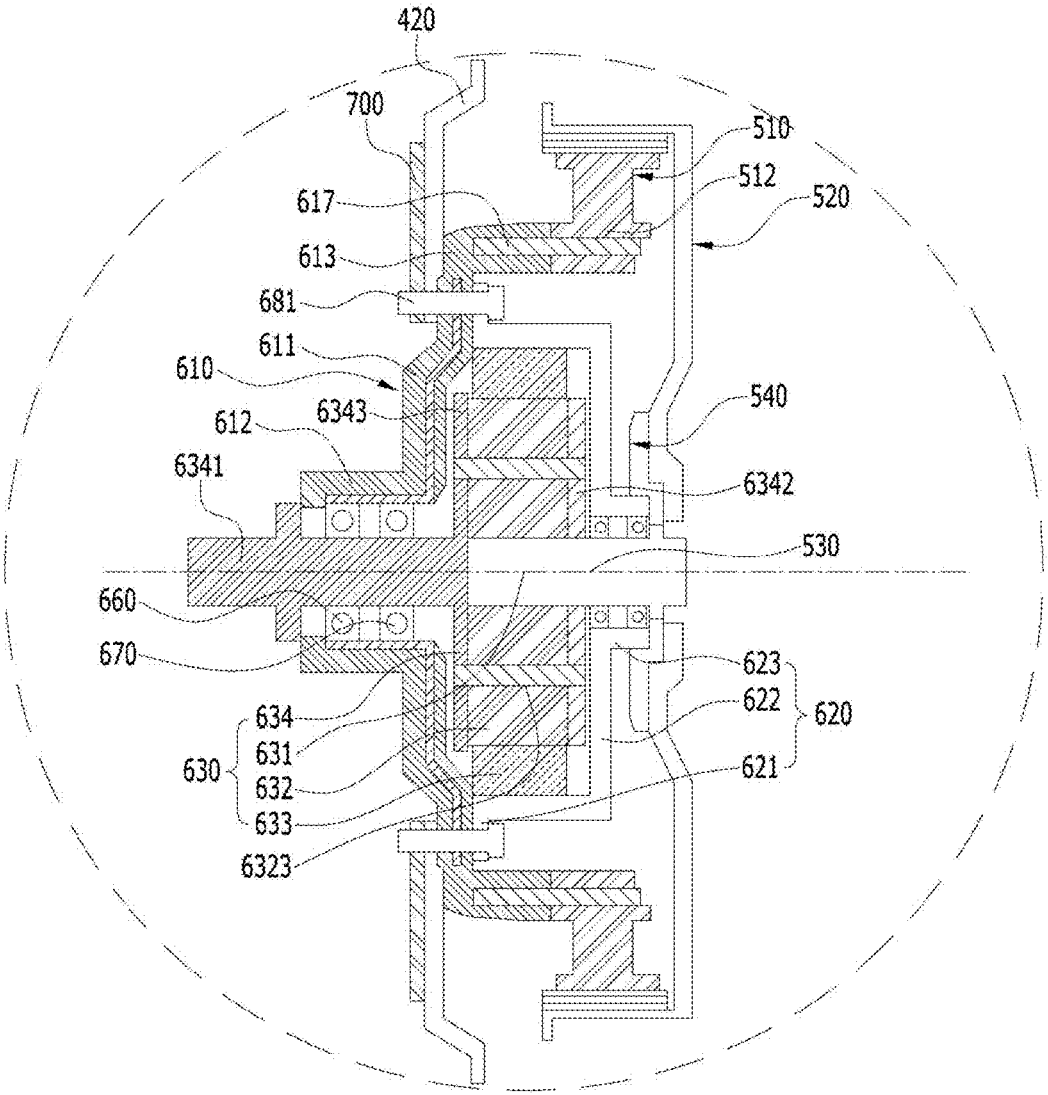
FIG. 7 is an enlarged and detailed cross-sectional view of examples of the motor and the speed reducer.

FIG. 7 is an enlarged cross-sectional view of the driver.

The driver can include the motor 500 that generates rotation power and the speed reducer that reduces the rotation speed of the motor 500 and delivers the rotation power having the reduced speed to the drum. The speed reducer 600 can include the drum rotation shaft 6341 that rotates the drum.

The motor 500 can include the stator 510 that generates a rotating magnetic field upon receiving external power and the rotor 520 that surrounds an outer circumferential face of the stator 510. Permanent magnets can be disposed on an inner circumferential face of the rotor 520.

The permanent magnets located on an inner circumferential face of the rotor 520 can move in a specific direction via rotating magnetism generated by the stator 510, and the permanent magnet can be fixed to an inner circumferential face of the rotor 520. Therefore, the rotor 520 can be rotated under the rotating magnetic field of the stator 510.

The drive shaft 530 that rotates together with the rotor 520 and transmits the rotation power of the rotor 520 can be coupled to a center of rotation of the rotor 520. The drive shaft 530 can be configured to rotate together with the rotor 520. The drive shaft 530 can be coupled to the rotor 520 via the washer 540.

The drive shaft 530 can be directly connected to the rotor 520. Alternatively, when the drive shaft 530 is connected to the rotor via the washer 540, the rotor 520 can be coupled thereto more firmly and thus can transmit the rotation force of the rotor 520 more effectively. Further, this can prevent the load from being concentrated on the drive shaft 530, thereby increasing the durability of the drive shaft 530.

The drive shaft 530 can be directly connected to the drum. In some cases, the drive shaft 530 can rotate at the same speed as that of the rotor 520. In some cases, the speed of the drive shaft 530 can be decelerated to rotate the drum. For example, the drive shaft 530 can be connected to the speed reducer, and the speed reducer can be connected to the drum. That is, the speed reducer can decelerate the rotation of the drive shaft 530 to rotate the drum in the decelerated manner.

The speed reducer 600 can include a first housing 610 and a second housing 620 constituting an outer shape, and the gearbox 630 for reducing the power of the drive shaft 530. The second housing 620 can provide a space to accommodate the gearbox 630 therein, and the first housing 610 can shield the accommodating space defined in the second housing 620.

The second housing 620 can include a second housing coupling body 621 coupled to the first housing 610, a second housing shielding body 622 extending rearwards from an inner circumferential face of the second housing coupling body 621 to define the receiving space for receiving the gearbox 630, and a second housing shaft receiving portion 623 extending rearwardly from the second housing shielding body 622 and configured to receive the drive shaft 530.

The gearbox 630 can include the ring gear 633 installed along an inner circumferential face of the second housing shielding body 622. One or more planetary gear 632 meshed with the ring gear 633 can be disposed on an inner circumferential face of the ring gear 633. The planetary gear 632 can be meshed with the ring gear 633, and the sun gear 631 can rotate together with the drive shaft 530.

The sun gear 631 can be configured to rotate while being coupled to the drive shaft 530. The sun gear 631 can be implemented as a separate member from the drive shaft 530. The disclosure is not limited thereto, and the sun gear 631 can be formed integrally with the drive shaft 530.

Each of the sun gear 631, the planetary gear 632 and the ring gear 633 can be implemented as a helical gear. When each gear is implemented as the helical gear, noise can be reduced and power transmission efficiency can increase. However, the present disclosure is not limited thereto, and each of the sun gear 631, the planetary gear 632, and the ring gear 633 can be implemented as a spur gear.

In an operation example of the gearbox 630, as the rotor rotates, the drive shaft 530 and the sun gear 631 connected to the drive shaft 530 rotate. Thus, the planetary gear 632 meshed with an outer circumferential face of the sun gear 631 can rotate while being disposed between the ring gear 633 and the sun gear 631.

The planetary gear 632 can include a planetary gear shaft 6323 that is inserted into the center of rotation. The planetary gear shaft 6323 can rotatably support the planetary gear 632.

The speed reducer can further include a first carrier 6342 and a second carrier 6343 supporting the planetary gear shaft 6323. A front face of the planetary gear shaft 6323 can be supported on the second carrier 6343, while a rear face thereof can be supported on the first carrier 6342.

The drum rotation shaft 6341 can extend from the rotation center of the second carrier 6343 in a direction away from the motor. The drum rotation shaft 6341 can be implemented as a separate component from the second carrier 6343 and can be coupled thereto such that both rotate together. To the contrary, the drum rotation shaft 6341 can extend from the second carrier 6343 and be integrally formed with the second carrier 6343.

The drum rotation shaft 6341 can be coupled to the drum to rotate the drum. As described above, the drum rotation shaft 6341 can be coupled to the drum via a connecting body such as a bushing, or can be directly coupled to the drum without a separate connecting body.

The drum rotation shaft 6341 can be supported on the first housing 610. The first housing 610 can include a first housing shielding body 611 shielding the receiving space of the second housing 620, and a first housing shaft receiving portion 612 extending from the first housing shielding body 611 in a direction away from the second housing 620 to accommodate the drum rotation shaft 6341 therein. A first bearing 660 and a second bearing 670 can be press-fitted to an inner circumferential face of the first housing shaft receiving portion 612 to rotatably support the drum rotation shaft 6341.

The first housing 610 and the second housing 620 can be coupled to each other via a speed reducer fastener 681. Further, the speed reducer fastener 681 passes through the first housing 610 and the second housing 620 at the same time and can couple both to each other. Further, the speed reducer fastener 681 passes through the first housing 610, the second housing 620 and the rear plate 420 simultaneously to couple the first housing 610 and the second housing 620 to each other and at the same time to fix the speed reducer 600 to the rear plate 420.

The rear plate 420 can be made of a thin steel plate. Therefore, the rear plate 420 may not secure the rigidity thereof to support all of the speed reducer 600, the motor 500 connected to the speed reducer 600, and the drum 200 connected to the speed reducer 600. Therefore, the bracket 700 can be used to secure the rigidity of the rear plate 420 when coupling the speed reducer 600 to the rear plate 420. The bracket 700 can be made of a material with higher rigidity than that of the rear plate 420 and can be coupled to the front face or rear of the rear plate 420.

The bracket 700 can be coupled to the front face of the rear plate 420 to secure the rigidity such that the speed reducer 600 can be coupled thereto, and the speed reducer 600 can be coupled to the rear plate 420 and the bracket 700 at the same time. A fastener such as a bolt can be used to couple the rear plate 420 to the bracket 700 and the speed reducer.

Further, in order to secure the speed reducer 600 to the rear plate 420, the speed reducer fastener 681 that is used to couple the first housing 610 and the second housing 620 to each other can be used. That is, the speed reducer fastener 681 can extend through the second housing 620, the first housing, the rear plate 420 and the bracket 700 at the same time to couple all thereof to each other. Thus, a front face of the rear plate 420 can be supported on the bracket 700 and a rear face thereof can be supported on the first housing 610. Thus, when the speed reducer 600 can be coupled to the rear plate 420, the rigidity thereof can be secured. However, the present disclosure is not limited thereto. First, only the first housing 610 and the second housing 620 can be coupled to each other using the speed reducer fastener 681, and then the speed reducer 600 can be coupled to the rear plate 420 using a separate fastener.

Further, the stator coupling portion 613 to which the motor 500 can be coupled can be formed at a radially outer side of the first housing 610. The stator coupling portion 613 can include a coupling groove formed by recessing which the stator coupling portion 613.

The stator 510 can be directly coupled to the rear plate 420, or can be coupled to the stator coupling portion 613. The stator 510 can include a fixing rib 512 that can be disposed on an inner circumferential face thereof to support the stator. The fixing rib 512 can be coupled to the stator coupling portion 613. The fixing rib 512 and the stator coupling portion 613 can be coupled to each other via a stator coupling pin 617.

The motor 500 can be coupled to the speed reducer 600 while being spaced apart from the rear plate 420, so that the motor 500 and the speed reducer 600 can constitute a single vibrating body. Therefore, even when external vibration is applied, the drive shaft 530 coupled to the rotor 520 and the drum rotation shaft 6341 connected to the speed reducer 600 can easily maintain the coaxial relationship with each other.

There is a risk that an axial direction of the drum rotation shaft 6341 can tilt due to the vibration of the drum 200. However, the motor 500 can be coupled to the first housing 610 supporting the drum rotation shaft 6341, such that even when the axial direction of the drum rotation shaft 6341 tilts, an axial direction of the drive shaft 530 can tilt by the same degree via the first housing 610. That is, the motor 500 can move integrally with the speed reducer 600 so that the drum rotation shaft 6341 and the drive shaft 530 can be maintained in a coaxial relationship with each other even when the external force is applied thereto.

Under the above coupling structure, the efficiency and reliability at which the power generated from the motor 500 is transmitted to the drum 200 can increase, and wear, decrease in power transmission efficiency and durability and reliability of the gearbox 630 as caused by the axial misalignment between the drum rotation shaft 6341 and the drive shaft 530 can be prevented.

Figure 8:
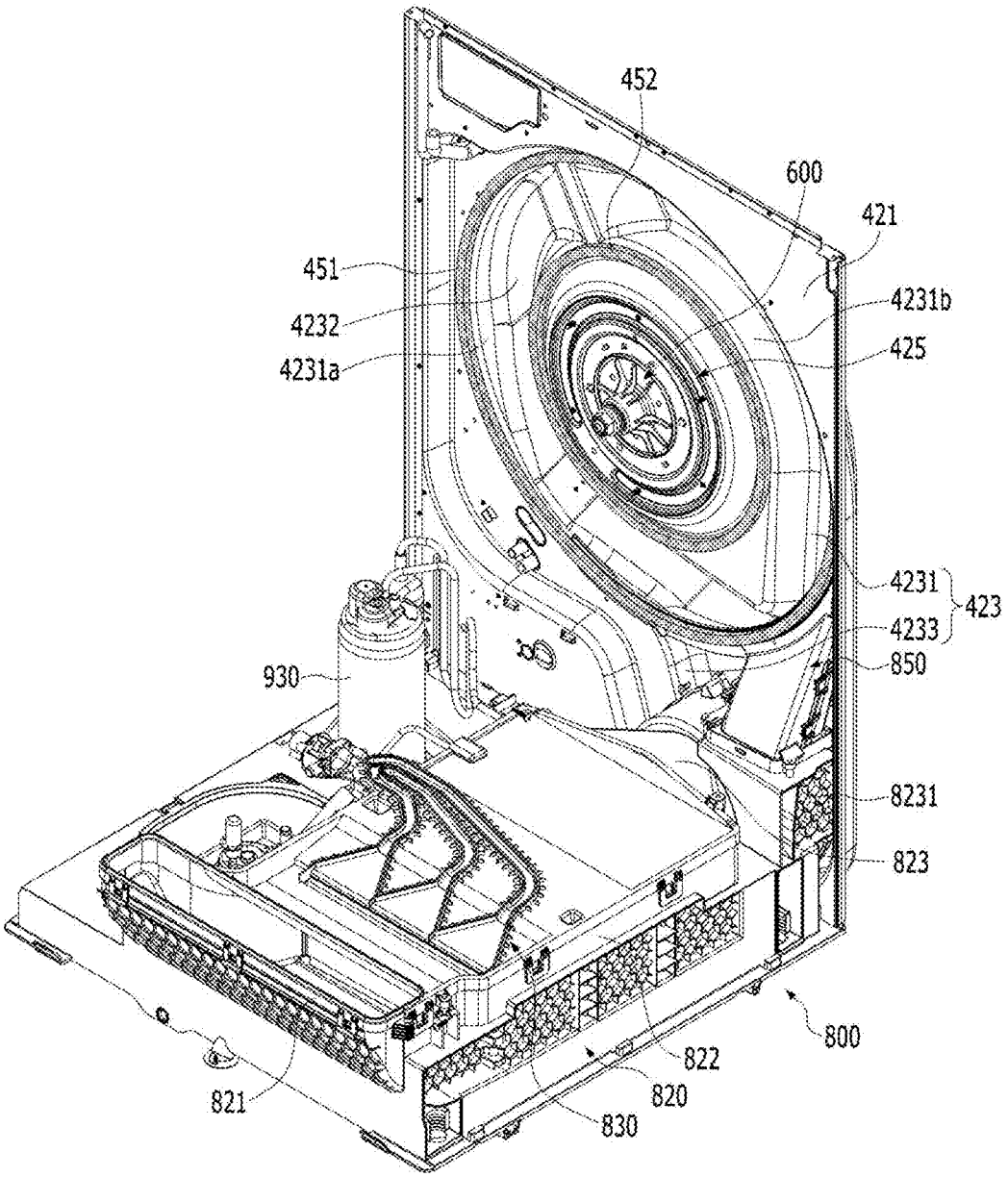
FIG. 8 shows an example of a base and a rear plate.

FIG. 8 shows the base and the rear plate.

Referring to FIG. 8, the rear plate 420 can be located in rear of the drum. The rear plate 420 can guide the hot air discharged from the air circulating channel 820 to the drum. That is, the rear plate 420 can be located in rear of the drum to define a channel so that the hot air is uniformly supplied to an entirety of the drum.

The rear plate 420 can include the rear panel 421 facing toward the drum rear face, and the duct portion 423 that can be configured to be recessed rearwardly in the rear panel 421 to define a channel. The duct portion 423 can be formed by pressing backwards the rear panel 421. The duct portion 423 can be configured to receive a portion of the drum rear face.

The duct portion 423 can include an air inlet 4233 positioned in rear of the air circulating channel and an air flow portion 4231 positioned in rear of the drum. The air flow portion 4231 can be configured to receive a portion of the drum. The air flow portion 4231 can accommodate a portion of the drum, and can define a channel located in rear of the drum.

The air flow portion 4231 can be formed in an annular shape so as to face toward the intake hole defined in the rear face of the drum. The air flow portion 4231 can be configured to be recessed in the rear panel 421. That is, the air flow portion 4231 can be configured so that a front face thereof is open, and can define a channel together with the rear face of the drum.

When the front face of the air flow portion 4231 can be configured to be open, the hot air flowing to the air flow portion 4231 can directly flow to the drum without passing through a separate component. Accordingly, this can prevent heat loss from occurring while hot air passes through the separate component. That is, there is an effect that can increase the drying efficiency by reducing the heat loss of the hot air.

The rear plate 420 can include the mount 425 disposed at the radially inner side of the air flow portion 4231. The mount 425 can provide a location to which the speed reducer 600 or the motor 500 is coupled. That is, the rear plate 420 can include the mount 425 disposed at an inner side thereof, and the air flow portion 4231 formed in an annular shape and disposed at a radially outer side of the mount 425.

Specifically, the air flow portion 4231 can include an outer circumferential portion 4231*a* disposed outwardly of and surrounding an inner space in which hot air flows. Further, the air flow portion 4231 can include an inner circumferential portion 4231*b* disposed inward of and surrounding the inner space in which hot air flows. That is, the outer circumferential portion 4231*a* can constitute an outer circumference of the air flow portion 4231, and the inner circumferential portion 4231*b* can constitute an inner circumference of the air flow portion 4231.

Further, the air flow portion 4231 can include a recessed face 4232 that forms a rear face of the channel through which the hot air flows. The recessed face 4232 can be configured to connect the outer circumferential portion 4231*a* and the inner circumferential portion 4231*b* to each other. That is, a space in which the hot air discharged from the air circulating channel 820 flows can be defined by the inner circumferential portion 4231*b*, the outer circumferential portion 4231*a*, and the recessed face 4232.

Further, the recessed face 4232 prevents the hot air from leaking rearwardly and guides the hot air toward the drum. That is, the recessed face 4232 can be recessed in the air flow portion 4231.

The air inlet 4233 can be positioned to face toward the air circulating channel 820. The inlet can be positioned to face toward the blower 8231. The air inlet 4233 can be configured to be recessed backwards in the rear panel 421 to prevent interference with the blower 8231. A top of the air inlet 4233 can be connected to the air flow portion 4231.

The laundry treating apparatus can include the connector 850 connected to the blower 8231. The connector 850 can guide the hot air discharged from the blower 8231 to the air flow portion 4231. The connector 850 can have a channel defined therein to guide the hot air discharged from the blower 8231 to the air flow portion 4231. That is, the connector 850 can define the channel for connecting the blower 8231 and the air flow portion 4231 to each other. A cross-sectional area of the channel defined inside the connector 850 can be configured to increase as the channel extends away from the blower 8231.

The connector 850 can be positioned to face toward the air inlet 4233. The air inlet 4233 can be formed to be recessed backwards to prevent interference with the connector 850. Further, a top of the connector 850 can be configured to partition the air flow portion 4231 and the air inlet 4233 from each other. That is, the hot air discharged from the connector 850 can be introduced into the air flow portion 4231, but can be prevented from flowing into the air inlet 4233.

The connector 850 can be configured to evenly supply the hot air to the air flow portion 4231. The connector 850 can be configured so that a width thereof increases as a distance thereof from the blower 8231 increases. The top of the connector 850 can be positioned along a circumferential extension line of the outer circumferential portion 4231*a*.

Accordingly, the hot air discharged from the connector 850 can be supplied to an entirety of the air flow portion 4231 without flowing to the air inlet 4233. The connector 850 prevents the hot air from being concentrated on one side of the air flow portion 4231, so that the hot air can be evenly supplied to the inside of the drum. Therefore, there is an effect of increasing the drying efficiency of laundry.

The connector 850 can be configured to increase in a width thereof as it extends toward an upstream side, so that a velocity of hot air flowing along the connector 850 can be reduced according to a flow direction. That is, the connector 850 can perform a function of a diffuser that adjusts a speed of the hot air. The connector 850 can reduce the speed of the hot air to prevent the hot air from being concentrated on a specific portion of the drum.

Due to the shape of the connector 850 as described above, the air inlet 4233 configured to face toward the connector 850, and configured to prevent interference with the connector 850 can be configured to increase in a width thereof as a distance thereof from the blower 8231 increases. Due to the shape of the air inlet 4233, an overall shape of the duct portion 423 can have a character '9' in a front view.

Because the drum can be configured to rotate during the drying cycle, the drum can be configured to be spaced apart from the air flow portion 4231 by a predetermined distance. Hot air can escape through a separation space.

Accordingly, the laundry treating apparatus can further include the sealing portion 450 that prevents the hot air from leaking into the separation space between the drum and the air flow portion 4231. The sealing portion 450 can be positioned along a perimeter of the air flow portion 4231.

The sealing portion 450 can include the first sealing 451 extending along the outer circumference of the air flow portion 4231. The first sealing 451 can be disposed between the drum and the outer circumference of the air flow portion 4231. Further, the first sealing 451 can be configured to contact both the drum rear face 220 and the rear plate 420 to prevent the leakage more effectively.

In some examples, the first sealing 451 can be configured to be in contact with the front face of the connector 850. Further, the first sealing 451 can be configured to be in contact with the top of the connector 850. The connector 850 can define a channel through which hot air flows together with the air flow portion 4231. Therefore, the first sealing 451 can be configured to be in contact with connector 850 to prevent the hot air from leaking into a space between the drum and the connector 850.

The sealing portion 450 can include the second sealing 452 extending along an inner circumference of the air flow portion 4231. The second sealing 452 can be disposed between the drum and an inner circumference of the air flow portion 4231. Further, the second sealing 452 can be configured to contact both the drum rear face 220 and the rear plate 420. The second sealing 452 can prevent the hot air flowing along the air flow portion 4231 from leaking toward the mount 425.

Because the drum 200 rotates during the operation of the laundry treating apparatus, continuous friction from the drum rear face 220 is applied to the sealing portion 450. Therefore, the sealing portion 450 can be made of a material capable of sealing between the drum rear face 220 and the air flow portion 4231 without deterioration in performance even with frictional force and frictional heat generated according to the rotation.

Figure 9:
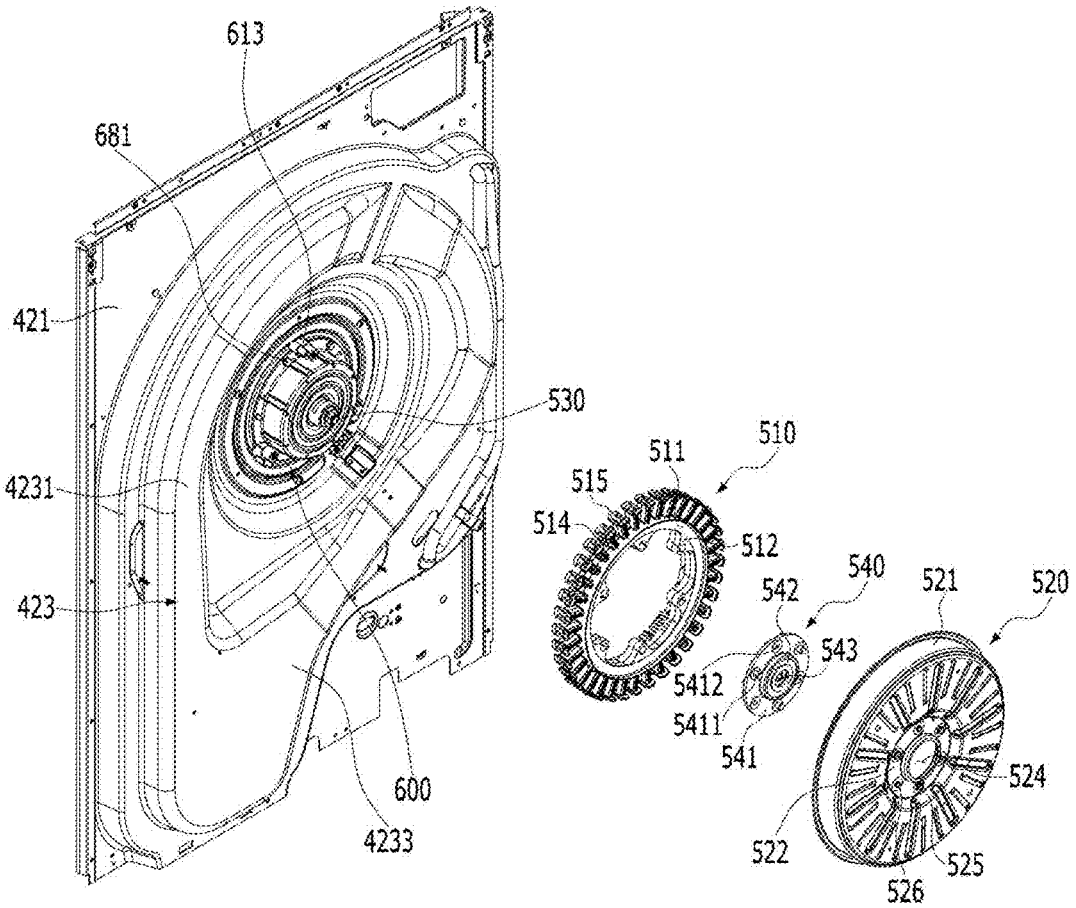
FIG. 9 shows an example of the rear plate, the speed reducer, and the motor.

FIG. 9 shows a combined structure of the rear plate and the speed reducer, and the motor.

Referring to FIG. 9, the speed reducer 600 can be supported on the rear plate 420, and the motor 500 can be coupled to the speed reducer 600. That is, the rear plate 420 can be configured to support both the speed reducer 600 and the motor 500.

The motor 500 that provides the rotation power and a speed reducer 600 that decelerates the power of the motor and transmits the same to the drum can be located in rear of the rear plate 420.

The speed reducer 600 can be installed on the rear plate 420 so as to be located inside the duct portion 423. The speed reducer 600 can be positioned radially inwardly of the air flow portion 4231 to prevent interference with the air flow portion 4231.

A gear unit inside the speed reducer 600 can be damaged by the heat of the hot air flowing along the air flow portion 4231. Accordingly, the air flow portion 4231 and the speed reducer 600 can be configured to be spaced apart from each other by a predetermined distance.

The speed reducer 600 can be coupled t and extend through the rear plate 420. Therefore, the speed reducer 600 can be connected to the drum located in front of the rear plate 420.

The stator 510 can be coupled to the speed reducer 600. The stator 510 can be coupled to the speed reducer 600 and can be installed to be spaced apart from the rear plate 420. In some examples, the speed reducer 600 can be located between the drum and the motor and can support the drum and the motor such that the drum and the motor are spaced apart from the rear plate 420. That is, the speed reducer 600 can act as a center supporting the drum and the motor.

In some examples, the stator 510 can include the main body 511 formed in a ring shape, the fixing rib 512 that extends from an inner circumferential face of the main body 511 and can be coupled to the stator coupling portion 613 of the speed reducer, teeth 514 extending from and along an outer circumferential face of the main body 511 so that a coil is wound around the teeth, and a pole shoe 515 disposed at a free end of the teeth 514 to prevent the coil from being removed.

The rotor 520 can include the rotor body 521 that can be formed in a cylindrical hollow shape. Further, the rotor 520 can include an installation body 522 that is recessed frontwards in a rear face of the rotor body 521. The rotor 520 can have permanent magnets disposed along an inner circumferential face of the rotor body 521.

The rotor 520 can be coupled to the drive shaft 530 to transmit the rotation power of the rotor 520 to an external component via the drive shaft 530. The drive shaft 530 can be connected to the rotor 520 via the washer 540.

Further, the motor 500 can include the washer 540 that supports the drive shaft 530. The washer 540 can include the washer coupling body 541 that is coupled to the rotor. The washer coupling body 541 can be formed in a disk shape.

The washer 540 can include the receiving body 542 that is housed in the rotor. The receiving body 542 can be configured to protrude rearward from the washer coupling body 541. The washer 540 can include the shaft support hole 543 extending through the center of the receiving body 542. The drive shaft 530 can be inserted into the shaft support hole 543 and supported on the washer 540.

Further, the washer 540 can include the washer coupling hole 5412 extending through the washer coupling body 541. Further, the installation body 522 can include a rotor coupling hole 526 disposed at a position corresponding to that of the washer coupling hole 5412. That is, the washer 540 and the rotor 520 can be coupled to each other via a coupling member that passes through the washer coupling hole 5412 and the rotor coupling hole 526 at the same time. That is, the washer 540 and the rotor 520 can be coupled to each other so as to rotate together.

Further, the washer 540 can include the washer coupling protrusion 5411 that projects rearward from the washer coupling body 541. Further, the installation body 522 can include a washer protrusion receiving hole 525 configured to correspond to the washer coupling protrusion 5411. The washer coupling protrusion 5411 can be inserted into the washer protrusion receiving hole 525 to support the coupling between the washer 540 and the rotor 520.

Further, the rotor 520 can include a rotor installation hole 524 that extends through a center of the installation body 522. The rotor installation hole 524 can accommodate the receiving body 542 therein. Accordingly, the washer 540 can rotate together with the drive shaft 530 via the rotor 520 and can firmly support the coupling between the drive shaft 530 and the rotor 520. Therefore, this can secure the durability and reliability of an entirety of the motor 500.

Figure 10:
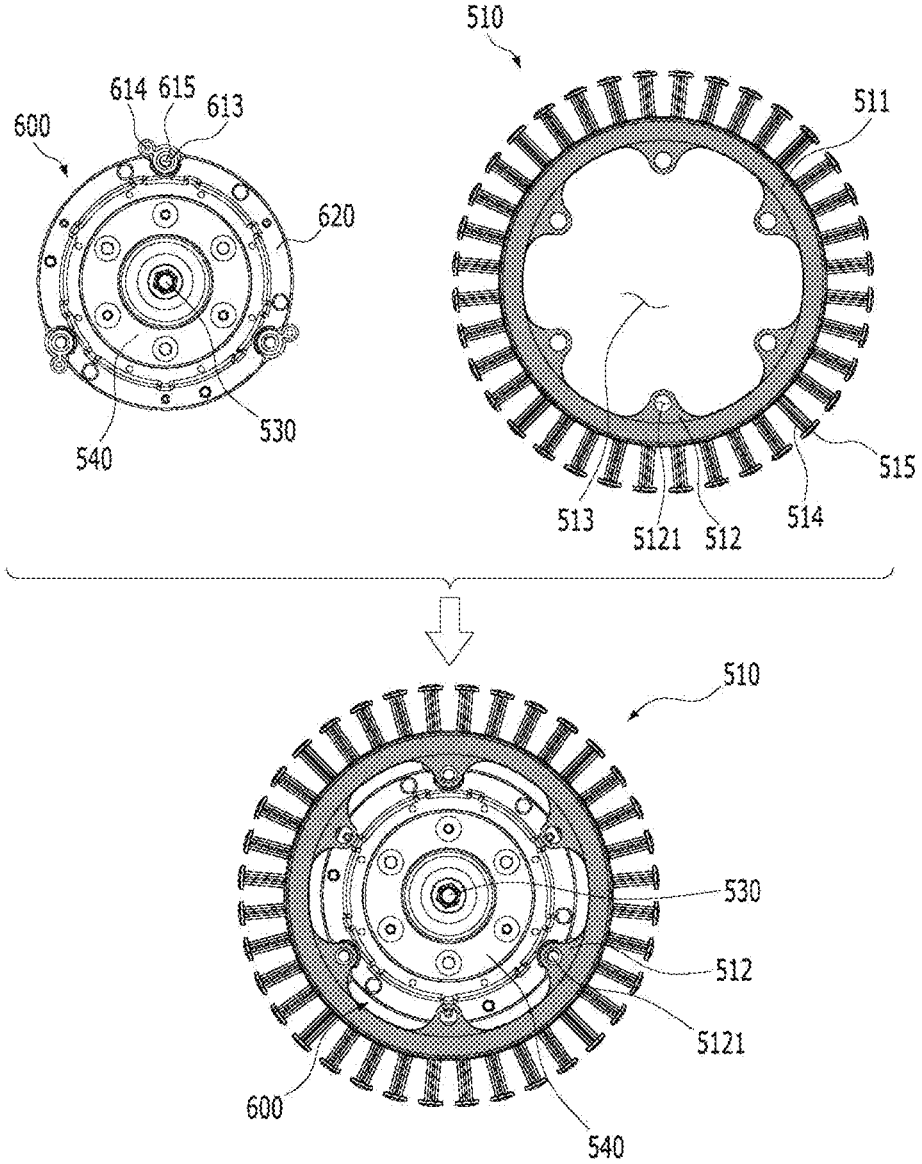
FIG. 10 shows an example of the speed reducer and the stator.

FIG. 10 shows a coupling structure of the speed reducer and the stator from the rear.

The stator 510 can include the main body 511 formed in a ring shape and fixed to the speed reducer 600, the fixing rib 512 extending from an inner circumferential face of the main body 511 and coupled to the stator fastening hole 615 of the speed reducer, the teeth 514 extending from and along the outer circumferential face of the main body 511 and configured so that the coil is wound around the teeth, the pole shoe 515 disposed at the free end of the teeth 514 to prevent the coil from being removed, and a terminal that controls supply of the current to the coil.

The stator 510 can include a receiving space 513 defined inside the main body 511 and extending through the main body 511. A plurality of fixing ribs 512 can be arranged to be spaced apart by a certain angular spacing around the receiving space 513 and can be disposed inside the main body 511. A fixed rib hole 5121 where a fixing member is installed can be defined inside the fixing rib 512 so that the fixed rib hole 5121 and the stator fastening hole 615 of the speed reducer can be coupled to each other using the fixing member such as a pin.

When the stator 510 is directly coupled to the speed reducer 600, a portion of the speed reducer 600 can be configured to be accommodated in the stator 510. In particular, when the speed reducer 600 is accommodated in the stator 510, an overall thickness of the driver including both the speed reducer and the motor can be reduced, so that to volume of the drum can be further expanded.

In some examples, the speed reducer 600 can have a diameter smaller than a diameter of the main body 511. That is, each of the first housing 610 and the second housing 620 can have a largest diameter smaller than the diameter of the main body 511. Accordingly, the speed reducer 600 can be configured such that at least a portion thereof is accommodated in the main body 511. However, the stator coupling portion 613 can extend from the housing of the speed reducer so as to overlap the fixing rib 512. Accordingly, the stator coupling portion 613 can be coupled to the fixing rib 512 and portions of the first housing and the second housing 620 can be positioned inside the main body 511.

Figure 11:
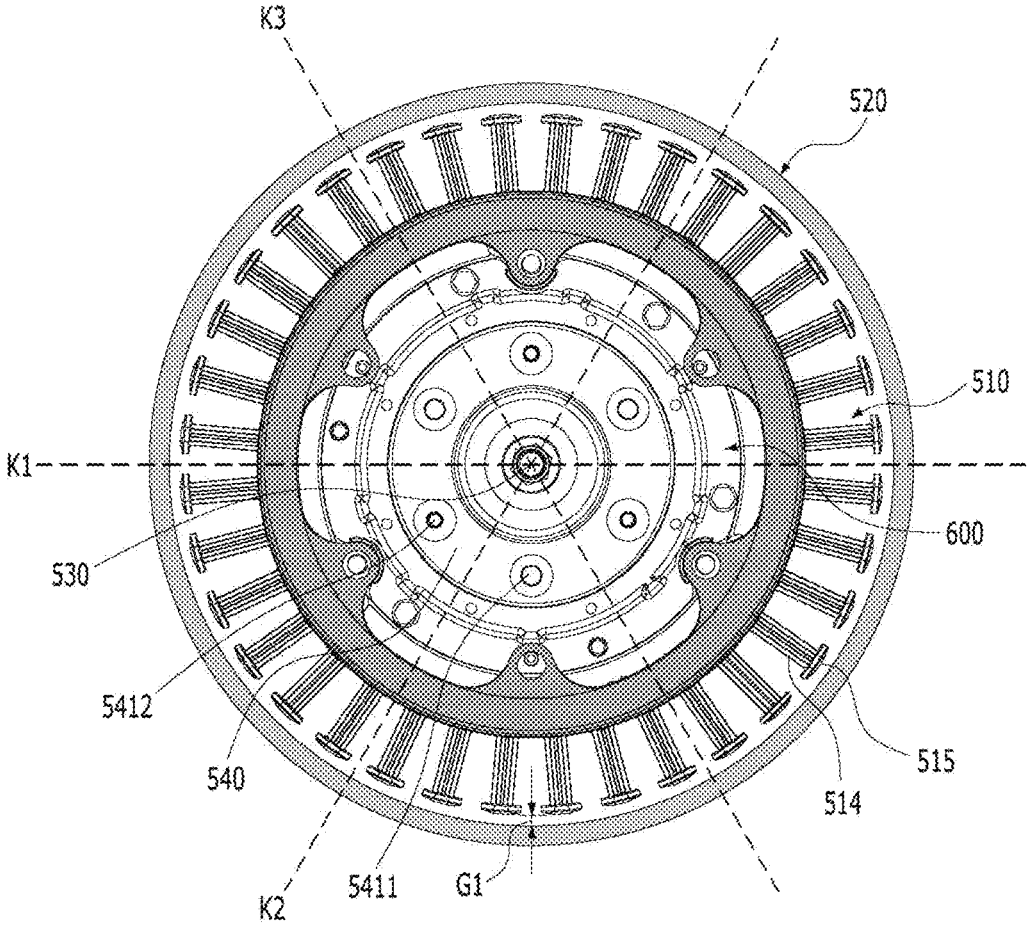
FIG. 11 shows an example of a speed reducer and a motor.

FIG. 11 shows combination of the speed reducer and the motor.

The stator 510 can be coupled to the speed reducer 600. The stator can be coupled to the stator coupling portion 613 protruding outwardly from the housing of the speed reducer 600 so that at least a portion of the speed reducer can be accommodated inside the main body 511. Thus, the center of the main body 511 and the centers of the drive shaft 530 and the speed reducer 600 can be kept in a coaxial relationship with each other.

In some examples, the rotor 520 can be positioned to accommodate the stator 510 therein while being spaced apart from the pole shoe 515 by a certain distance. Because the drive shaft 530 is fixed to the speed reducer 600 housed in the main body 511, a gap G1 between the rotor 520 and the stator 510 can be maintained.

Therefore, the rotor 520 and the stator 510 can be prevented from colliding with each other or the rotor can be prevented from rotating while the rotor is temporarily misaligned with the stator, so that noise or vibrations can be prevented.

In some examples, all of an imaginary first diameter line K1 passing through the center of the speed reducer 600 and the center of the drive shaft 530, and an imaginary second diameter line K2 passing through the center of the main body 511, and an imaginary third diameter line K3 passing through the center of the rotor 520 can meet each other at the rotation center of the speed reducer 600.

In this way, the speed reducer 600 itself can act as the center of rotation of the drive shaft 530, and the stator 510 can be fixed directly to the speed reducer 600, so that the drive shaft 530 can be prevented from being misaligned with the speed reducer 600. As a result, the reliability of the speed reducer 600 can be guaranteed.

Figure 12:
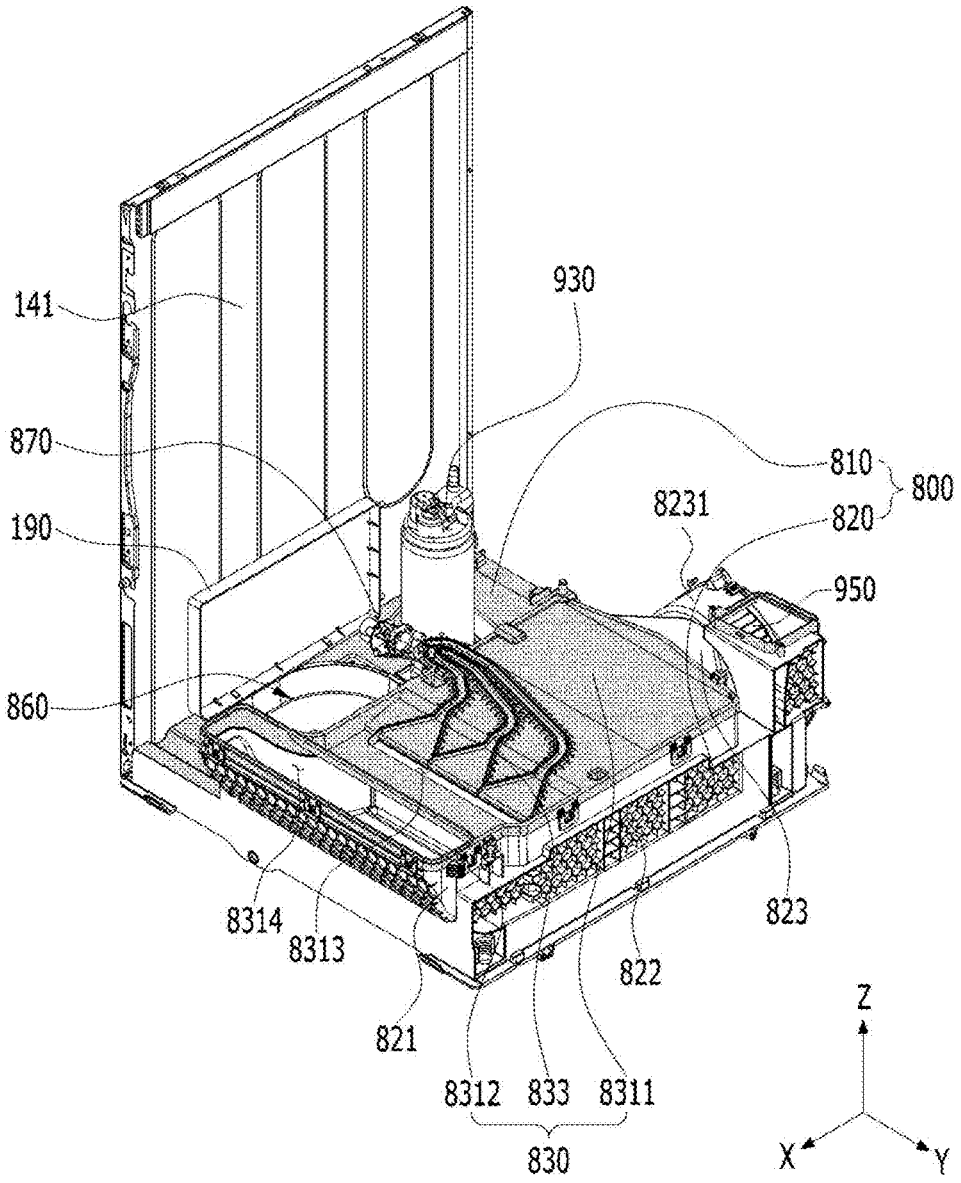
FIG. 12 is a perspective view showing an example of the base.

FIG. 12 is a perspective view showing the base 800 of the laundry treating apparatus.

Referring to FIG. 12, the base 800 can include the air circulating channel 820 which can be disposed at one side of the base 800, and circulate the air in the drum. Further, at the other side of the base 800, a component mount 810 that provides a space in which components for the operation of the dryer are installed can be provided. The component mount 810 can be disposed out of the air circulating channel 820.

In the conventional dryer, the air circulating channel 820 may be disposed on the base 800, and the driver for rotating the drum 200 may be installed on the base 800. Because the driver occupies a large portion of an installation space of the base 800, the component mount 810 formed in a space of the base 800 except for the air circulating channel 820 has a small space. Thus, it may not be easy to install other components of the laundry treating apparatus on the component mount.

In some implementations, in the laundry treating apparatus, the motor 500 rotating the drum 200 can be spaced apart from the base 800 and can be disposed in rear of the drum 200. Thus, without the motor 500 in the base, a space of the base 800 can be utilized in various ways.

A compressor 930 for compressing refrigerant for heat exchange can be installed at the component mount 810. Further, the base 800 can include a water collector 860 which can be configured to be spaced apart from the compressor 930, and into which the condensate generated in the air circulating channel 820 is collected. A control box 190 for controlling the compressor 930 and the motor can be installed on the component mount 810.

The control box 190 can be installed on the base and supported thereon firmly. Further, the control box 190 and a connection line for connecting components controlled by the control box to each other can be firmly supported on the base 800.

In another example, the water collector 860 may not be disposed between the compressor 930 and the air circulating channel 820, but can be disposed to overlap the compressor 930 in the front-rear direction. Because the water collector 860 may be located in a space where the motor is conventionally disposed, a volume of the water collector 860 can be expanded. When the volume of the water collector 860 increases, a frequency of emptying the collected condensate can be reduced, so that the user's convenience can be improved.

A side face of the base 800 can be coupled to the side panel constituting the side face of the cabinet. The side panel can include the first side panel 141 and the second side panel 142. The control box 190 can be installed on the component mount 810 and can be installed closer to one of the side panels.

The control box 190 can control all operations of the laundry treating apparatus. Therefore, there can be many cases of checking or repairing the control box 190.

When the control box 190 is adjacent to the first side panel 141, the user can access the control box 190 by removing only the first side panel 141. Accordingly, there is an effect that easiness of maintenance increases.

When the first side panel 141 is removed, various components such as the compressor 930 and the control box 190 can be easily accessed by the user, so that the first side panel 141 can be referred to as a service panel.

FIG. 12 shows a state in which the component mount 810 is located at a left side of the base 800 and the control box 190 can be accessed by the user when the first side panel 141 is removed. However, the present disclosure is not limited thereto. When the air circulating channel 820 is formed on at the left side and the component mount 810 is formed at the right side, the control box or the compressor can be repaired and checked by removing the right panel.

In some examples, the air circulating channel 820 can further include the duct cover 830 positioned at a top of the air circulating channel 820 to define a channel through which air discharged from the drum flows. The duct cover 830 can be coupled to an open top face of the air circulating channel 820.

The top faces of the inflow duct 821 and the air flow duct 822 are open so that air can flow in and out through the open top faces. The duct cover 830 can shield an open top face of the air flow duct 822. Therefore, the duct cover 830 allows the air of the drum to flow into the channel through the inflow duct 821, and prevents the air flowing into the inflow duct 821 from flowing out of the channel through the open top face of the air flow duct 822. That is, the duct cover 830 can constitute one face of the channel that guides the air introduced through the inflow duct 821 to the air discharge duct 823.

The air discharge duct 823 can include the blower 8231 that discharges air out of the air discharge duct 823. The blower 8231 can discharge the air that has passed through the inflow duct 821 and the air flow duct 822 out of the air discharge duct 823.

The blower 8231 can provide a space where the air circulating channel fan 950 that circulates the air inside the drum is installed. The air circulating channel fan 950 can increase a circulating speed of air by forcibly flowing the air, and thus has the effect of shortening a drying time by increasing a drying speed of laundry.

When the air circulating channel fan 950 rotates, air can flow in such a way that the air is discharged through an opening formed above the blower 8231. The air discharged from the blower 8231 can flow back into the drum and can be used to dry the laundry.

The air circulating channel fan 950 can employ various types of fans. For example, a sirocco fan can be applied so that air is introduced in a direction of the rotation shaft and is discharged in a radial direction. However, the present disclosure is not limited thereto, and various fans can be used to generate the air flow according to design purposes.

The duct cover 830 can include a communication cover body 8312 coupled to a top of the inflow duct 821 and a shielding cover body 8311 coupled to the top of the air flow duct 822. The shielding cover body 8311 can extend from the communication cover body 8311, and the shielding cover body 8311 can be formed integrally with the communication cover body 8312.

The communication cover body 8312 can include an inflow communication hole 8314 that communicates the drum and the inflow duct 821 with each other. Even when the communication cover body 8312 can be coupled to the inflow duct 821, the inflow communication hole 8314 can guide the air discharged from the drum to the inflow duct 821.

Further, the shielding cover body 8311 can shield the top face of the air flow duct 82. Thus, the air introduced into the inflow duct 821 can be guided to the air discharge duct 823 while not flowing out of the air circulating channel 820 via the air flow duct 822.

The shielding cover body 8311 can include a cleaning water channel 833 through which water can flow and which can be disposed in a top face of the shielding cover body 8311. The cleaning water channel 833 can receive water and spray the water toward the first heat exchanger located below the duct cover 830.

A cover through-hole 8313 vertically extending through the shielding cover body 8311 can be disposed downstream of the cleaning water channel 833. Water flowing along the cleaning water channel 833 can be sprayed downwardly of the shielding cover body 8311 through the cover through-hole 8313.

The first heat exchanger to dehumidify the air discharged from the drum can be disposed below the cover through-hole 8313. Therefore, the water passing through the cover through-hole 8313 can be sprayed towards the first heat exchanger to wash the first heat exchanger.

A nozzle cover can be coupled to a top of the cleaning water channel 833. The nozzle cover can shield an open top face of the cleaning water channel 833. The nozzle cover can prevent the air flowing along the air flow duct 822 from leaking through the cover through-hole 8313. Further, the nozzle cover shields the top face of the cleaning water channel 833 to prevent the water flowing along the cleaning water channel 833 from scattering to the outside.

Alternatively, the air circulating channel 820 can further include a duct filter that can be disposed in front of the first heat exchanger to filter foreign substances of air that has passed through the inflow duct 821. The duct filter can be disposed between the inflow duct 821 and the first heat exchanger to prevent foreign substances from being deposited on a front face of the first heat exchanger, thereby improving the drying efficiency and heat exchange efficiency of the first heat exchanger.

When the foreign substances are deposited on the duct filter, the circulation of air passing through the inflow duct 821 and the air flow duct 822 can be disturbed. In order to solve the above problem, the cleaning water channel 833 can remove the foreign substances deposited on the duct filter using water pressure via spraying water toward the duct filter.

However, for convenience of description, the following description will be based on the laundry treating apparatus in which the duct filter is omitted.

A channel switching valve 870 that can be coupled to the cleaning water channel 833 and supplies water for cleaning to the cleaning water channel 833 can be further included. The channel switching valve 870 can be connected to a water supply source to selectively supply water to the cleaning water channel 833. The water supply source can include the water collector 860.

Figure 1:
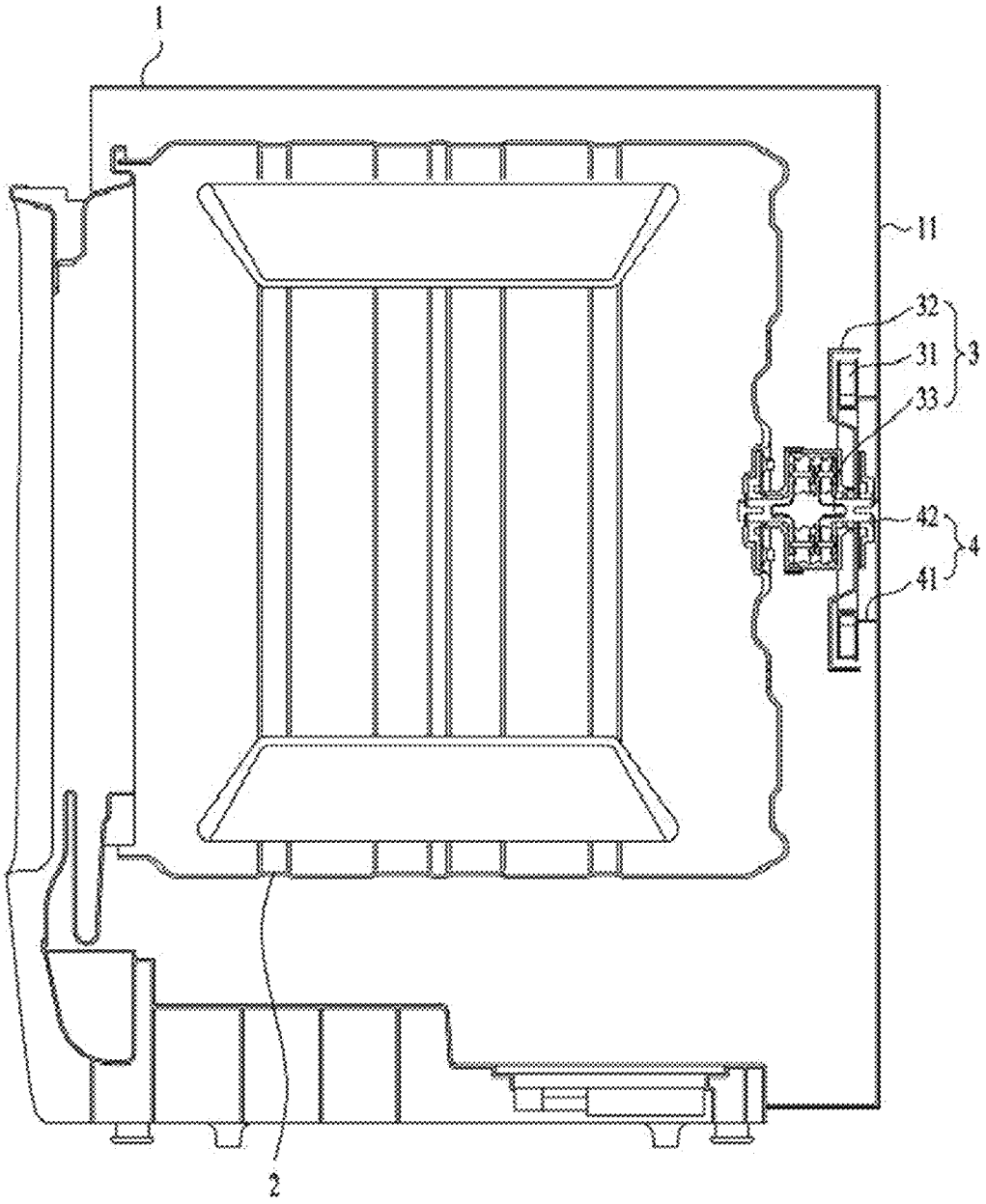
FIG. 1 shows a structure of a conventional dryer in related art.
Figure 2B:
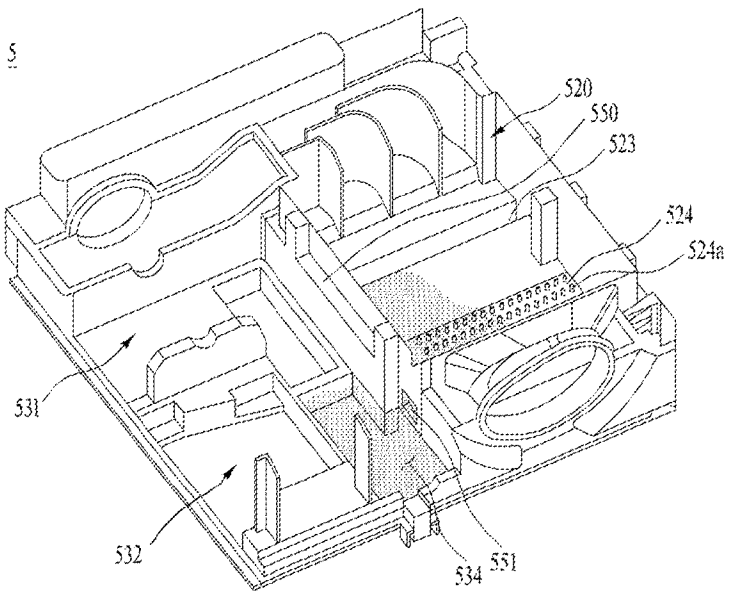
FIGS. 2A and 2B show a dryer in related art.
Figure 2A:
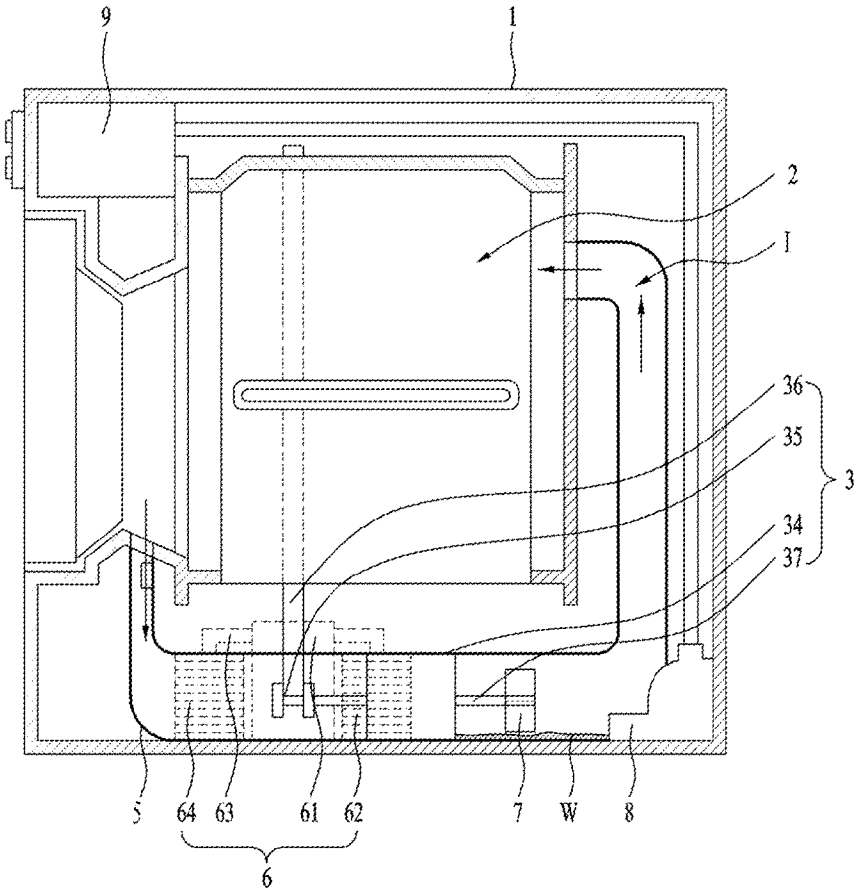
FIG. 2A Related Art

The channel switching valve 870 can be connected to the water collector 860 via a hose to guide the water collected in the water collector 860 to the cleaning water channel 833. The channel switching valve 870 can guide the water collected in the water collector 860 to the water storage tank 120 (refer to FIG. 1).

Figure 13:
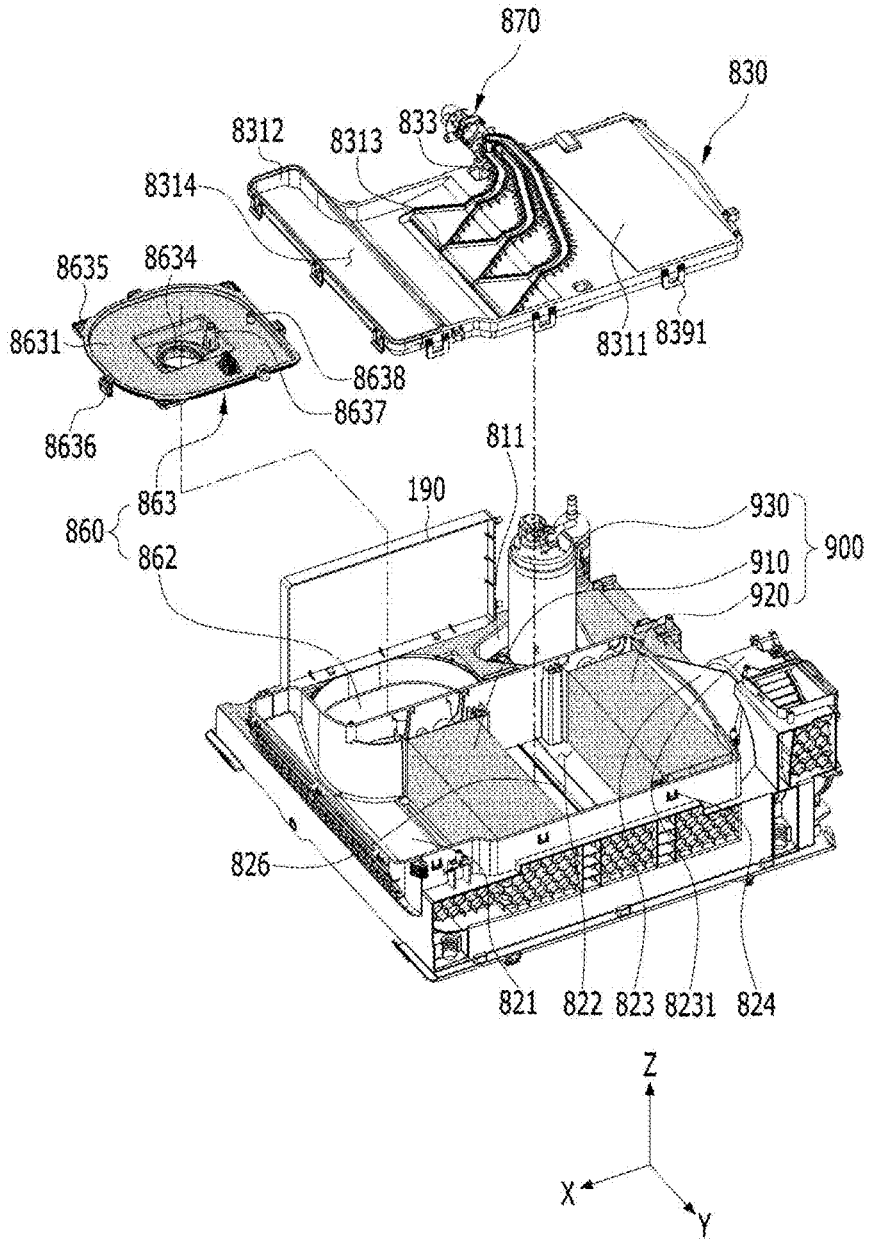
FIG. 13 is an exploded perspective view showing an example of a duct cover and a water collector cover coupled to an open top surface of a water collector body that are separated from the base of the FIG. 12.

FIG. 13 is an exploded perspective view showing the duct cover and the water collector cover in a separated state from the base in FIG. 12.

Referring to FIG. 13, below the duct cover 830, the first heat exchanger 910 and the second heat exchanger 920 which sequentially exchange heat with the air inside the drum 200 can be installed so as to be spaced apart from each other in the front and rear direction. The air inside the drum 200 introduced into the inflow duct 821 can be heat-exchanged in the first heat exchanger 910 such that the moisture is removed therefrom, and the air from which the moisture has been removed can be heat-exchanged in the second heat exchanger 920 and thus can be heated. The heated air can be supplied back into the drum 200 through the air discharge duct 823.

The air circulating channel 820 can further include a water cover 826 disposed between the first heat exchanger 910 and a bottom face of the air flow duct 822. The water cover 826 can be configured to be supported on the air flow duct 822.

The water cover 826 can be configured to be positioned under the first heat exchanger 910 to support the bottom face of the first heat exchanger 910. The water cover 826 can support the first heat exchanger 910 so as to be spaced away from the bottom face of the air flow duct 822.

In the first heat exchanger 910, condensate can be generated by condensing the wet steam discharged from the drum 200. When the condensate is not discharged from the inside of the laundry treating apparatus and remains, there is a problem that an odor is generated or the drying efficiency is reduced. Thus, the condensate can be collected while being spaced away from the first heat exchanger 910 or the second heat exchanger 920, and then discharged.

The water cover 826 can support the first heat exchanger 910 so as to be spaced apart from the bottom face of the air flow duct 822 to define a space between the bottom face of the air flow duct 822 and the water cover 826. The condensate can flow into the water collector 860 along the space defined by the water cover 826.

The air dehumidified through the first heat exchanger 910 can be heated in the second heat exchanger 920. The air passing through the second heat exchanger 920 has a low moisture content. As the air is heated, an amount of saturated steam increases, so that it is difficult to generate condensate. Accordingly, the water cover 826 can be positioned on a bottom face adjacent to the first heat exchanger 910, and the water cover 826 can be configured to be spaced apart from the second heat exchanger 920.

Because only a portion of a top face of the water cover 826 is shown in FIG. 13, a shape of the channel formed by the water cover 826 and a detailed structure of the water cover 826 will be described later.

In some examples, the base 800 can include the water collector 860 that can be configured to be spaced apart from the air circulating channel 820 and configured to collect the condensate generated in the air circulating channel 820. The water collector 860 can include the water collector body 862 that has a space defined therein where condensate is collected.

The water collector 860 can further include a water collector cover 863 shielding an open top face of the water collector body 862. Moisture-sensitive components can be installed around the water collector 860. In some examples, the condensate collected in the water collector body 862 can be blocked from scattering to the outside. For example, the water collector cover 863 can be coupled to the water collector body 862 to block the condensate from leaking to the top face of the water collector body 862.

Further, the water collector 860 can include a pump that allows the condensate collected inside the water collector body 862 to flow to the outside. In order for the pump to function properly, the inside of the water collector body 862 can be sufficiently sealed. The water collector cover 863 seals the inside of the water collector body 862 to increase the reliability of the pump.

The water collector cover 863 can include a water collector cover body 8631 that constitutes a shielding face of the water collector body 862. Further, the water collector cover 863 can include at least one of a support body 8635 configured to support the water collector cover body 8631 and a fastening hook 8636 configured to couple the water collector cover body 8631 to the water collector body 862.

The support body 8635 can protrude from a circumference of the water collector cover body 8631 and be seated on the base. The fastening hook 8636 can be formed to protrude from the water collector cover body 8631. The fastening hook 8636 can firmly fix the water collector cover body 8631 to the water collector body 862. The fastening hook 8636 can be fixedly inserted into a hook hole to be described later.

The condensate generated in the air circulating channel 820 is collected inside the water collector body 862. The top face of the water collector body 862 can be open, such that the condensate can be scattered to the outside. However, the water collector body 862 is located adjacent to the control box 190, the compressor 930, and the like. Thus, when the condensate scatters out of the water collector body 862, a failure of the mechanical devices can occur.

The water collector cover 863 can shield the open top face of the water collector body 862 using the water collector cover body 8631 to prevent the condensate from scattering. The support body 8635 and the fastening hook 8636 can firmly fix the water collector cover body 9631 to the water collector body 862. Therefore, this can prevent the condensate from scattering and thus a failure of the device from occurring.

Further, the water collector cover 863 can include a pump receiving portion 8634 configured to extend through the water collector cover body 8631 and to receive the pump. Further, the water collector cover 863 can include a drain channel 8637 that protrudes upwardly from the water collector cover body 8631 and is formed in a pipe shape communicating an inside and an outside of the water collector body 862 to each other.

The pump receiving portion 8634 can receive therein the pump configured to move the condensate collected inside the water collector body 862 out of the water collector body 862. When the pump is activated, the condensate stored in the water collector body 862 can be discharged through the drain channel 8637.

The hose can be connected to the drain channel 8637 to guide the discharged condensate out of the water collector body 862. One end of the hose can be connected to the drain channel 8637, and the other end thereof can be connected to the channel switching valve 870. However, the disclosure is not limited thereto, and the other end of the hose can be located out of the cabinet to drain the condensate directly out of the cabinet. The other end of the hose can be connected to the water storage tank 120 (refer to FIG. 1) located on a top of the cabinet, so that the condensate collected in the water collector body 862 can be guided to the water storage tank 120.

The water collector cover 863 can further include a return channel 8638 which can be spaced apart from the drain channel 8637 and communicate an inside and an outside of the water collector body 862 with each other. The return channel 8638 can communicate the water collector body 862 and the water storage tank with each other. The return channel 8638 can guide water from the water storage tank back to the water collector body 862.

The return channel 8638 can be connected via the hose to the water storage tank 120 disposed on the top of the cabinet (see FIG. 3). To prevent water from overflowing the water storage tank, when the water storage tank is full of water, the water stored in the water storage tank can flow back to the water collector body 862 via the hose connecting the return channel 8638 and the water storage tank to each other. There is an effect that the user's convenience can be improved by reducing the frequency at which the user directly drains the water.

In some examples, the channel switching valve 870 for switching the channel along which the condensate collected in the water collector 860 flow can be further included. The pump can be connected to the channel switching valve 870 via the hose. The water stored in the water collector body 862 can flow, under the operation of the pump, to the channel switching valve 870. The channel switching valve 870 can guide the flowing water to various paths.

The channel switching valve 870 can be connected to the cleaning water channel 833 to move the water to the cleaning water channel 833. Water directed to the cleaning water channel 833 can be used to clean the first heat exchanger.

Further, the channel switching valve 870 can be connected to the water storage tank 120 via the hose to guide the condensate flowing from the water collector body 862 to the water storage tank 120. The user can directly drain water from the water storage tank where the condensate is stored.

The channel switching valve 870 can be controlled by the control box 190, and can operate in a different manner depending on an operation timing of the laundry treating apparatus. For example, when an operation of the first heat exchanger 910 has been completed in the drying cycle, the control box 190 can control the channel switching valve 870 to direct the condensate to the cleaning water channel 833. Further, when washing of the first heat exchanger 910 has been completed, the control box 190 can control the channel switching valve 870 to guide the condensate to the water storage tank 120.

In some examples, as described above, in order for the pump to operate normally, it is desirable to seal an inside of the space to which the pump drains water. Because the water collector cover 863 can be firmly coupled to the water collector body 862 using the support body 8635 and the fastening hook 8636, this can easily seal the space where the condensate is stored. Thus, operational reliability of pump 861 can be improved. A sealing can be added to a portion where the water collector cover 863 and the water collector body 862 are joined to each other, thereby improving water-tightness of the space.

In some examples, the water collector cover 863 can be configured to seal the inside of the water collector body 862, and can be detachably coupled to the water collector body 862. Foreign substances such as lint included in the condensate generated by the first heat exchanger 910 can flow into the water collector body 862. When the foreign substances with large particles are introduced thereto, there can be a problem that the substances can interfere with the operation of the pump.

In some examples, the water collector cover 863 can be removed to remove the foreign substances introduced into the water collector body 862. Accordingly, the water collector cover 863 can be detachably coupled to the water collector body 862. In some examples, there is an effect that the water collector cover 863 can be easily removed from the water collector body 862 using the fastening hook 8636.

That is, in a general use environment, the support body 8635 and the fastening hook 8636 can securely shield the open top face of the water collector body 862 to prevent the condensate from scattering to the outside.

In some cases, when the water collector cover 863 is removed in order to remove foreign substances deposited on the water collector body 862, the fastening hook 8636 can be used to easily remove the water collector cover.

In some examples, the duct cover 830 can include a cover mount hook 8391 formed along a perimeter thereof, and a duct protrusion 824 protruding from and along a periphery of the air circulating channel 820 and coupled to the cover mount hook 8391.

The cover mount hook 8391 can be coupled to the duct protrusion 824 to couple the duct cover 830 to the air circulating channel 820. That is, the duct cover 830 can be securely fastened to the duct protrusion 824 using the cover mount hook 8391 in a state seated around the inflow duct 821 and the air flow duct 822.

A sealing can be added to a contact face of the duct cover 830 and the air circulating channel 820 to prevent air from leaking from the inside of the air circulating channel 820 to the outside.

Figure 14:
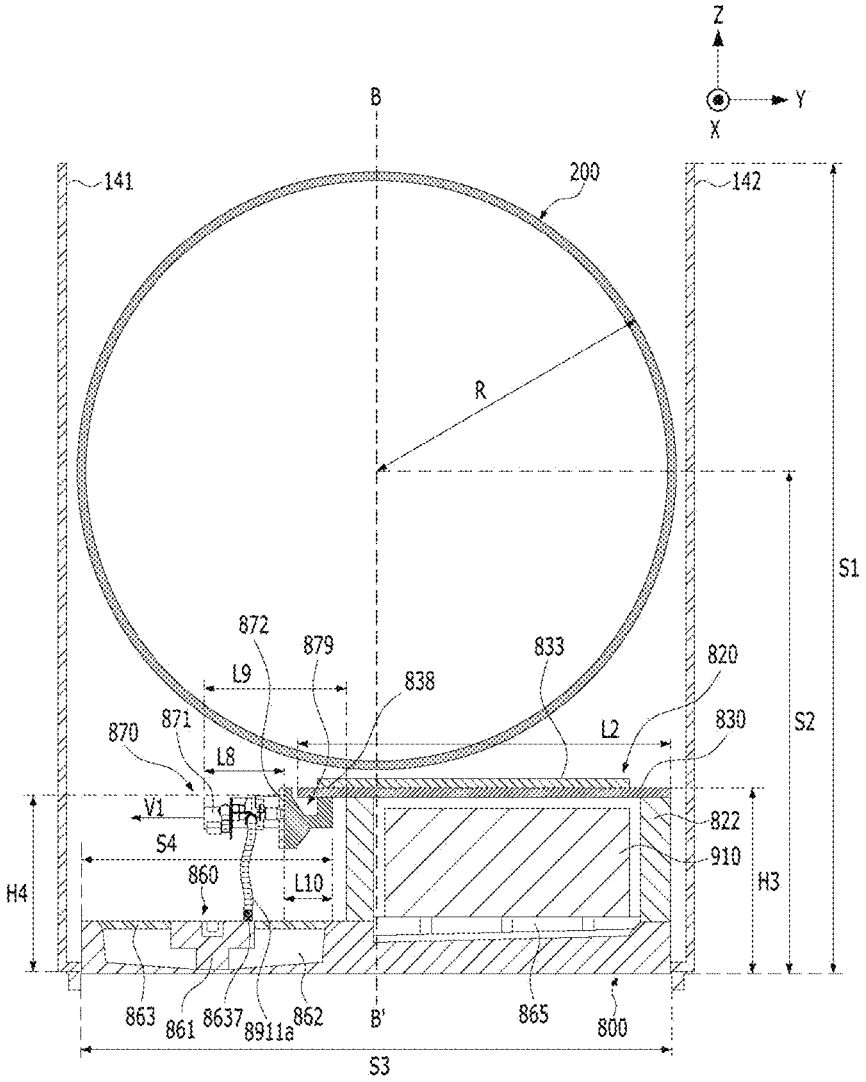
FIG. 14 is a cross-sectional view showing an example of an arrangement relationship of a drum and an air circulating channel.

FIG. 14 is a cross-sectional view showing an arrangement relationship of the drum and the air circulating channel in the laundry treating apparatus. Descriptions of those duplicate with the configurations as described in FIG. 13 are omitted.

The cabinet 100 can include the first side panel 141 positioned on one side of the drum 200 to constitute one side face thereof, and the second side panel 142 positioned on the other side of the drum 200 to constitute the other side face thereof.

In this case, the air circulating channel 820 can be disposed closer to one of the first side panel 141 and the second side panel 142 than to the other thereof. The water collector 860 can be disposed closer to the other of the first side panel 141 and the second side panel 142.

In some examples, the air circulating channel 820 can be disposed closer to the second side panel 142 than to the first side panel 141. The air flow duct 822 and the duct cover 830 can be disposed closer to the second side panel 142 than to the first side panel 141. The first side panel 141 can define a left side face with respect to the drum 200, and the second side panel 142 can define a right side face with respect to the drum 200.

Accordingly, the water collector 860 can be spaced apart from the air circulating channel 820 and disposed out of the air circulating channel 820. The water collector 860 can be installed between the second side panel 142 and the air circulating channel 820.

In some examples, the channel switching valve 870 can be coupled to the air circulating channel 820 so as to communicate with the cleaning water channel 833 and can be configured to deliver the condensate to the cleaning water channel 833. In some examples, the channel switching valve 870 can be coupled to the air circulating channel 820 and extend by a predetermined length L9. Thus, depending on an arrangement of the channel switching valve 870, the channel switching valve 870 can interfere with the drum 200.

To solve this situation, the channel switching valve 870 can be positioned at a lower level than that of the top face of the duct cover 830 and can be configured to face toward a side face of the air flow duct 822. In some examples, the channel switching valve 870 can be disposed between the air circulating channel 820 and the first side panel 141 and can face toward the water collector 860. A vertical level of a top of the channel switching valve 870 can be lower than that of the top face of the duct cover 830.

Thus, the channel switching valve 870 may not interference with the drum 200. Thus, the user can remove the first side panel 141 without removing the drum 200 to easily repair and maintain the channel switching valve 870.

Further, the duct cover 830 can include a valve connector 838 extending toward the water collector 860 and facing toward the water collector 860. The valve connector 838 can be configured to be disposed above the water collector 860, and can be configured to be disposed side by side with the water collector 860.

The channel switching valve 870 can be coupled to a bottom face of the valve connector 838 and can extend toward the water collector 860. The cleaning water channel 833 can be configured such that one end thereof is formed on a top face of the valve connector 838 and communicates with the channel switching valve 870.

Coupling the channel switching valve 870 to the bottom face of the valve connector 838 can allow the channel switching valve 870 to be further prevented from interfering with the drum 200. Further, in the laundry treating apparatus, a radius R of the drum 200 can be further expanded within a range in which interference with the channel switching valve 870 is prevented. The channel switching valve 870 can be freely positioned according to the position of the valve connector 838.

In some examples, regarding a detailed structure of the channel switching valve 870, the channel switching valve 870 can include a water receiving portion 871 communicating with the pump 861 and receiving the water from the pump 861, and a connective portion 879 communicating with the water receiving portion 871 and coupled to the duct cover 830 to deliver the water to the cleaning water channel 833.

Further, the channel switching valve 870 can further include a water delivering portion 872 disposed between the water receiving portion 871 and the connective portion 879. The water delivering portion 872 can be coupled to each of the water receiving portion 871 and the connective portion 879 and guide the water supplied from the water receiving portion 871 to the connective portion 879. In other words, the water receiving portion 871, the water delivering portion 872, and the connective portion 879 can be arranged in this order along a direction in which the condensate flows.

In some examples, the connective portion 879 can be coupled to the valve connector 838 and extend toward the water collector 860, and the connective portion 879 can be disposed to face toward the water collector body 862. Further, the connective portion 879 can be coupled to the bottom face of the valve connector 838 and communicate with the cleaning water channel 833 to deliver the condensate to the cleaning water channel 833. The connective portion 879 can be disposed at a side in a longitudinal direction of the air circulating channel 820. At least a portion of the connective portion 879 is positioned at a lower level than that of the top face of the air circulating channel 820.

In some examples, the water collector 860 can include the drain channel 8637 protruding upward from the water collector cover 863 and communicating the water collector body 862 with the outside of the water collector cover 863, and a first water collector drain pipe 8911*a* for connecting the drain channel 8637 and the channel switching valve 870 to each other such that the condensate flows from the pump 861 to the channel switching valve 870. The first water collector drain pipe 8911*a* can act as a passage through which the condensate flows from the pump 861 to the channel switching valve 870.

In some examples, the water receiving portion 871 can be connected to the first water collector drain pipe 8911*a* and can receive condensate from the pump 861 through the first water collector drain pipe 8911*a*. The condensate supplied to the water receiving portion 871 can be delivered to the water delivering portion 872 and the connective portion 879.

As the channel switching valve 870 extends from the valve connector 838 toward the water collector 860, the water receiving portion 871 can be disposed on top of the water collector 860 and face toward the water collector 860.

Thus, a distance between the water receiving portion 871 and the pump 861 can be reduced. Thus, an extension length of the first water collector drain pipe 8911*a* for connecting the pump 861 and the water receiving portion 871 to each other can be reduced to prevent the condensate from remaining in the first water collector drain pipe 8911*a*.

Figure 15:
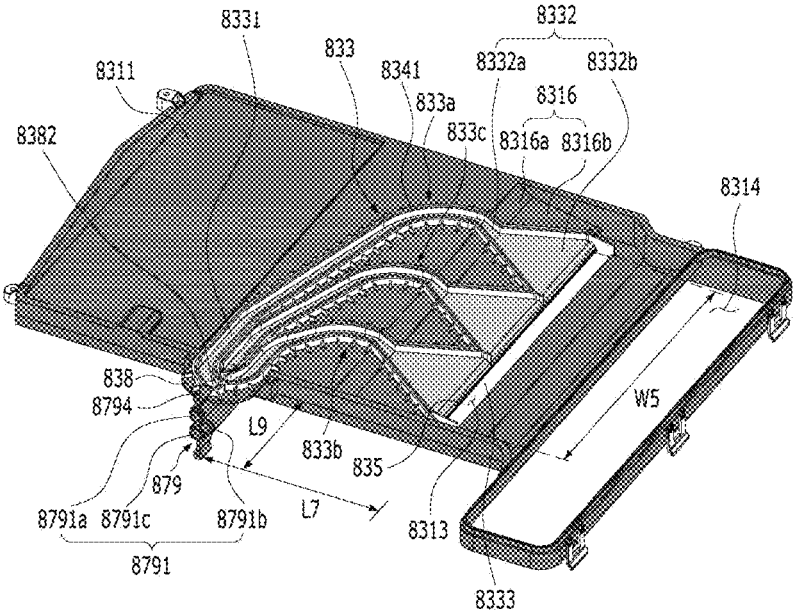
FIG. 15 is a perspective view showing an example of a cleaning water channel disposed on a top surface of a duct cover.

FIG. 15 is a perspective view showing the cleaning water channel disposed on the top face of the duct cover in the laundry treating apparatus.

The duct cover 830 can include a shielding cover body 8311 coupled to a top of the air flow duct 822 for shielding the first heat exchanger 910 and the second heat exchanger 920, and a communication cover body 8312 extending forward from the shielding cover body 8311 and coupled to a top of the inflow duct 821.

The shielding cover body 8311 can be configured to shield the open top face of the air flow duct 822, and the communication cover body 8312 can be configured to be seated on a top face of the inflow duct 821.

In this case, the shielding cover body 8311 and the communication cover body 8312 can be formed integrally with each other. Accordingly, an assembly process of the duct cover 830 can be simplified, and the air inside the air flow duct 822 and the inflow duct 821 can be prevented from leaking to a space between the shielding cover body 8311 and the communication cover body 8312.

Further, the communication cover body 8312 can include an inflow communication hole 8314 that passes through one face thereof and communicates the drum 200 and the inflow duct 821 with each other. The inflow communication hole 8314 can communicate with the duct communication hole 417. Thus, the air discharged from the drum 200 can be introduced through the inflow communication hole 8314.

The inflow duct 821 can have a width larger than a width of the air flow duct 822. Accordingly, the communication cover body 8312 seated on the top face of the inflow duct 821 can have a greater width than that of the shielding cover body 8311.

Further, the inflow communication hole 8314 formed in the communication cover body 8312 has a larger width than that of the shielding cover body 8311. Accordingly, the air inside the drum 200 can be smoothly introduced into the inflow communication hole 8314 that communicates with the drum 200.

The inflow communication hole 8314 has a larger diameter than that of the shielding cover body 8311, and one portion of the inflow communication hole 8314 extends in a parallel manner to the shielding cover body 8311 and the other portion of the inflow communication hole 8314 can be configured to protrude toward the connective portion 879.

In some examples, the water supplied to the cleaning water channel 833 through the connective portion 879 flows along the top face of the shielding cover body 8311 and is discharged to the first heat exchanger 910. In this way, the foreign substances attached to the front face of the first heat exchanger 910 can be removed.

In some implementations, the shielding cover body 8311 can include a cover through-hole 8313 extending through a top face thereof and facing toward at least a portion of the first heat exchanger 910. The cover through-hole 8313 can be disposed at an end of the cleaning water channel 833 so as to communicate the cleaning water channel 833 and the first heat exchanger 910 with each other.

The cover through-hole 8313 can act as an outlet of the cleaning water channel 833, and the water flowing along the cleaning water channel 833 can be sprayed to the first heat exchanger 910 via the cover through-hole 8313.

Accordingly, the foreign substances attached to the first heat exchanger 910 can be removed by the water discharged from the cleaning water channel 833 through the cover through-hole 8313 without the user having to separate the first heat exchanger 910 to clean the same.

The cover through-hole 8313 can correspond to a width direction of the shielding cover body 8311, and can extend parallel to the extension direction of the valve connector 838. A width W5 of the cover through-hole 8313 can be smaller than a width of the shielding cover body 8311, and can correspond to a width of the first heat exchanger 910 shown in FIG. 14.

In some examples, the connective portion 879 can be connected to the water delivering portion 872 shown in FIG. 14 and configured to deliver water to the cleaning water channel 833. For instance, the connective portion 879 can include receiving channels 8791*a*, 8791*b*, and 8791*c* that communicate with the water delivering portion 872 and receive water from the water delivering portion 872. The receiving channels 8791*a*, 8791*b*, and 8791*c* can extend through the valve connector 838 and communicate with the cleaning water channel 833 and deliver the condensate supplied from the water delivering portion 872 to the cleaning water channel 833.

Further, the cleaning water channel 833 can include a valve communication hole 8382 passing through the bottom face thereof and communicating with the receiving channels 8791*a*, 8791*b*, and 8791*c*. The condensate supplied from the receiving channels 8791*a*, 8791*b*, and 8791*c* can flow into the cleaning water channel 833 through the valve communication hole 8382. The valve communication hole 8382 can be disposed on a top face of the valve connector 838, and can be disposed on a top face of the shielding cover body 8311 and along an extension direction of the receiving channels 8791*a*, 8791*b*, and 8791*c*.

In some examples, the cleaning water channel 833 can be disposed on a top face of the shielding cover body 8311 to guide the water flowing therein from the valve communication hole 8382 to the cover through-hole 8313. That is, the cleaning water channel 833 can extend from the valve communication hole 8382 to the cover through-hole. The valve communication hole 8382 can act as a starting point of the cleaning water channel 833, and the cover through-hole 8313 can act as an ending point of the cleaning water channel 833.

For example, one end of the cleaning water channel 833 can be disposed on a top face of the valve connector 838, and the other end thereof can be connected to the cover through-hole 8313. Further, one end of the cleaning water channel 833 can extend toward the valve connector 838, and the other end thereof can extend toward the cover through-hole 8313.

In some examples, the condensate supplied to the cleaning water channel 833 through the valve communication hole 8382 can friction with an inner face of the cleaning water channel 833 while flowing along the cleaning water channel 833, and thus a flow speed can gradually decrease. Accordingly, the condensate inside the cleaning water channel 833 may not be discharged from the cleaning water channel 833 but can remain therein.

In some implementations, the shielding cover body 8311 can include an inclined face 8316 configured such that a portion of a top face extends in a downwardly inclined manner and frontwards. At least a portion of the cleaning water channel 833 can be disposed in the inclined face 8316.

This can minimize an amount of residual water that is not discharged from the cleaning water channel 833. Further, as the water flowing through the cleaning water channel 833 flows along the inclined face 8316, the flow speed thereof naturally increases to remove the foreign substances remaining in the first heat exchanger 910.

In some examples, the inclined face 8316 can include a first inclined face 8316*a* which extends from the top face of the shielding cover body 8311 in a downwardly inclined manner and in a frontward direction, and a second inclined face 8316*b* extending from the first inclined face 8316*a* toward the communication cover body 8312 in an inclined manner. An inclination of the first inclined face 8316*a* can be greater than that of the second inclined face 8316*b*.

The cleaning water channel 833 can include a guide channel 8331 that communicates with the valve communication hole 8382 and receives water from the valve communication hole 8382, and a discharge channel 8332 that is connected to the guide channel 8331 and extends to the cover through-hole 8313.

The guide channel 8331 can be disposed on the top face of the shielding cover body 8311 which is positioned at a higher level than that of the inclined face 8316, and the discharge channel 8332 can be disposed on the inclined face 8316.

Further, the discharge channel 8332 can include a first discharge channel 8332*a* connected to the guide channel 8331 and disposed on the first inclined face 8316*a*, and a second discharge channel 8332*b* connected to the first discharge channel 8332*a* and disposed on the second inclined face 8316*b*.

The guide channel 8331 can have one end disposed on the top face of the valve connector 838 and extending toward the first inclined face 8316*a*. One end of the first discharge channel 8332*a* can communicate with the guide channel 8331, while the other end thereof can communicate with the second discharge channel 8332*b*, so that water flowing from the guide channel 8331 can be guided to the second discharge channel 8332*b*.

One end of the second discharge channel 8332*b* can communicate with the first discharge channel 8332*a* while the other end thereof can be connected to the cover through-hole 8313, so that water flowing from the first discharge channel 8332*a* can be guided to the cover through-hole 8313.

Accordingly, the flow speed of the water supplied to the guide channel 8331 from the valve communication hole 8382 can increase naturally as it passes through the first discharge channel 8332*a* and the second discharge channel 8332*b*. In other words, as the first discharge channel 8332*a* and the second discharge channel 8332*b* extend in a downwardly inclined manner, the flow speed of the water flowing from the guide channel 8331 to the cover through-hole 8313 can increase naturally.

Further, the water inside the cleaning water channel 833 flows along the first discharge channel 8332*a* and the second discharge channel 8332*b* to the cover through-hole 8313. Thus, the situation can be prevented in which the water inside the cleaning water channel 833 is not be discharged to the cover through-hole 8313 and remains inside the cleaning water channel 833.

In some examples, as the flow speed of the water increases as the water flow along the channel, a diameter thereof becomes narrower. Thus, the water inside the cleaning water channel 833 may not be uniformly dispersed at a distal end of the cleaning water channel 833. This can result in concentrated discharge to only a specific area of the cover through-hole 8313, and thus can result in water not being evenly supplied to the surface of the first heat exchanger 910.

Accordingly, the cleaning water channel 833 can include a plurality of channels and disposed on the top face of the shielding cover body 8311. Each of the distal ends of the plurality of cleaning water channels 833 can be connected to the cover through-hole 8313. Accordingly, a width of the distal end of one of the plurality of cleaning water channels 833 can be smaller than that of a single cleaning water channel 833 when the cleaning water channel 833 only includes the single cleaning water channel 833.

The cleaning water channel 833 can include the first cleaning water channel 833*a* disposed closest to one end of the shielding cover body 8311 among the plurality of cleaning water channels 833, the second cleaning water channel 833*b* disposed closest to the other end of the shielding cover body 8311 among the plurality of cleaning water channels 833, and the third cleaning water channel 833*c* disposed between the first cleaning water channel 833*a* and the second cleaning water channel 833*b*.

The distal end of the first cleaning water channel 833*a* can be connected to one end of the cover through-hole 8313, and the distal end of the second cleaning water channel 833*b* can be connected to the other end of the cover through-hole 8313.

The cover through-hole 8313 can be configured to be in connection with distal ends of the first cleaning water channel 833*a*, the second cleaning water channel 833*b*, and the third cleaning water channel 833*c*.

Further, widths of the first cleaning water channel 833*a*, the second cleaning water channel 833*b*, and the third cleaning water channel 833*c* can be equal to each other. When the water may not be dispersed to a specific area due to a structure of the cleaning water channel 833, the widths of the first cleaning water channel 833*a*, the second cleaning water channel 833*b*, and the third cleaning water channel 833*c* can be different from each other.

Further, one end of each of the first cleaning water channel 833*a*, the second cleaning water channel 833*b*, and the third cleaning water channel 833*c* can be referred to as a first end. In some examples, the first ends of the first cleaning water channel 833*a*, the second cleaning water channel 833*b*, and the third cleaning water channel 833*c* can be configured to be in contact with each other and to be disposed on a top face of the valve connector 838. The first cleaning water channel 833*a*, the second cleaning water channel 833*b*, and the third cleaning water channel 833*c* can extend in a separate manner from each other and along a flowing direction of the condensate. The other end of each of the first cleaning water channel 833*a*, the second cleaning water channel 833*b* and the third cleaning water channel 833*c* can extend to the cover through-hole 8313.

Further, the channel switching valve 870 shown in FIG. 14 can be configured to communicate with the first cleaning water channel 833*a*, the second cleaning water channel 833*b* and the third cleaning water channel 833*c* and to selectively supply water to the first cleaning water channel 833*a*, the second cleaning water channel 833*b* and the third cleaning water channel 833*c*.

Specifically, the valve communication hole 8382 can include the number of holes corresponding to the number of the plurality of cleaning water channels 833. The number of the receiving channels 8791, for example, 8791*a*, 8791*b*, and 8791*c* can correspond to the number of the cleaning water channels 833.

The receiving channel 8791 can include the first receiving channel 8791*a* communicating with the first cleaning water channel 833*a*, the second receiving channel 8791*b* communicating with the second cleaning water channel 833*b*, and the third receiving channel 8791*c* communicating with the third cleaning water channel 833*c*.

The condensate can be selectively supplied to the first receiving channel 8791*a*, the second receiving channel 8791*b* and the third receiving channel 8791*c* through the water receiving portion 871 based on an operation of the channel switching valve 870 shown in FIG. 14. Accordingly, the water can be selectively supplied to one of the first receiving channel 8791*a*, the second receiving channel 8791*b* and the third receiving channel 8791*c*. The water can be then supplied to one of the plurality of cleaning water channels 833 and discharged to the cover through-hole 8313.

Accordingly, a water pressure of water discharged from one of the plurality of cleaning water channels 833 can be greater than that compared to a case in which the condensate from the channel switching valve 870 is supplied to all of the plurality of cleaning water channels 833. As the pressure of water discharged from the cleaning water channel 833 increases, the foreign substances generated in the first heat exchanger 910 can be completely removed.

In some examples, the cleaning water channel 833 can include a channel defining portion 834 defining a channel through which water flowing into the valve communication hole 8382 can flow to the cover through-hole 8313. The channel defining portion 834 can protrude from the top face of the shielding cover body 8311 and be formed integrally with the shielding cover body 8311.

Accordingly, the cleaning water channel 833 may not be separately coupled to the shielding cover body 8311, so that a manufacturing cost of the duct cover 830 can be reduced, and an assembly process thereof can be simplified.

The channel defining portion 834 can extend from the valve communication hole 8382 towards the cover through-hole 8313.

That is, the channel defining portion 834 can constitute an inner circumferential face of the cleaning water channel 833. Specifically, the channel defining portion 834 can be configured to constitute an inner circumferential face of the guide channel 8331 and an inner circumferential face of the discharge channel 8332. Further, the channel defining portion 834 can be configured to constitute an inner circumferential face of each of the first discharge channel 8332*a* and the second discharge channel 8332*b*.

In some examples, the cleaning water channel 833 can include a discharge rib 835 configured to guide the water discharged from the cleaning water channel 833 to the first heat exchanger 910.

The discharge rib 835 can extend frontwards from the distal end of the second discharge channel 8332*b*. The discharge rib 835 can extend downward so that the distal end of the discharge rib 835 can be positioned in the cover through-hole 8313 and can further extend toward the first heat exchanger 910. Thus, the water discharged from the cleaning water channel 833 can flow uniformly along the discharge rib 835 towards the first heat exchanger 910.

Figure 16:
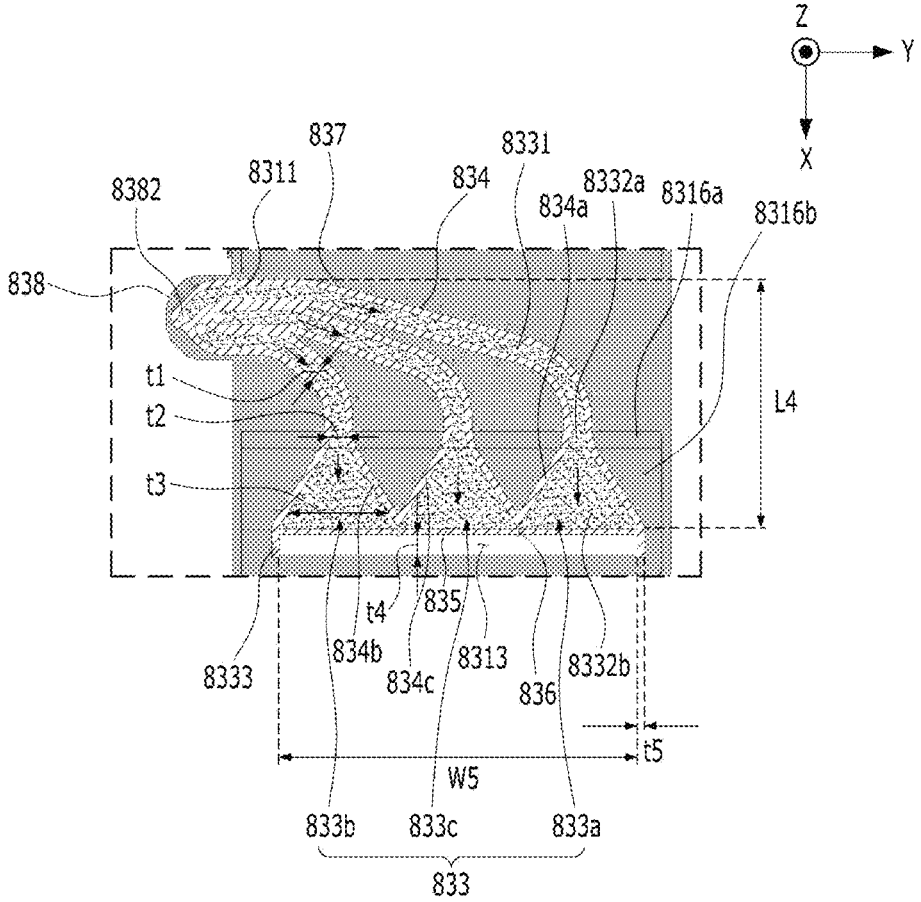
FIG. 16 is a top view showing an example of a duct cover having a cleaning water channel.

FIG. 16 is a top view of the duct cover having the cleaning water channel in a laundry treating apparatus.

The flow speed of the condensate flowing into the guide channel 8331 through the valve communication hole 8382 can increase naturally as it passes through the first discharge channel 8332*a* and the second discharge channel 8332*b*. As the flow speed of the water increases as the water flow along the channel, a diameter thereof becomes narrower. Thus, the cleaning water channel 833 can be configured so that a width thereof increases in the direction in which the condensate flows, so that the condensate can be spread widely at a distal end thereof.

Specifically, the guide channel 8331 can be configured such that a width t1 thereof increases as it extends from the valve communication hole 8382 toward the first discharge channel 8332*a*.

Further, the first discharge channel 8332*a* has a larger width than that of the guide channel 8331, so that water flowing from the guide channel 8331 to the first discharge channel 8332*a* can be uniformly discharged. A width t2 of the first discharge channel 8332*a* can be greater than the width t1 of the guide channel 8331.

Further, the second discharge channel 8332*b* has a larger width than that of the first discharge channel 8332*a*, so that water flowing from the first discharge channel 8332*a* to the second discharge channel 8332*b* can be uniformly discharged. A width t3 of the second discharge channel 8332*b* can be greater than the width t2 of the first discharge channel 8332*a*.

Further, a width of each of the first discharge channel 8332*a* and the second discharge channel 8332*b* can increase as it extends along the flowing direction of the water.

Accordingly, the cleaning water channel 833 can evenly spray the water on the front face of the first heat exchanger 910, and as a result, an entirety of water can be uniformly supplied to the first heat exchanger 910

In some examples, the pressure of water as discharged from the valve communication hole 8382 can be lowered as the water flows toward the cover through-hole 8313. A thickness of the channel defining portion 834 can decrease as it extends along the direction of movement of the water. That is, a thickness t5 of the channel defining portion 834 can decrease as a distance thereof from the valve communication hole 8382 increases. Alternatively, the thickness t5 of the channel defining portion 834 can be uniform in order to facilitate molding of an entirety of the duct cover 830.

In some examples, the channel defining portion 834 can include a first channel defining portion 834 constituting an inner circumferential face of the first cleaning water channel 833*a*, a second channel defining portion 834 constituting an inner circumferential face of the second cleaning water channel 833*b*, and a third channel defining portion 834 constituting an inner circumferential face of the third cleaning water channel 833*c*.

A distal end of the first channel defining portion 834 and a distal end of the third channel defining portion 834 can be configured to be in contact with each other. A distal end of the first channel defining portion 834 and a distal end of the second channel defining portion 834 can be configured to be in contact with each other.

Further, the cleaning water channel 833 can include a partitioning rib 836 configured to partition the first cleaning water channel 833*a*, the second cleaning water channel 833*b*, and the third cleaning water channel 833*c* from each other.

The partitioning rib 836 can extend from the distal end of the first channel defining portion 834 and the distal end of the third channel defining portion 834 toward the cover through-hole 8313. That is, the partitioning rib 836 can extend from a point at which the distal end of the first channel defining portion 834 and the distal end of the third channel defining portion 834 contact each other toward the cover through-hole 8313.

Accordingly, the water discharged from the second discharge channel 8332*b* can be uniformly discharged to the cover through-hole 8313 along the partitioning rib 836. The partitioning rib 836 can extend from the channel defining portion 834 toward the discharge rib 835 and be disposed on a top face of the discharge rib 835.

Further, the cleaning water channel 833 can include a communication channel 8333 that communicates the discharge channel 8332 and the cover through-hole 8313 with each other.

The communication channel 8333 can be disposed on a top of the cover through-hole 8313 and can be configured to face toward the cover through-hole 8313. The communication channel 8333 can be configured so that water to be discharged from the discharge channel 8332 flows to the cover through-hole 8313.

Further, the channel defining portion 834 can be configured to constitute an inner circumferential face of the communication channel 8333, so that water discharged from the discharge channel 8332 can be prevented from flowing out of the cover through-hole 8313.

In some examples, the cleaning water channel 833 can include a support 837 supporting the channel defining portion 834.

The channel defining portion 834 can include the support 837 extending outwardly from an outer circumferential face thereof. The support 837 can be configured to protrude from a top face of the shielding cover body 8311, and can be coupled to an outer circumferential face of the channel defining portion 834 to support the channel defining portion 834. The support 837 can include a plurality of supports arranged along the outer circumferential face of the channel defining portion 834.

Thus, the support 837 can support the channel defining portion 834 so that the channel defining portion 834 can withstand the water pressure of water therein. Thus, durability and reliability of the channel defining portion 834 can be improved.

Figure 17:
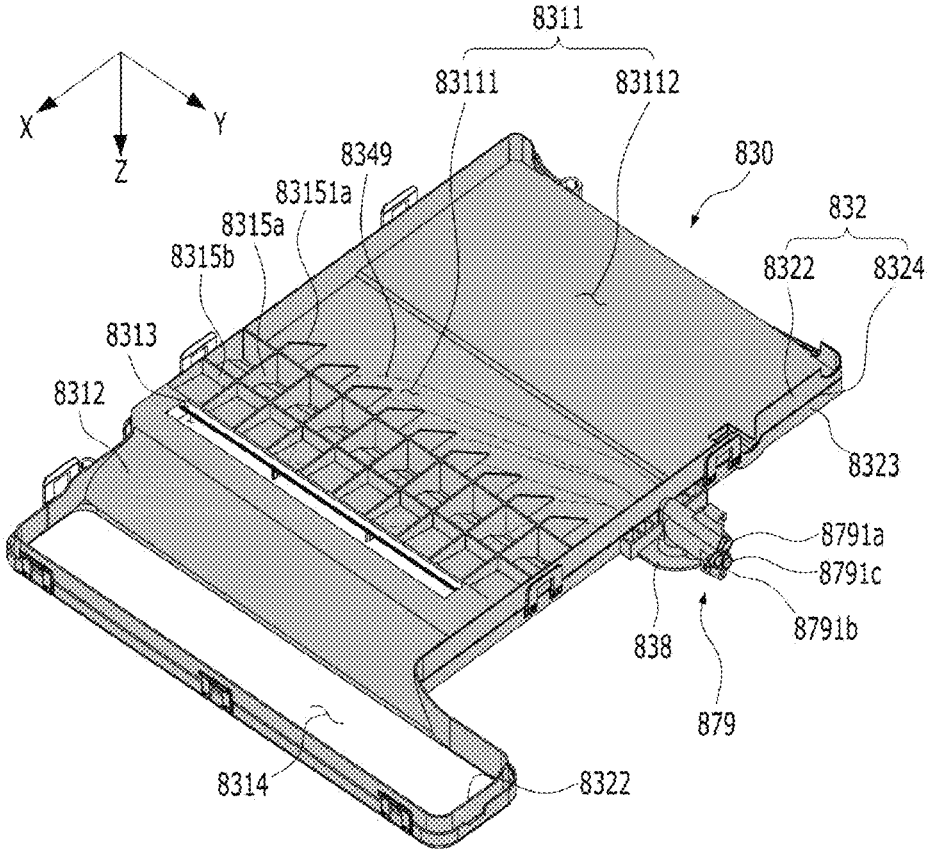
FIG. 17 is a perspective view showing a bottom surface of an example of a duct cover.

FIG. 17 is a perspective view showing a bottom face of the duct cover in the laundry treating apparatus.

The duct cover 830 can include a first heat-blocking rib 8315*a* and a second heat-blocking rib 8315*b* that can prevent the heat from the first heat exchanger 910 from being transferred to the cleaning water channel 833.

The first heat-blocking rib 8315*a* can protrude from a bottom face of the shielding cover body 8311 and extend in an away direction from the cover through-hole 8313. The second heat-blocking rib 8315*b* can protrude from the bottom face of the shielding cover body 8311 and extend in parallel to the cover through-hole 8313.

Each of the first heat-blocking rib 8315*a* and the second heat-blocking rib 8315*b* can include a plurality of heat-blocking ribs. The second heat-blocking rib 8315*b* can extend in a perpendicular manner to the first heat-blocking rib 8315*a* and be connected to the plurality of first heat-blocking ribs 8315*a*.

The first heat-blocking rib 8315*a* and the second heat-blocking rib 8315*b* can be configured to face toward the first heat exchanger 910. Thus, an amount of the heat transfer from the first heat exchanger 910 to the cleaning water channel 833 via the first heat-blocking rib 8315*a* and the second heat-blocking rib 8315*b* can be reduced.

Further, the shielding cover body 8311 can include an evaporator cover body 83111 facing toward the first heat exchanger 910 and a condenser cover body 83112 extending rearwards from the evaporator cover body 83111 and facing toward the second heat exchanger 920. The first heat-blocking rib 8315*a* and the second heat-blocking rib 8315*b* can be disposed on a bottom face of the evaporator cover body 83111, and the cover through-hole 8313 can extend through the bottom face of the evaporator cover body 83111.

In some examples, the duct cover 830 can include a channel inserted groove 8349 that is recessed in a bottom face of the duct cover and constitutes the channel defining portion 834. The channel inserted groove 8349 can be recessed in the bottom face of the shielding cover body 8311 and extend to the channel defining portion 834.

The channel inserted groove 8349 can extend along an extending direction of the channel defining portion 834. The channel inserted groove 8349 can be formed in a process of injection molding the channel defining portion 834, and a load applied to the channel defining portion 834 can be distributed, thereby reinforcing structural rigidity of the channel defining portion 834.

In some examples, the duct cover 830 can include a duct cover extension 832 extending in a thickness direction from an outer face of each of the shielding cover body 8311 and the communication cover body 8312 and along a circumference of each of the shielding cover body 8311 and the communication cover body 8312. The air flow duct 822 and the inflow duct 821 shown in FIG. 13 can be coupled to the duct cover extension 832.

The duct cover extension 832 can protrude in the thickness direction from at least one of both side faces, a front face, and a rear face of each of the shielding cover body 8311 and the communication cover body 8312 to improve durability of each of the shielding cover body 8311 and the communication cover body 8312 and to provide a space in which a separate component can be seated on top of each of the shielding cover body 8311 and the communication cover body 8312.

In some examples, the duct cover extension 832 can include an inserted portion 8322 extending in the thickness direction and inserted into an inner face of each of the inflow duct and the air flow duct 822, and a step portion 8223 spaced outwardly from an outer circumferential face of the inserted portion 8322 and extending in the thickness direction Z2 and coupled to an outer face of each of the air flow duct 822 and the inflow duct 821.

Between an inner circumferential face of the step portion 8223 and an outer circumferential face of the inserted portion 8322, a sealing seat portion 8324 into which a top each of the air flow duct 822 and the inflow duct 821 is inserted can be disposed. The air flow duct 822 and the inflow duct 821 of the air circulating channel 820 can be inserted into the sealing seat portion 8324 and be coupled to a portion between the step portion 8223 and the inserted portion 8322. Accordingly, the air flow duct 822 and the inflow duct 821 can be coupled to the shielding cover body 8311 and the communication cover body 8312, respectively, so that open top faces thereof can be shielded.

Figure 18:
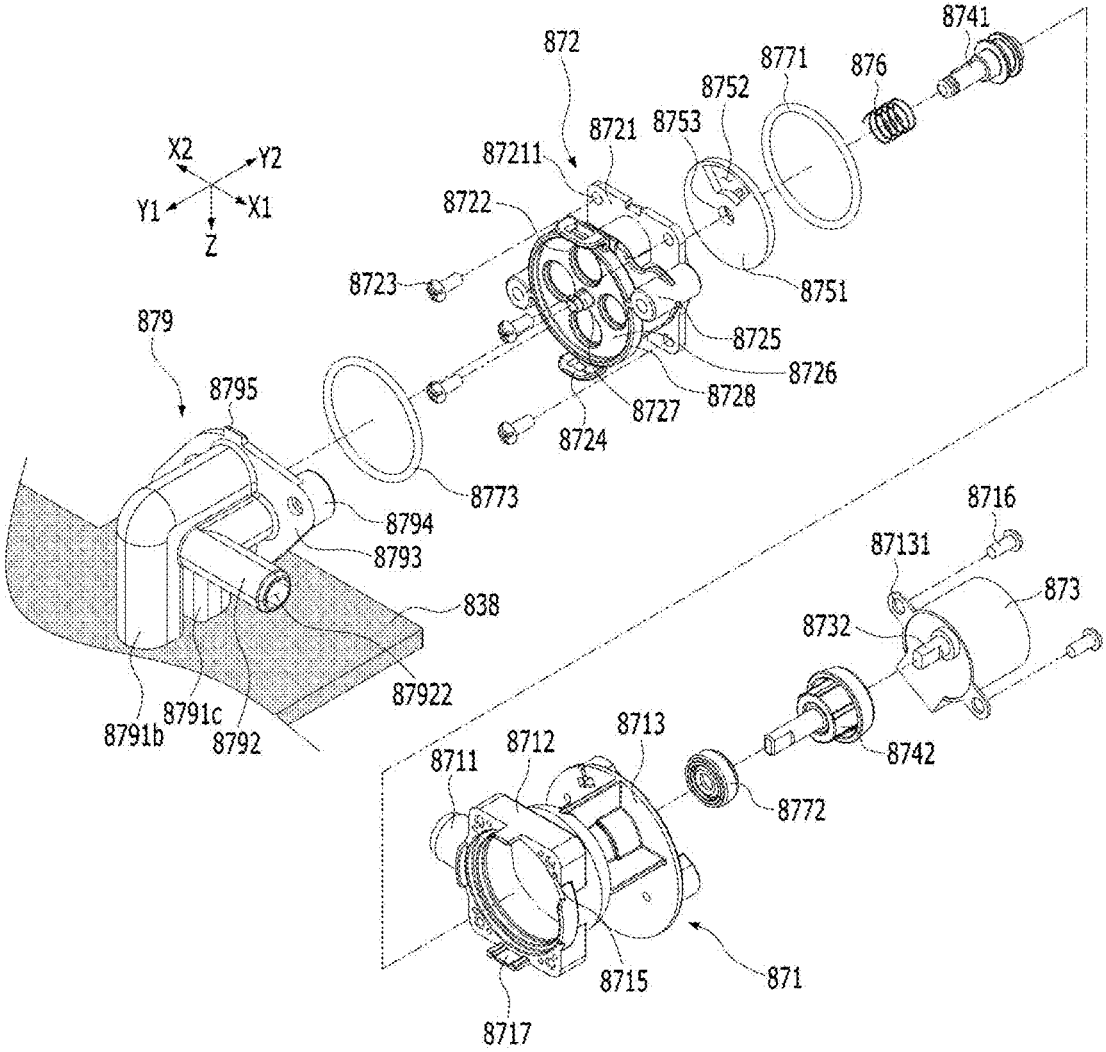
FIG. 18 is an exploded perspective view showing an example of a channel switching valve.

FIG. 18 is an exploded perspective view of the channel switching valve in a laundry treating apparatus.

FIG. 18 illustrates a detailed structure of the channel switching valve 870 that selectively supplies the water to the plurality of cleaning water channels 833. FIG. 18 is a view of the channel switching valve 870 viewed in a direction from a bottom to a top (Z direction).

The channel switching valve 870 can include the water receiving portion 871 communicating with the pump 861 and receiving the water from the pump 861, and the connective portion 879 communicating with the water receiving portion 871 and connected to the valve connector 838 to deliver the water to the cleaning water channel 833. The channel switching valve 870 can include the water delivering portion 872 disposed between the water receiving portion 871 and the connective portion 879 and coupled to the water receiving portion 871 and the connective portion 879.

In some examples, the connective portion 879 can include a connective transfer channel 8792 that communicates with the water delivering portion 872 and receives water from the water delivering portion 872. The connective transfer channel 8792 can act as a passage which can be in communication with the water storage tank 120 and along which the water supplied from the water delivering portion 872 can flow to the water storage tank 120.

Accordingly, the water storage tank 120 can receive the water transferred to the channel switching valve 870 through the channel switching valve 870 from the pump 861 via the connective transfer channel 8792 and can temporarily store therein the water.

In this case, the connective transfer channel 8792 can be configured such that one end thereof faces toward the water delivering portion, and the other end thereof faces toward the water storage tank 120.

Further, one end and the other end of the connective transfer channel 8792 can be spaced apart from each other so as to be prevented from facing toward each other. The connective transfer channel 8792 can be configured such that one end and the other end thereof can be prevented from facing toward each other in a straight line manner.

In some examples, the water receiving portion 871 can include a scroll receiving portion 8712 coupled to the water delivering portion 872, and a water inlet portion 8711 extending from the scroll receiving portion 8712 toward the water collector 860 (see FIG. 14) and connected to the first water collector drain pipe 8911*a*.

The water inlet portion 8711 can communicate with an inside of the scroll receiving portion 8712 and receive water from the first water collector drain pipe 8911*a* and can move the water into the inside of the scroll receiving portion 8712.

Further, the water receiving portion 871 can include a driver receiving portion 8713 extending from the scroll receiving portion 8712 in a direction away from the water delivering portion 872, a valve driver 873 installed in the driver receiving portion 8713 to provide rotation power, and a valve rotatable portion 874 disposed within the scroll receiving portion 8712 and coupled to the valve driver 873 and configured to rotate. The water receiving portion 871 can include a driver fixing member 8716 that secures the valve driver 873 to the driver receiving portion 8713.

Further, the water receiving portion 871 can include a scroll 875 accommodated in the scroll receiving portion 8712 and coupled to the valve rotatable portion 874 and configured to rotate.

The valve rotatable portion 874 can include a second valve rotation shaft 8742 coupled to the valve driver 873 so as to rotate, and a first valve rotation shaft 8741 coupled to the second valve rotation shaft 8742 and the scroll 875 so as to rotate.

In some examples, the water delivering portion 872 can include a delivering body 8721 to which the scroll receiving portion 8712 is coupled, and a contact portion 8726 extending from the delivering body 8721 toward the connective portion 879 and coupled to the connective portion 879.

Further, the water delivering portion 872 can include a supply channel 8722 that passes through the delivering body 8721 and the contact portion 8726 and communicates with the connective transfer channel 8792 and the receiving channels 8791*a*, 8791*b*, and 8791*c*.

The supply channel 8722 can include a plurality of supply channels arranged along a circumference of the contact portion 8726. The plurality of supply channels can communicate with the plurality of receiving channels 8791*a*, 8791*b*, and 8791*c* and the connective transfer channel 8792, respectively.

The scroll 875 can include a scroll plate 8751 that is accommodated in the scroll receiving portion 8712 and rotates, a scroll communication hole 8752 that passes through the scroll plate 8751 and selectively communicates with the plurality of supply channels 8722, and a scroll coupling groove 8753 passing through the scroll plate 8751 and coupled to the first valve rotation shaft 8741.

The scroll plate 8751 can rotate while being in contact with one end of the supply channel 8722. The scroll communication hole 8752 can be configured to selectively communicate with one of the supply channels 8722 according to the rotation of the scroll plate 8751.

Accordingly, water flowing into the water inlet portion 8711 according to the rotation of the scroll plate 8751 can be selectively guided to the connective transfer channel 8792 and the receiving channels 8791*a*, 8791*b*, and 8791*c*.

When water is supplied to the connective transfer channel 8792, the water stored in the water collector 860 can flow to the water storage tank 120. Further, when water is supplied to one of the receiving channels 8791*a*, 8791*b*, and 8791*c*, water can be supplied to one of the cleaning water channels 833.

Accordingly, according to the operation of the channel switching valve 870, water can be selectively supplied to one of the water storage tank 120 or the cleaning water channel 833. Further, when water is supplied to one of the plurality of cleaning water channels 833, the pressure of water discharged to the first heat exchanger 910 can be greater than that in a case when water is continuously supplied to all of the plurality of cleaning water channels 833.

In some examples, when the water supplied to the channel switching valve 870 flows into a location between the connective portion 879 and the valve connector 838, various devices for the operation of the laundry treating apparatus can come into contact with the water.

In some implementations, the receiving channels 8791*a*, 8791*b*, and 8791*c* can be formed integrally with the valve connector 838. This prevents water from leaking to a location between the connective portion 879 and the valve connector 838.

The receiving channels 8791*a*, 8791*b*, and 8791*c* can pass through the bottom face of the valve connector 838 and communicate with the cleaning water channel 833. The receiving channels 8791*a*, 8791*b*, and 8791*c* can extend first downwards from the valve connector 838 and then extend in a direction away from the valve connector 838.

Each of the receiving channels 8791*a*, 8791*b*, and 8791*c* can be formed to be positioned at a lower level than that of the top face of the valve connector 838. Each of the receiving channels 8791*a*, 8791*b*, and 8791*c* can extend through the valve connector 838 so that one end thereof can be inserted into the cleaning water channel 833.

In some examples, the connective portion 879 can include a connective extension 8793 extending from the outer circumferential face of the connective transfer channel 8792 and the outer circumferential face of each of the receiving channels 8791*a*, 8791*b*, and 8791*c*.

The connective extension 8973 can couple the connective transfer channel 8792 to the receiving channels 8791*a*, 8791*b*, and 8791*c*. The connective extension 8793 can be integrally formed with the connective transfer channel 8792 and the receiving channels 8791*a*, 8791*b*, and 8791*c*, and can serve to fix the connective transfer channel 8792 and the receiving channels 8791*a*, 8791*b*, and 8791*c*.

In some examples, the water delivering portion 872 can include a fastening portion 8725 that extends from an outer circumferential face of the contact portion 8726 and can be coupled to the connective extension 8793. The connective portion 879 can include fixing protrusion 8794 extending from the connective extension 8793 to the fastening portion 8725 and coupled to the fastening portion 8725.

The fixing protrusion 8794 and the fastening portion 8725 can be configured to face toward each other. One end of the fastening portion 8725 can be coupled to and accommodated in the fixing protrusion 8794. As shown in the figure, the fixing protrusion 8794 can be disposed at each of one side and the other side of the connective extension 8793. The fastening portion 8725 can be disposed at each of one side and the other side of the contact portion 8726 and can face toward the fixing protrusion 8794.

Further, the connective portion 879 can include a connective protrusion 8795 protruding from the outer circumferential face of the connective extension 8793 and spaced apart from the fixing protrusion 8794. Further, the water delivering portion 872 can include a mount hook 8724 which extends from the outer circumferential face of the contact portion 8726 and into which the connective protrusion 8795 is inserted.

The mount hook 8724 can be disposed at a position corresponding to that of the connective protrusion 8795 and can be coupled to the connective protrusion 8795. In an example, as shown in the figure, the connective protrusion 8795 can be formed to protrude from each of one side and the other side in a vertical direction (the Z-direction) of the connective extension 8793. The mount hook 8724 can be disposed at each of one side and the other side in a vertical direction (the Z-direction) of the contact portion 8726.

Accordingly, the water delivering portion 872 can be coupled to the connective extension 8793 through the connective protrusion 8795 and the fixing protrusion 8794, and can prevent the water delivering portion 872 from being spaced from the connective extension 8793.

Further, the water delivering portion 872 can include a protrusion 8727 that protrudes from a center of the contact portion 8726 toward the connective extension 8793 and is inserted into the connective extension 8793. The protrusion 8727 can be inserted into the connective extension 8793 to prevent the water delivering portion 872 from being removed from the connective portion 879.

In some examples, the water delivering portion 872 can include a fixing member 8723 for fixing the scroll receiving portion 8712 to the delivering body 8721. The scroll receiving portion 8712 can include a fixing groove 8715 into which the fixing member 8723 is inserted. Further, the water receiving portion 871 can have a protruding hook 8717 that extends from an outer circumferential face of the scroll receiving portion 8712 and is coupled to the delivering body 8721.

In some examples, the channel switching valve 870 can include a sealing member 8773 disposed between the connective portion 879 and the water delivering portion 872. The sealing member 8773 can be disposed between the connective extension 8793 and the contact portion 8726 to prevent water from leaking to a location between each of the receiving channels 8791*a*, 8791*b*, and 8791*c* and the supply channel 8722.

The sealing member 8773 can be accommodated in one of the contact portion 8726 or the connective extension 8793. The sealing member 8773 can be configured to surround the receiving channels 8791*a*, 8791*b*, and 8791*c*.

A sealing portion 877 can include a shaft sealing member 8772 disposed between the second valve rotation shaft 8742 and the first valve rotation shaft 8741 to prevent water from leaking to the valve driver 873, and a scroll sealing member 8771 that surrounds an outer circumferential face of the scroll plate 8751 and prevents water from leaking to a location between the scroll receiving portion 8712 and the delivering body 8721.

An elastic member 876 for pressing the scroll 875 in a direction away from the first valve rotation shaft 8741 can be disposed between the scroll 875 and the first valve rotation shaft 8741.

Figure 19:
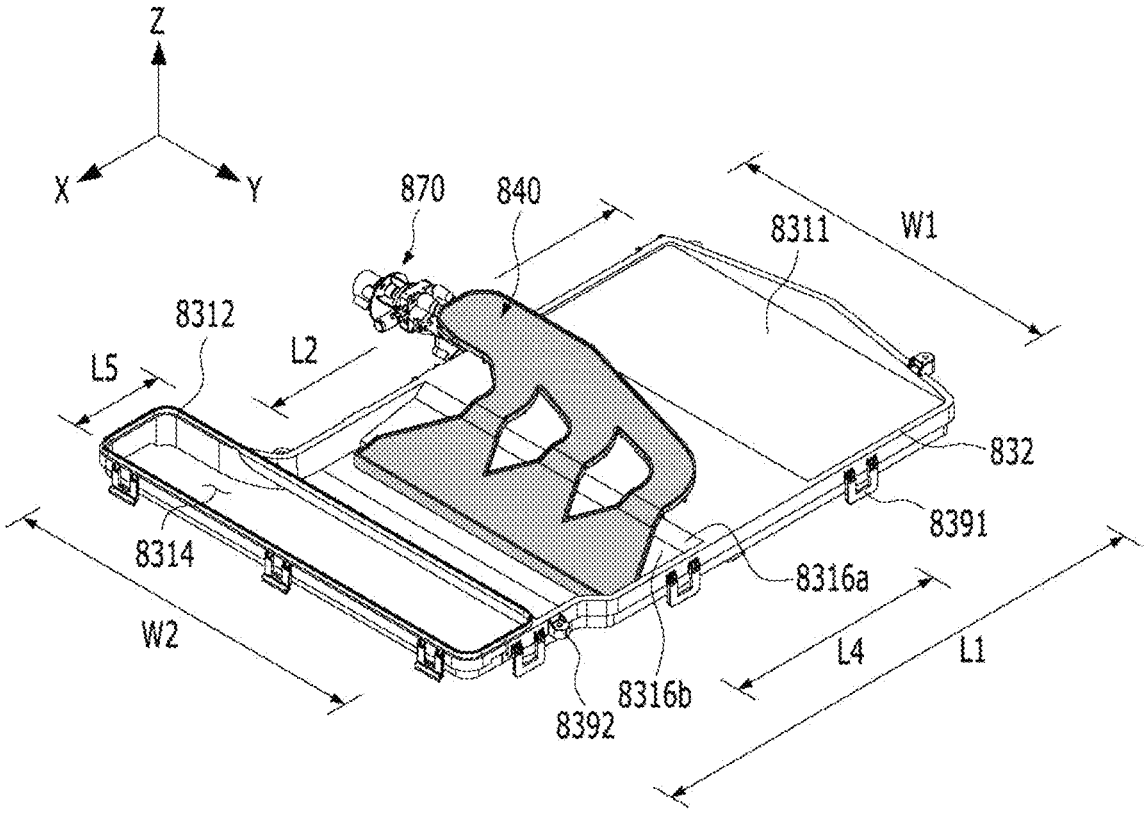
FIG. 19 is a perspective view showing an example of a duct cover to which a nozzle cover is coupled.

FIG. 19 is a perspective view showing the duct cover to which the nozzle cover is coupled in the laundry treating apparatus.

The air circulating channel 820 can further include the nozzle cover 840 that shields the cleaning water channel 833 and prevents water flowing through the cleaning water channel 833 from scattering to the outside.

The nozzle cover 840 can be coupled to the top of the cleaning water channel 833 and can be disposed above the shielding cover body 8311. When the shielding cover body 8311 is viewed from above the nozzle cover 840, the nozzle cover 840 can accommodate the cleaning water channel 833 and can be coupled to the top of the cleaning water channel 833 so that the cleaning water channel 833 can be screened with the nozzle cover 840.

The nozzle cover 840 can extend along an extension direction of the cleaning water channel 833. That is, the nozzle cover 840 can extend from one side thereof at which the channel switching valve 870 can extend to the other side at which the inflow communication hole 8314 is disposed. For example, a direction toward one side can be a direction in which the channel switching valve 870 extends from the valve connector 838, while a direction toward the other side can be a direction toward the inflow communication hole 8314, that is, a frontward direction (X direction).

Further, a length L4 by which the nozzle cover 840 extends frontwards and rearwards can be smaller than or equal to a length L2 by which the shielding cover body 8311 extends. The length L4 by which the nozzle cover 840 extends forwards and backwards can be larger than or equal to a length by which the cleaning water channel 833 extends, which can be appropriately designed according to an amount of water to wash the first heat exchanger 910.

The nozzle cover 840 can be coupled to a top of the channel defining portion 834 shown in FIG. 15 and can be configured to shield the cleaning water channel 833. As shown, the nozzle cover 840 can be coupled to a top of each of the first cleaning water channel 833*a*, the second cleaning water channel 833*b*, and the third cleaning water channel 833*c* and can be configured to shield the first cleaning water channel 833*a*, the second cleaning water channel 833*b* and the third cleaning water channel 833*c*.

Accordingly, the nozzle cover 840 can prevent the water flowing through the cleaning water channel 833 from scattering to the outside.

Figure 20:
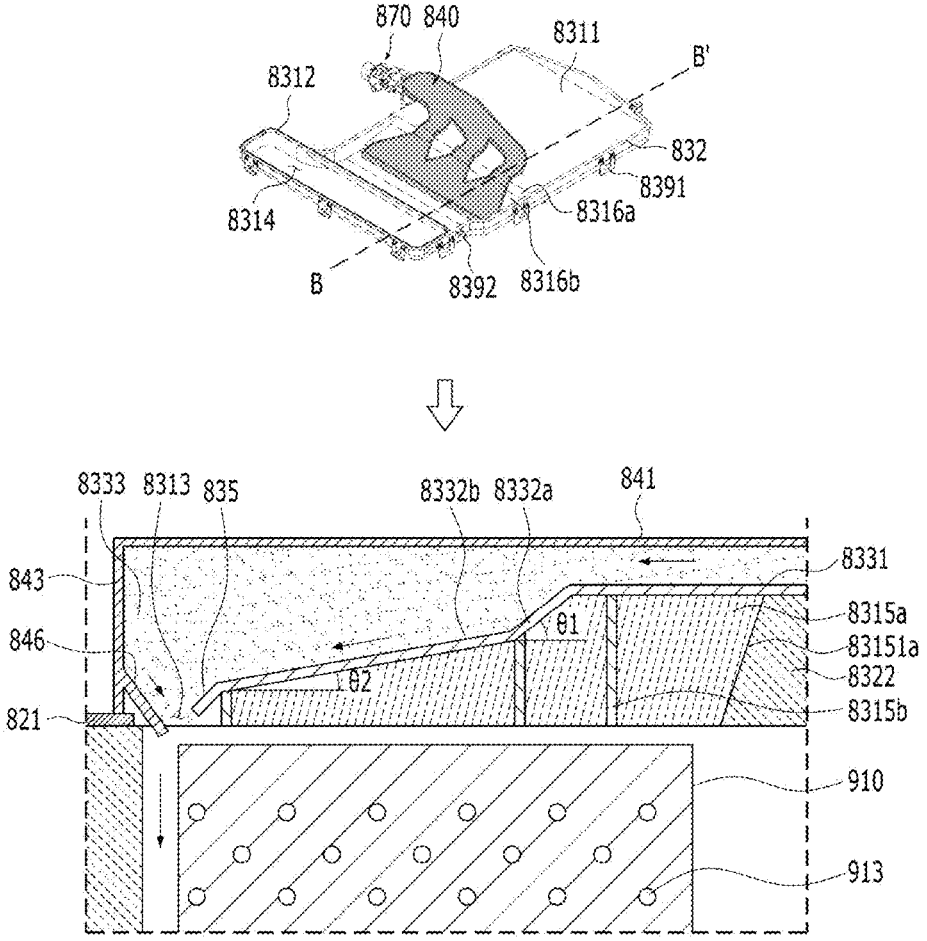
FIG. 20 is a cross-sectional view showing an example of a nozzle cover.

FIG. 20 is a cross-sectional view showing an example of the nozzle cover in the laundry treating apparatus. FIG. 20 is a cross-sectional view in a longitudinal direction B-B' showing an inside of the duct cover 830 and the nozzle cover 840 shown in FIG. 19.

The nozzle cover 840 can include a nozzle cover body 841 shielding the cleaning water channel 833.

The nozzle cover body 841 can be coupled to a top 8341 of the channel defining portion 834 shown in FIG. 15 and extend along the extension direction of the cleaning water channel 833. The nozzle cover body 841 can extend in parallel with the guide channel 8331, and a distance between the nozzle cover body 841 and the cleaning water channel 833 can gradually increase along a direction in which the water flows.

That is, a distance between a bottom face of each of the first discharge channel 8332*a* and the second discharge channel 8332*b* and the nozzle cover body 841 can gradually increase along the direction in which the water flows.

Further, the nozzle cover 840 can further include a shielding rib 843 that moves water flowing along the cleaning water channel 833 to the cover through-hole 8313.

The shielding rib 843 can extend from a distal end of the nozzle cover body 841 to the shielding cover body 8311. The shielding rib 843 together with the nozzle cover body 841 can serve to shield the cover through-hole 8313, and can be disposed at the distal end of the cover through-hole 8313.

That is, one end of the cover through-hole 8313 can be connected to the second discharge channel 8332*b* and the other end thereof can be connected to the shielding rib 843. Alternatively, the shielding rib 843 can be spaced apart from the cover through-hole 8313 and positioned in front of the cover through-hole 8313.

The shielding rib 843 can serve to temporarily store the water discharged from the cleaning water channel 833 inside the cleaning water channel 833. Water flowing along the cleaning water channel 833 can collide with the shielding rib 843 such that the water can flow to the cover through-hole 8313.

In some examples, the condensate discharged from the second discharge channel 8332 can be discharged through the cover through-hole 8313 and along the discharge rib 835. In some examples, the condensate may not be discharged to the first heat exchanger 910, but can be discharged to a location in front of the first heat exchanger 910 along the extension direction of the discharge rib 835. In particular, as a speed of the condensate passing through the discharge rib 835 increases, the number of times the condensate comes into contact with an inlet face of the first heat exchanger 910 can be reduced.

In some implementations, the nozzle cover 840 can further include a switching rib 846 for guiding the water passing through the discharge rib 835 toward the first heat exchanger 910.

The switching rib 846 can be configured to extend from the shielding rib 843 toward the cover through-hole 8313 and to face toward the discharge rib 835. The switching rib 846 can extend toward the first heat exchanger 910 so that a distal end of the switching rib 846 can be configured to protrude downwardly beyond the cover through-hole 8313. The switching rib 846 can extend in an inclined manner relative to the discharge rib 835, and a distal end of the switching rib 846 and a distal end of the discharge rib 835 can be configured to be spaced apart from each other.

The distal end of the switching rib 846 can be disposed in front of a front face of the first heat exchanger 910, and the distal end of the discharge rib 835 can be disposed in rear of the front face of the first heat exchanger 910. Accordingly, the water passing through the discharge rib 835 can collide with the switching rib 846 and thus be discharged to a location between the distal end of the switching rib 846 and the distal end of the discharge rib 835.

In some examples, an inclination angle θ1 of the first discharge channel 8332*a*, that is, the inclination angle θ1 of the first inclined face 8316*a* can be greater than or equal to an inclination angle θ2 of the second discharge channel 8332*b*, that is, the inclination angle θ2 of the second inclined face 8316*b*.

Accordingly, the water flowing into the cleaning water channel 833 can flow to the cover through-hole 8313 due to gravity while passing through the first discharge channel 8332*a* and the second discharge channel 8332*b*. Thus, the water can be completely discharged. Further, a thickness of each of the first inclined face 8316*a* and the second inclined face 8316*b* can be uniform.

Figure 21:
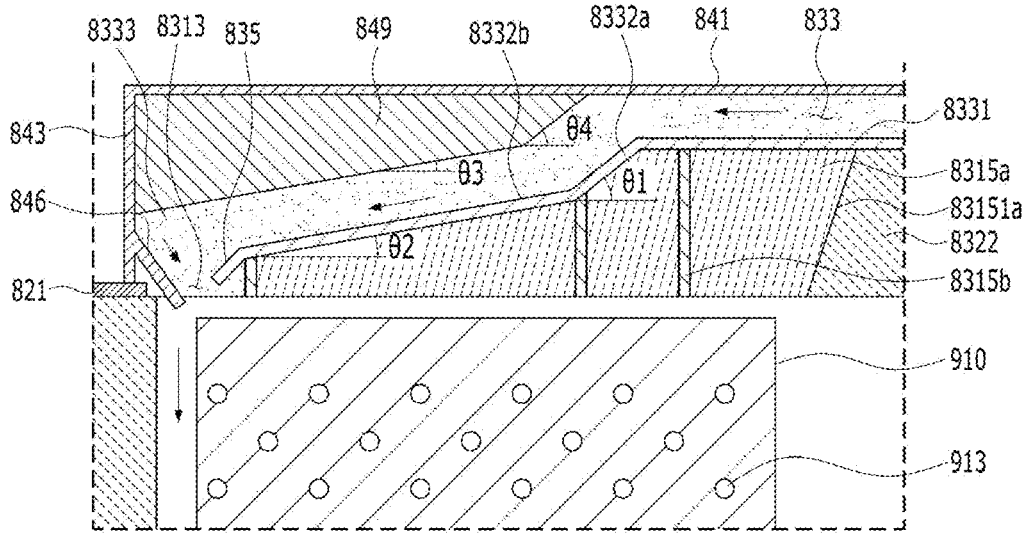
FIG. 21 is a cross-sectional view showing an example of a nozzle cover.

FIG. 21 is a cross-sectional view showing another example of the nozzle cover in the laundry treating apparatus. Hereinafter, the description will be based on a different configuration from that of the nozzle cover 840 in FIG. 20.

The nozzle cover 840 can further include an inserted portion 849 that reduces a distance between the cleaning water channel 833 and the nozzle cover body 841.

The inserted portion 849 can be configured to protrude from the nozzle cover body 841 toward the inside of the cleaning water channel 833. The inserted portion 849 can be configured to protrude from a top face of the nozzle cover body 841 toward the first discharge channel 8332*a* and the second discharge channel 8332*b*.

As the inserted portion 849 protrudes from the nozzle cover body 841 toward the cleaning water channel 833, a thickness of the nozzle cover body 841 can increase. The inserted portion 849 can be configured such that a length by which the inserted portion 849 protrudes from the nozzle cover body 841 gradually increases along a flowing direction of the condensate.

The inserted portion 849 can be configured such that one face thereof facing toward the cleaning water channel 833 has an inclination angle corresponding to the inclined face 8316.

In some examples, an inclination angle θ4 of one face of the inserted portion 849 facing toward the first inclined face 8316 can correspond to the inclination angle θ1 of the first inclined face. An inclination angle θ3 of one face of the inserted portion 849 facing toward the second inclined face 8316*b* can correspond to the inclination angle θ2 of the second inclined face.

A distance between one face of the inserted portion 849 facing toward the first discharge channel 8332*a* and the first inclined face 8316*a* can correspond to a vertical dimension between a bottom face and a top face of the guide channel 8331.

Further, a distance between one face of the inserted portion 849 facing toward the second inclined face 8316*b* and the second inclined face 8316*b* can correspond to a vertical dimension between the bottom face and the top face of the guide channel 8331.

The inserted portion 849 can serve to reduce an internal space of the cleaning water channel 833. As a result, a vertical dimension of the cleaning water channel 833 can be reduced so that the speed of the water reaching the shielding rib 843 can increase and thus the water can flow quickly to the cover through-hole 8313.

Further, as the inserted portion 849 is formed, a vertical dimension of the cleaning water channel 833 can be uniform. Accordingly, when the water flows in the cleaning water channel 833, a volume occupied by air inside the cleaning water channel 833 can be reduced. Further, the noise and vibration generated when the water inside the cleaning water channel 833 collides with an inner circumferential face of the cleaning water channel 833 can be reduced.

Further, even when the water first reaches a specific area of the inserted portion 849, the water can be uniformly discharged along an entire area of the inserted portion 849 and through the cover through-hole 8313.

Figure 22:
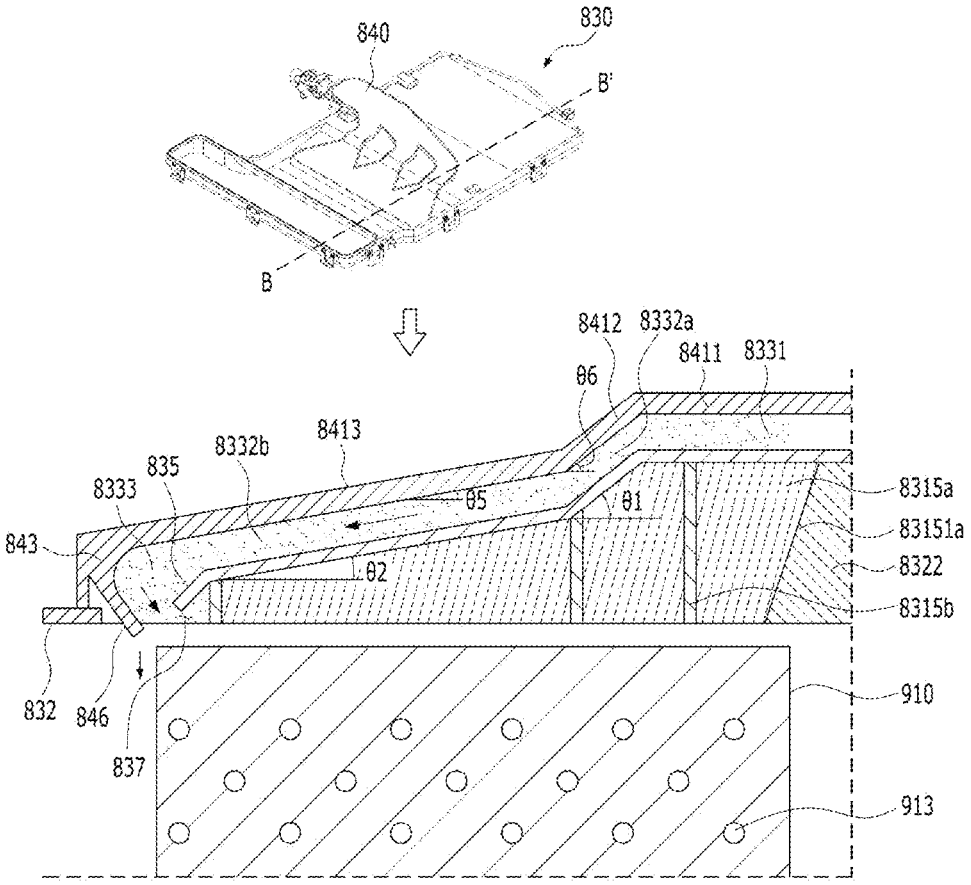
FIG. 22 is a cross-sectional view showing an example of a nozzle cover.

FIG. 22 is a cross-sectional view showing another example of the nozzle cover in the laundry treating apparatus. FIG. 22 is a cross-sectional view of an inside of the duct cover 830 and the nozzle cover 840 (B-B').

The nozzle cover body 841 can include a welded plate 8411 coupled to the channel defining portion 834 and shielding the guide channel 8331, a first inclined plate 8412 extending from the welded plate 8411 and coupled to the channel defining portion 834 and shielding the first discharge channel 8332*a*, and a second inclined plate 8413 extending from the first inclined plate 8412 and coupled to the channel defining portion 834 and shielding the second discharge channel.

The shielding rib 843 can extend downward from the distal end of the second inclined plate 8413 and can be coupled to the top face of the duct cover body 831. The switching rib 846 can extend from the second inclined plate 8413 or the shielding rib 843 toward the cover through-hole 8313.

The first inclined plate 8412 can extend from the welded plate 8411 in an inclined manner along the flowing direction of water, and the second inclined plate 8413 can extend from the first inclined plate 8412 in an inclined manner along the flowing direction of water.

An inclination angle θ3 of the first inclined plate with respect to the welded plate can correspond to the inclination angle θ1 of the first inclined face. An inclination angle θ4 of the second inclined plate with respect to the welded plate 8411 can correspond to the inclination angle θ2 of the second inclined face. Accordingly, an internal vertical dimension of the cleaning water channel 833 can be constant.

A thickness of each of the welded plate 8411, the first inclined plate 8412 and the second inclined plate 8413 can be uniform, which has the effect of lowering a manufacturing cost of the nozzle cover 840.

Figure 23A:
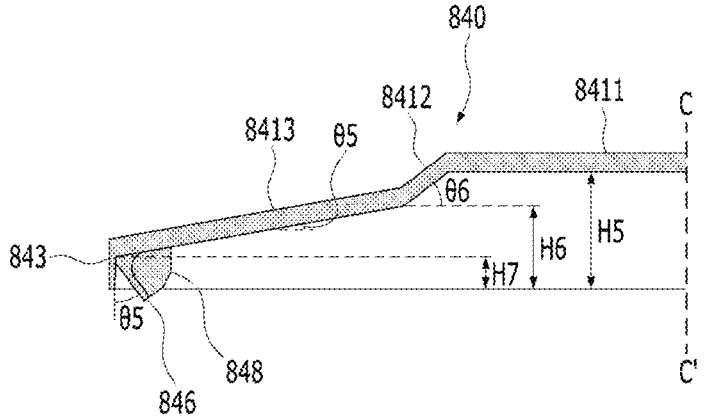
FIGS. 23A and 23B are a side view and a bottom view of the nozzle cover shown in FIG. 22.
Figure 23B:
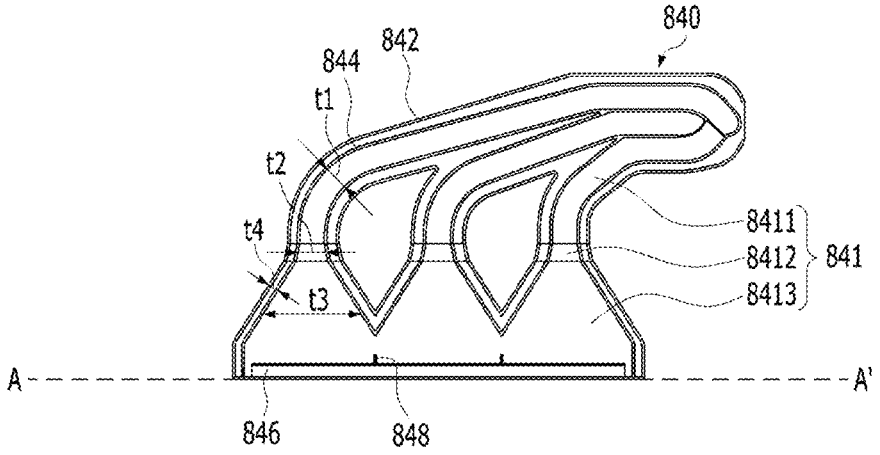

FIGS. 23A and 23B are a side view and a bottom view of the nozzle cover shown in FIG. 22. FIG. 23A is a side view of the nozzle cover 840, and FIG. 23B is a bottom view of the nozzle cover 840.

The switching rib 846 can extend from the second inclined plate 8413 or the shielding rib 843 toward the cover through-hole 8313. An angle θ5 between the switching rib 846 and the shielding rib 843 can be in a range of 10 degrees to 80 degrees. The angle θ5 between the switching rib 846 and the shielding rib 843 can be designed in various manners depending on an arrangement of the shielding rib 843 and the first heat exchanger 910 or an arrangement of the shielding rib 843 and the cover through-hole 8313.

A vertical dimension H7 of the shielding rib 843 can be smaller than a vertical dimension of the second inclined face 8316*b*. A vertical dimension of the second inclined plate 8413 can be smaller than a vertical dimension of the first inclined face 8316*a* of H6 and be larger than a vertical dimension of the second inclined face 8316*b*.

Accordingly, the channel defining portion 834 can protrude by a certain vertical dimension and can be coupled to the nozzle cover 840. The nozzle cover 840 can face toward the first inclined face 8316*a*, the second inclined face 8316*b*, and the cleaning water channel 833 and can have a certain vertical dimension.

In some examples, the nozzle cover 840 can include a partitioning rib 848. The rib 848 together with the partitioning rib 836 can partitioning the water discharged from the plurality of cleaning water channels 833.

The partitioning rib 848 can extend from the switching rib 846 towards the partitioning rib 836. The partitioning rib 848 can overlap the partitioning rib 836. For example, the partitioning rib 848 can be coupled to the partitioning rib 836.

The partitioning rib 848 together with the partitioning rib 836 can partition the water discharged from the plurality of cleaning water channels 833. Accordingly, the partitioning rib 848 prevents the water discharged from one cleaning water channel 833 from flowing to another cleaning water channel 833, so that water is uniformly sprayed to the first heat exchanger 910.

As shown in FIG. 23B, the nozzle cover 840 can include a coupling portion 844 coupled to the channel defining portion 834.

The coupling portion 844 can extend from the nozzle cover body 841 toward the channel defining portion 834, and can be configured to be coupled to the top of the channel defining portion 834.

The coupling portion 844 can be welded onto the top of the channel defining portion 834 so as to be integrally formed with the channel defining portion 834. The welded plate 8411 can be configured to be in contact with the top of the channel defining portion 834. The coupling portion 844 can face toward the channel defining portion 834 and extend along an extension direction of the channel defining portion 834.

Further, the nozzle cover 840 can include an extension rib 842 that prevents the nozzle cover body 841 from being removed from the cleaning water channel 833.

The extension rib 842 can be configured to extend from an outer circumferential face of the nozzle cover body 841 in the thickness direction and to accommodate therein the channel defining portion 834. The extension rib 842 can be configured to have a larger width than a width of the channel defining portion 834 and to accommodate therein the outer circumferential face of the channel defining portion 834.

Alternatively, when the support 837 can be disposed on the outer circumferential face of the channel defining portion 834, the extension rib 842 can be configured to accommodate therein a top of the support 837.

In some examples, a distance t1 between both opposing inner faces of the coupling portion 844 extending from the welded plate 8411 can correspond to a width t1 of the guide channel 8331.

A distance t2 between both opposing inner faces of the coupling portion 844 extending from the first inclined plate 8412 can correspond to a width t2 of the first discharge channel 8332*a*. A distance t3 between both opposing inner faces of the coupling portion 844 extending from the second inclined plate 8413 can correspond to a width t3 of the second discharge channel 8332*b*.

Accordingly, the welded plate 8411 can shield the cleaning water channel 833, such that the water inside the cleaning water channel 833 can be prevented from leaking to the outside.

Figure 24:
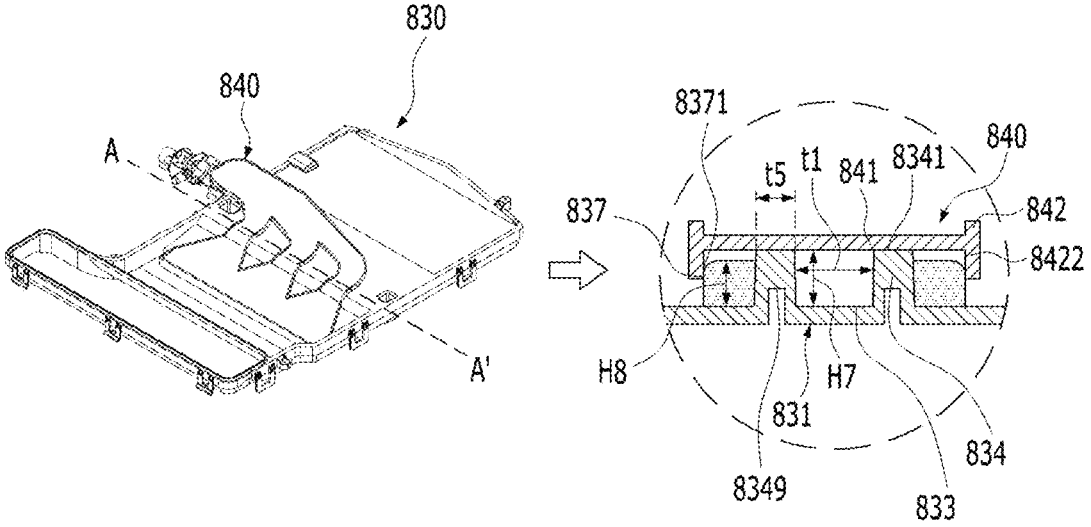
FIG. 24 is a cross-sectional view showing one example in which a nozzle cover and a channel defining portion are coupled to each other.

FIG. 24 is a cross-sectional view showing an example in which the nozzle cover and the channel defining portion are coupled to each other in the laundry treating apparatus.

The support 837 can include a curved portion 8371 for easy coupling of the extension rib 842 thereto.

The support 837 can include the curved portion 8371 configured to be spaced apart from the at least a portion of the extension rib 842. The curved portion 8371 can be formed at a distal end of the support coupled to the extension rib 842.

The extension rib 842 can extend from the outer circumferential face of the nozzle cover body 841 in the thickness direction and can be coupled to the support 837 at the curved portion 8371 thereof. Thus, this can prevent burr from occurring in a process where a lower end 8422 of the extension rib 842 is coupled to the support 837.

Further, a vertical dimension H7 by which the channel defining portion 834 protrudes from the top face of the duct cover body 831 can be larger than or equal to a vertical dimension H8 by which the support 837 protrudes. Accordingly, the nozzle cover body 841 can be configured to be spaced apart from the support 837.

In some examples, a thickness t5 of the channel defining portion 834 can be smaller than or equal to a width t1 of the cleaning water channel 833. A vertical dimension of the cleaning water channel 833 can correspond to a vertical dimension H7 of the channel defining portion 834.

Further, the nozzle cover body 841 can be coupled to a top 8341 of the channel defining portion 834, and the channel defining portion 834 can be integrally coupled to the nozzle cover body 841 through a thermal welding process. For example, the channel defining portion 834 can be coupled to the nozzle cover body 841 by welding.

In some examples, the thermal welding process can refer to a process of bonding surfaces of two thermoplastic members to each other by applying heat and pressure thereto. In other words, heat can be applied to the coupling portion 844 and then the coupling portion 844 can be brought into contact with the channel defining portion 834 so that the coupling portion 844 is integrally formed with the channel defining portion 834.

Alternatively, the channel defining portion 834 can be coupled to the nozzle cover body 841 through a vibrating welding process.

In some examples, the vibration welding process can refer to a process in which two thermoplastic members are melted with frictional heat generated at a contact area therebetween via vertical or left and right vibrations while pressing the two thermoplastic members against each other, and then the melted solidified members are joined to each other and are solidified.

In other words, the vibration welding process vibrates the nozzle cover body 841 or the channel defining portion 834 to generate the frictional heat between the coupling portion 844 and the channel defining portion 834 and the couples the coupling portion 844 and the channel defining portion 834 to each other using the frictional heat.

As a result, the nozzle cover body 841 can shield the cleaning water channel 833 more efficiently than in an approach in which the channel defining portion 834 and the body 841 are coupled to each other in a hook or bolt-nut coupling manner. Thus, a lifespan of a final product can extend as a modification and repair period can extend.

Further, the nozzle cover body 841 is integrally coupled to the channel defining portion 834, thereby reducing a material cost and simplifying an assembly process thereof.

Further, even when a separate cleaning water pipe is not configured, the cleaning water channel 833 can be formed via the combination of the nozzle cover 840 and the duct cover 830, so that a manufacturing process thereof can be easy.

Figure 25:
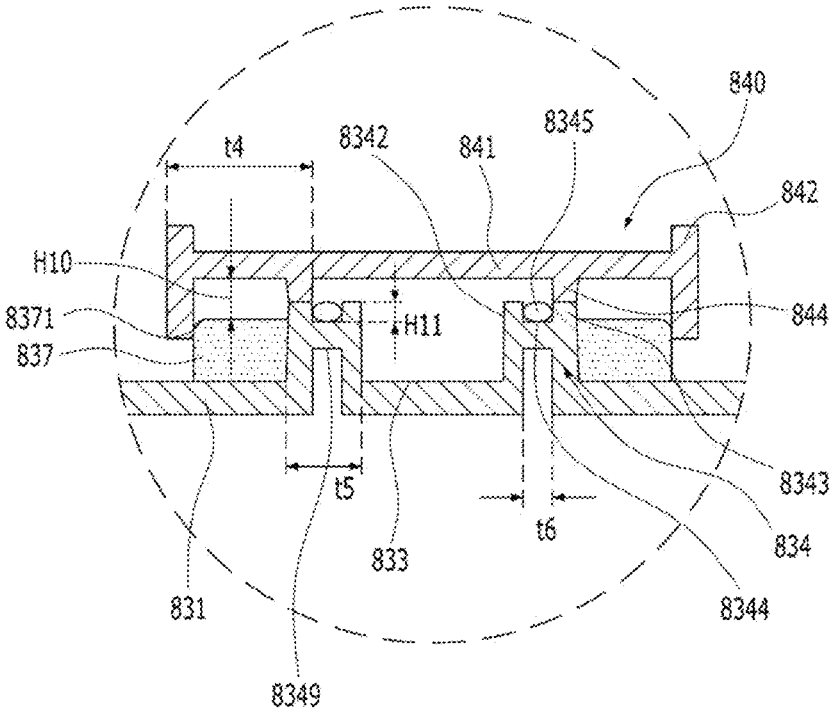
FIG. 25 is a cross-sectional view showing another example in which a nozzle cover and a channel defining portion are coupled to each other.

FIG. 25 is a cross-sectional view showing another example in which the nozzle cover and the channel defining portion are coupled to each other in the laundry treating apparatus.

In FIG. 24, the nozzle cover 840 is shown to be coupled to the channel defining portion 834. FIG. 25 is a view showing a state in which the nozzle cover 840 is spaced apart from the channel defining portion 834 by a predetermined distance before being coupled to the channel defining portion 834.

The channel defining portion 834 can further include a first coupling rib 8342 constituting an inner side face of the cleaning water channel 833 and a second coupling rib 8343 constituting an outer side face of the cleaning water channel 833.

The first coupling rib 8342 can protrude from the channel defining portion 834 and be coupled to the nozzle cover body 841. The second coupling rib 8343 can be coupled to the coupling portion 844 while protruding from the channel defining portion 834 so as to be spaced apart from the first coupling rib 8342. A vertical dimension H11 by which the second coupling rib 8343 can protrude from the channel defining portion 834 can correspond to the first coupling rib 8342.

In some examples, a lower end of the coupling portion 844 can be configured to be in contact with the top of the second coupling rib 8343, and the welded plate 8411 and the first coupling rib 8342 can be configured to be in contact with each other.

The second coupling rib 8343 can be coupled to the coupling portion 844 via a thermal welding process, or via a vibration welding process. In this process, the coupling portion 844 can be melted and coupled to the second coupling rib 8343. In some examples, the channel defining portion 834 can further include a sealing groove 8344 disposed between the first coupling rib 8342 and the second coupling rib 8343 and extending in the extension direction of the cleaning water channel 833, and a sealing member 8345 seated in the sealing groove 8344 for shielding a space between the nozzle cover body 841 and the cleaning water channel 833.

A vertical dimension H11 by which the second coupling rib 8343 and the first coupling rib 8342 protrude can correspond to a diameter of the sealing member 8345.

The sealing member 8345 can be configured to be in contact with the nozzle cover body 841 and to shield a space between the nozzle cover body 841 and the sealing groove 8344, and to prevent the water inside the cleaning water channel 833 from leaking out through the nozzle cover body 841. That is, the sealing member 8345 can prevent water leakage from the inside of the cleaning water channel 833 to the outside.

Further, a plurality of sealing grooves 8344 and a plurality of sealing members 8345 can be defined in the channel defining portion 834 and can overlap each other along the width direction.

When the plurality of sealing grooves 8344 and the plurality of sealing members are provided, a shielding force of the nozzle cover body 841 can further increase compared to a case when a single sealing groove 8344 and a single sealing member 8345 are provided.

In some examples, a distance t6 between both opposing inner faces of the channel inserted groove 8349 can be smaller than a thickness t5 of the channel defining portion 834, so that the channel inserted groove 8349 can be accommodated in the channel defining portion 834.

Figure 26B:
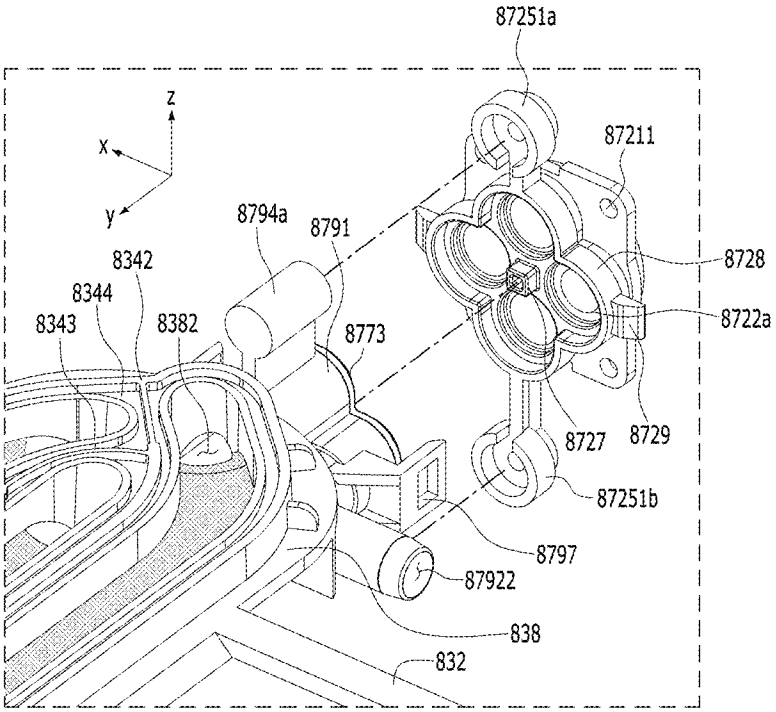
FIGS. 26A and 26B are a perspective view showing an example of a connective portion and a water delivering portion are coupled to each other.
Figure 26A:
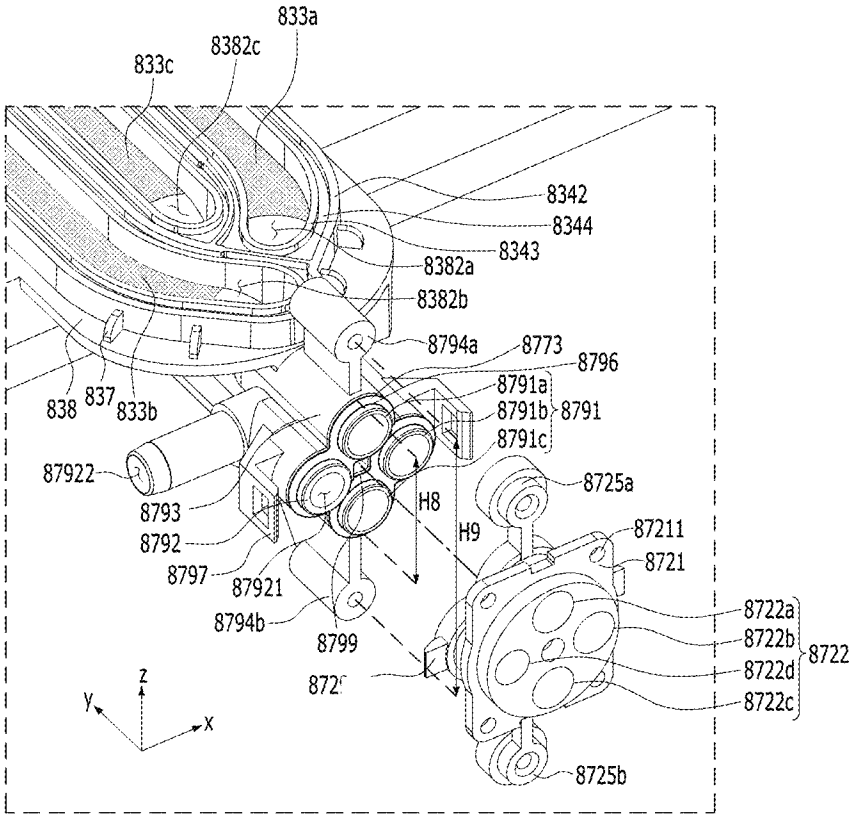

FIGS. 26A and 26B are perspective views showing a state in which the connective portion and the water delivering portion are coupled to each other in the laundry treating apparatus. Hereinafter, descriptions of those with the above-described structures will be omitted.

FIG. 26A is a perspective view showing a state in which the water receiving portion 871 is omitted from the channel switching valve 870 and the connective portion 879 and the water delivering portion 872 are present. FIG. 26B is a perspective view of a state in which the connective portion 879 and the water delivering portion 872 in FIG. 26A are coupled to each other when viewed in a different direction.

The connective portion 879 can be coupled to the valve connector 838 and extend toward the water delivering portion 872. The water delivering portion 872 can be connected to the connective portion 879 and guide the condensate supplied from the water receiving portion 871 to the connective portion 879. Further, the water receiving portion 871 can be connected to the water delivering portion 872 to supply the condensate to the water delivering portion 872.

The water receiving portion 871 can be located on top of the water collector 860 and can be connected to the water delivering portion 872. Accordingly, the water delivering portion 872 can receive a load due to a weight of the water receiving portion 871.

Further, the water delivering portion 872 can be located on top of the water collector 860 and can be connected to the connective portion 879. Accordingly, the connective portion 879 can receive a load due to the weight of the water receiving portion 871 and the weight of the water delivering portion 872.

Accordingly, the connective portion 879 can include the fixing protrusion 8794 to which the fastening portions 8725*a* and 8725*b* of the water delivering portion 872 are coupled, in order to support the water delivering portion 872 and the water receiving portion 871. The fixing protrusion 8794 can be configured to protrude from an outer circumferential face of the connective extension 8793.

The connective extension 8793 can have a distal end facing toward the water delivering portion 872 and protruding beyond the valve connector 838 in order to prevent the fixing protrusion 8794 from coming into contact with the valve connector 838. A top of the fixing protrusion 8794 can be positioned above the valve connector 838 and the first coupling rib 8342.

Further, the fixing protrusion 8794 can include first fixing protrusion 8794*a* extending from the connective extension 8793 to one side and second fixing protrusion 8794*b* extending from the connective extension 8793 to the other side.

For example, one side to which the first fixing protrusion 8794*a* can extend can refer to a side above the connective extension 8793, and the other side to which the second fixing protrusion 8794*b* can extend can refer to a side below the connective extension 8793.

In some examples, the water delivering portion 872 can include a receiving portion 8728 extending toward the connective portion 879 and an outer circumferential face of the plurality of supply channels 8722.

The receiving portion 8728 can be integrally formed with the plurality of supply channels 8722, and can be disposed closer to the valve connector 838 than the distal end of the supply channel 8722 can be.

Further, the receiving portion 8728 can be connected to the connective extension 8793 and accommodate the plurality of receiving channels 8791 therein. The sealing member 8773 can be seated on an inner circumferential face of the receiving portion 8728 and can shield a space between the supply channel 8722 and the receiving channel 8791 and the connective transfer channel 8792.

Further, the water delivering portion 872 can include a fastening portion 8725 that extends from the outer circumferential face of the receiving portion 8728 and is coupled to the connective extension 8793.

In some examples, the fastening portion 8725 can include a first fastening portion 8725*a* coupled to the first fixing protrusion 8794*a* and a second fastening portion 8725*b* coupled to the second fixing protrusion 8794*b*.

The first fastening portion 8725*a* can extend to one side from the outer circumferential face of the receiving portion 8728 and be positioned in a corresponding manner to that of the first fixing protrusion 8794*a*. The second fastening portion 8725*b* can extend from the outer circumferential face of the receiving portion 8728 to the other side and be disposed at a position corresponding to that of the second fixing protrusion 8794*b*.

In some examples, one side to which the first fastening portion 8725*a* extends from the outer circumferential face of the receiving portion 8728 can refer to a side above the receiving portion 8728. The other side to which the second fastening portion 8725*b* extends from the outer circumferential face of the receiving portion 8728 can refer to a side below the receiving portion 8728.

In some examples, the fastening portion 8725 can include a fastening rib 87251 that accommodates the fixing protrusion 8794 therein. The fastening rib 87251 has a diameter larger than a diameter of the fixing protrusion 8794 and can be configured to accommodate the fixing protrusion 8794 therein.

The fastening rib 87251 can include a first fastening rib 87251*a* protruding from the first fastening portion 8725*a* and accommodating the first fixing protrusion 8794*a* therein, and a second fastening rib 87251*b* protruding from the second fastening portion 8725*b* and accommodating the second fixing protrusion 8794*b* therein.

Accordingly, the fastening portions 8725*a* and 8725*b* can be prevented from moving in the vertical direction from the fixing protrusion 8794, so that the coupling force between the fastening portions 8725*a* and 8725*b* and the fixing protrusion 8794 can increase.

In some examples, the water delivering portion 872 can include a protrusion 8729 extending from an outer circumferential face of the receiving portion 8728. The connective portion 879 can include the mount hook 8797 that is coupled to the protrusion 8729.

The mount hook 8797 can be configured to protrude from an outer circumferential face of the connective extension 8793 and extend toward the protrusion 8729.

In some examples, the supply channel 8722 can communicate with one of the receiving channel 8791 or the connective transfer channel 8792. A plurality of supply channels 8722 can be provided and can be arranged along a circumference of the receiving portion 8728.

In some examples, the plurality of supply channels 8722 can include the first supply channel 8722*a* in communication with the first receiving channel 8791*a*, the second supply channel 8722*b* in communication with the second receiving channel 8791*b*, the third supply channel 8722*c* that communicates with the third receiving channel 8791*c*, and the fourth supply channel 8722*d* that communicates with the connective transfer channel 8792.

Further, the water delivering portion 872 can include a protrusion 8727 that can be disposed between the first supply channel 8722*a*, the second supply channel 8722*b*, the third supply channel 8722*c*, and the fourth supply channel 8722*d*.

The connective portion 879 can include the inserted portion 8799 which is disposed at a position corresponding to that of the protrusion 8727 and into which the protrusion 8727 is inserted.

The inserted portion 8799 can be disposed between the first receiving channel 8791*a*, the second receiving channel 8791*b*, the third receiving channel 8791*c*, and the connective transfer channel 8792 and face toward the protrusion 8727.

The protrusion 8727 has a diameter corresponding to that of the inserted portion 8799 and can be inserted into the inserted portion 8799. Thus, the protrusion 8727 can prevent the water delivering portion 872 from being spaced apart from the connective portion 879.

In some examples, the channel switching valve 870 can include the sealing member 8773 that prevents leakage of water supplied from the water delivering portion 872 to the connective portion 879. The connective portion 879 can include the receiving portion 8796 in which the sealing member 8773 is seated.

One end of each of the connective transfer channel 8792 and the receiving channel 8791 can protrude toward the water delivering portion 872 beyond the connective extension 8793. The receiving portion 8796 can be disposed on an outer circumferential face of each of the connective transfer channel 8792 and the receiving channel 8791 and face toward the connective extension 8793. The sealing member 8773 can be disposed between the connective portion 879 and the water delivering portion 872 and be seated in the receiving portion 8796.

In some examples, the sealing member 8773 can be configured to accommodate an outer circumferential face of each of the connective transfer channel 8792 and the receiving channel 8791. The sealing member 8773 can serve to seal a space between the connective transfer channel 8792 and the receiving channel 8791, and the supply channel 8722.

The first fastening rib 87251*a* can extend from an outer circumferential face of the first fastening portion 8725*a* toward the first fixing protrusion 8794*a* and can accommodate the first fixing protrusion 8794*a* therein. The second fastening rib 87251*b* can extend from an outer circumferential face of the second fastening portion 8725*b* toward the second fixing protrusion 8794*b* and accommodate the second fixing protrusion 8794*b* therein.

Figure 27:
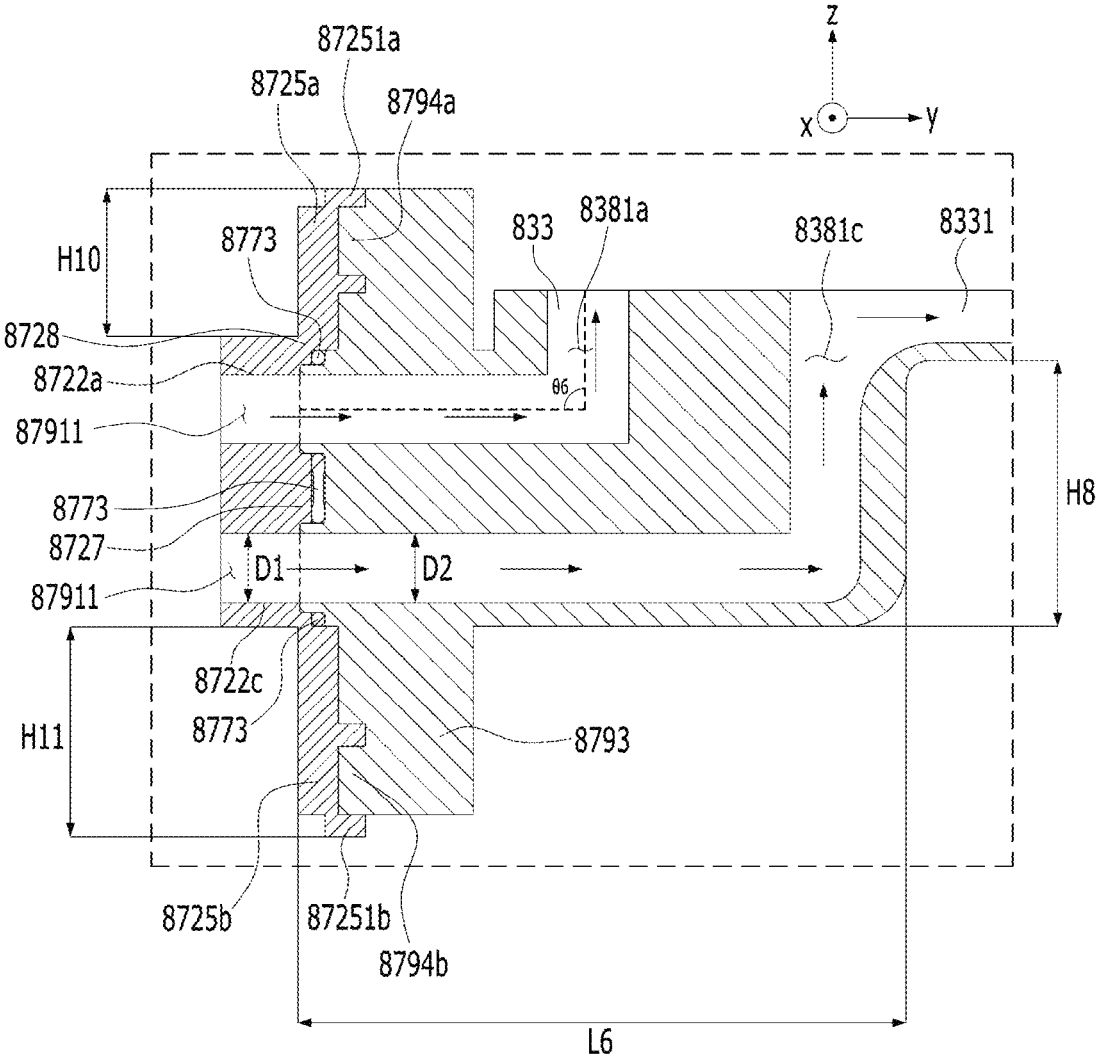
FIG. 27 shows an example of an internal cross-sectional view of the connective portion and the water delivering portion.

FIG. 27 is an internal cross-sectional view of the connective portion and the water delivering portion in the laundry treating apparatus. Hereinafter, a description of the configuration duplicate with the above configuration is omitted.

A length by which the second fixing protrusion 8794*b* extends vertically from the connective extension 8793 can be larger than a length by which the first fixing protrusion 8794*a* extends vertically from the connective extension 8793.

Because the load delivered from the water delivering portion 872 to the connective portion 879 is delivered to the second fixing protrusion 8794*b* in a larger amount than an amount in which the load is delivered to the first fixing protrusion 8794*a*, a length H11 by which the second fixing protrusion 8794*b* extends vertically from the connective extension 8793 can be larger than a length H10 by which the first fixing protrusion 8794*a* extends vertically from the connective extension 8793.

Accordingly, even when the water delivering portion 872 is coupled to the connective portion 879, the connective portion 879 can stably support the weights of the water delivering portion 872 and the water receiving portion 871.

Further, a diameter D1 of the supply channel 8722 can be equal to a diameter D2 of each of the connective transfer channel 8792 and the receiving channel 8791.

Thus, the water discharged from the supply channel 8722 can stably flow to the connective transfer channel 8792 and the receiving channel 8791. Further, the sealing member 8773 can shield a small gap between the supply channel 8722 and the receiving channel 8791 and the connective transfer channel 8792. The connective transfer channel 8792 can include a water receiving hole 87921 defined at one end of the connective transfer channel 8792 and a water discharging hole 87922 defined at another end of the connective transfer channel 8792 and configured to discharge the water received through the water receiving hole 87921 toward the water storage tank 120.

In some examples, the protrusion 8727 can pass through the sealing member 8773 and be inserted into the connective extension 8793. Thus, this can prevent the sealing member 8773 from being removed from between the water delivering portion 872 and the connective portion 879.

The receiving channel 8791 can extend in an inclined manner and toward the cleaning water channel 833, and the receiving channel 8791 can have an inclination angle θ6 in a range of 10 to 90 degrees.

For example, when the inclination angle θ6 of the receiving channel 8791 is smaller than 10 degrees, the pressure of the water flowing into the connective portion 879 becomes too low. This can be disadvantageous in terms of the energy efficiency of the pump 861.

When the inclination angle θ6 of the receiving channel 8791 exceeds 90 degrees, a length L6 by which the connective portion 879 extends from the valve connector 838 is too small. Thus, the connective portion 879 may not be able to support the loads of the water delivering portion 872 and the water receiving portion 871.

However, a distance H8 between the valve communication hole 8382 and a supply hole 87911 can be appropriately designed based on an extension length of the channel switching valve 870.

The sealing member 8773 can be accommodated in one end of the receiving channel 8791, and can be constructed to surround one end of each of the receiving channels 8791. The supply hole 87911 can be surrounded with the sealing member 8773, and the supply hole 87911 can protrude toward the water delivering portion 872 relative to the sealing member 8773.

The connective extension 8793 can be configured to have a larger diameter than a diameter of all of the plurality of receiving channels 8791 and extend from an outer circumferential face of the receiving channel 8791.

The sealing member 8773 can be seated on the distal end of the connective extension 8793 and surround the plurality of receiving channels 8791.

Figure 28B:
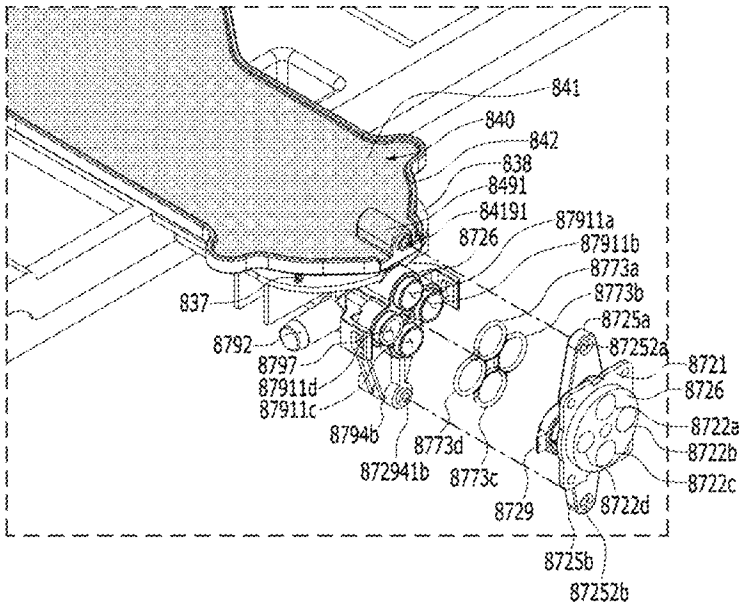
FIGS. 28A and 28B are perspective views of an example of a connective portion, a water delivering portion, and a nozzle cover are coupled to each other.
Figure 28A:
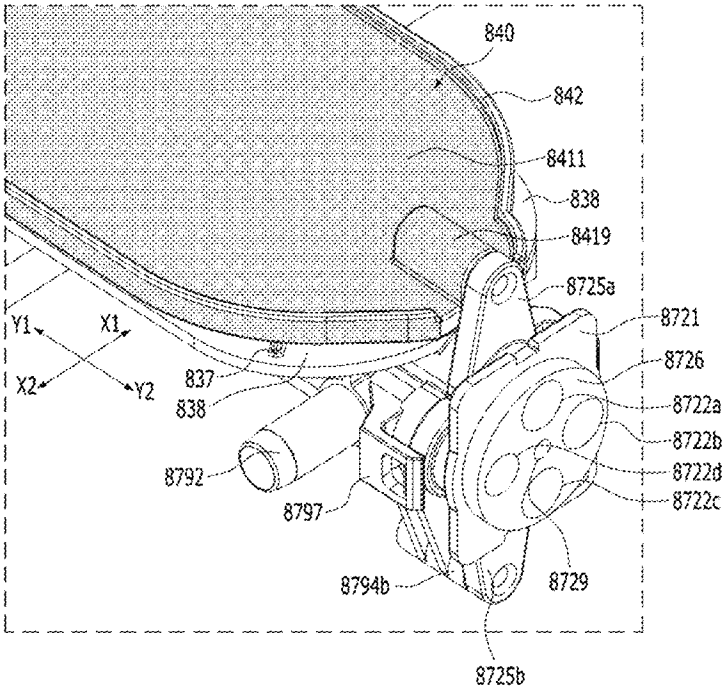

FIG. 28A is a perspective view showing a state in which the connective portion, the water delivering portion and the nozzle cover are coupled to each other in the laundry treating apparatus. FIG. 28B is a perspective view viewed in a different direction of a state in which the connective portion, the water delivering portion and the nozzle cover in FIG. 28A are coupled to each other in the laundry treating apparatus.

Hereinafter, a description will be focused on a structure different from that of the water delivering portion 872 and the connective portion 879 shown in FIGS. 26A and 26B.

When a distance by which the connective portion 879 protrudes from the valve connector 838 is too larger, a rotational moment applied to a contact point between the connective portion 879 and the valve connector 838 can increase. That is, the structural rigidity of the connective portion 879 can be lowered.

For this reason, the distal end of the valve connector 838 can be configured to protrude beyond the distal end of the connective portion 879. In other words, the distal end of the connective portion 879 can be positioned below the valve connector 838.

Thus, the protruding length of the connective portion 879 from the valve connector 838 can be reduced, such that an amount of moment loaded onto the connective portion 879 can be reduced.

Further, as a distal end of the valve connector 838 can be configured to protrude beyond a distal end of the connective portion 879, the fixing protrusion 8794 can extend from the connective extension 8793 to one side so that the first fixing protrusion 8794*a* to which the first fastening portion 8725 is coupled can be omitted.

In this case, the nozzle cover 840 can include a fastening part 8419 coupled to the first fastening portion 8725 or the second fastening portion 8725*b* so as to reinforce structural rigidity of the connective portion 879.

The fastening part 8419 can be disposed at a position corresponding to that of one of the first fastening portion 8725 or the second fastening portion 8725*b* and can protrude from a top face of the nozzle cover 840 in a vertical direction (Z direction). The fastening part 8419 can protrude upwards from the nozzle cover body 841 and extend toward the first fastening portion 8725*a*.

Coupling the first fastening portion 8725 to the fastening part 8419 can allow a load applied to the connective portion 879 supporting a weight of the first water collector drain pipe 8911*a* and the water delivering portion 872 and the water receiving portion 871 to be reduced. In other words, because the nozzle cover 840 can be coupled to the channel defining portion 834 in a relatively large area, the load applied to the connective portion 879 can be transmitted to the nozzle cover 840 and thus can be distributed. For example, the fastening part 8419 can include a protrusion that protrudes from a top surface of the nozzle cover 840 and a hole defined inside the protrusion.

Further, a length by which the connective portion 879 extends from the valve connector 838 can be reduced. The water delivering portion 872 can be closer to the duct cover 830, so that an overall extension length of the channel switching valve 870 can be reduced.

Thus, a possibility that the channel switching valve 870 interferes with the drum 200 can be significantly reduced. Furthermore, a length of each of the receiving channel 8791 and the connective transfer channel 8792 can be reduced, so that an amount of residual water inside each of the receiving channel 8791 and the connective transfer channel 8792 can be reduced.

In some examples, a length of the first fastening portion 8725*a* can be equal to a length of the second fastening portion 8725*b*. In some examples, unlike a configuration shown in FIGS. 26A and 26B, the first fixing protrusion 8794*a* can be omitted from the connective portion 879, such that the length of the first fastening portion 8725*a* and that of the second fastening portion 8725*b* may not be different from each other.

In some examples, the first fastening portion 8725*a* extending upwardly from an outer circumferential face of the receiving portion 8728 can have a length corresponding to that of the second fastening portion 8725*b* extending downwardly from an outer circumferential face of the receiving portion 8728.

Accordingly, manufacturing and repair of the first fastening portion 8725*a* and the second fastening portion 8725*b* can be facilitated. Further, when assembling the water delivering portion 872, positions of the first fastening portion 8725*a* and the second fastening portion 8725*b* can be exchanged with each other such that the second fastening portion 8725*b* can be coupled to the fastening portion 8719. Accordingly, the water delivering portion 872 can be easily assembled to the connective portion 879 and the nozzle cover 840.

In some examples, the sealing member 8773 can include a first sealing member 8773*a* which accommodates an outer circumferential face of the first receiving channel 8791*a*, a second sealing member 8773*b* which accommodates an outer circumferential face of the second receiving channel 8791*b*, a third sealing member 8773*c* which accommodates an outer circumferential face of the third receiving channel 8791*c*, and a fourth sealing member 8773*d* which accommodates the protrusion 8727.

The first sealing member 8773*a*, the second sealing member 8773*b*, and the third sealing member 8773*c* can have diameters and thicknesses corresponding to each other, and can be configured to be in contact with each other.

The fourth sealing member 8773*d* can be formed in a shape corresponding to that of the protrusion 8727. The first sealing member 8773*a*, the second sealing member 8773*b*, and the third sealing member 8773*c* can be arranged along a perimeter.

Various implementations of the present disclosure have been described above in detail. However, those of ordinary skill in the art to which the present disclosure belongs can make various modifications to the above-described implementations without deviating from the scope of the present disclosure. Therefore, the scope of the present disclosure should not be limited to the described implementations, and should be defined by the claims as described below as well as the equivalents thereto.

What is claimed is:

1. A laundry treating apparatus comprising:

a cabinet having an opening defined at a front surface thereof;

a drum rotatably disposed in the cabinet, the drum having a laundry inlet defined at a front surface thereof and configured to introduce laundry into the drum;

a base that is disposed below the drum and defines a space configured to receive air discharged from the drum and to guide the air to the drum; and a motor configured to rotate the drum, wherein the base comprises:

an air circulating channel configured to fluidly communicate with the drum, the air circulating channel being configured to receive the air discharged from the drum and to guide the air to the drum, a heat exchanger comprising (i) a first heat exchanger disposed inside the air circulating channel and configured to cool the air discharged from the drum and (ii) a second heat exchanger spaced apart from the first heat exchanger and configured to heat air that has been cooled by the first heat exchanger, a water collector body that is disposed outside the air circulating channel and in fluid communication with the air circulating channel, the water collector body being configured to collect water condensed from the air in the first heat exchanger, a cleaning water channel disposed above the air circulating channel and configured to receive the water from the water collector body and to discharge water received from the water collector body to the first heat exchanger, a pump configured to move the water collected in the water collector body to the cleaning water channel, and a channel switching valve connected to the pump and configured to selectively supply the water from the pump to the cleaning water channel, wherein the channel switching valve comprises:

a water receiving portion connected to the pump and configured to receive the water from the pump, and a connective portion connected to the water receiving portion and disposed at a lateral side of the air circulating channel, the connective portion being configured to deliver the water from the water receiving portion to the cleaning water channel, and wherein at least portion of the connective portion is located lower than a top surface of the air circulating channel.

2. The laundry treating apparatus of claim 1, wherein the air circulating channel comprises:

an air flow duct that extends upward from the base and accommodates the first heat exchanger and the second heat exchanger; and a duct cover that is coupled to the air flow duct and covers the first heat exchanger and the second heat exchanger, the cleaning water channel being disposed at a top surface of the duct cover, and wherein the connective portion is disposed at a side surface of the duct cover, the at least portion of the connective portion being located lower than the top surface of the duct cover.

3. The laundry treating apparatus of claim 2, wherein the duct cover defines:

a cover through-hole that passes through the top surface of the duct cover and faces at least a portion of the first heat exchanger; and a valve communication hole that passes through a surface of the cleaning water channel and fluidly communicates the cleaning water channel with the connective portion, and wherein the cleaning water channel extends from the valve communication hole to the cover through-hole and is configured discharge the water toward the first heat exchanger through the cover through-hole.

4. The laundry treating apparatus of claim 2, wherein the connective portion is integrally formed with the duct cover such that the water is delivered to the cleaning water channel without leakage at the connective portion.

5. The laundry treating apparatus of claim 4, wherein the connective portion defines:

a supply hole connected to the water receiving portion and configured to receive the water from the water receiving portion; and a valve communication hole that passes through a bottom surface of the cleaning water channel and is configured to deliver the water supplied from the supply hole to the cleaning water channel, and wherein the supply hole and the valve communication hole are spaced apart from each other and face different directions from each other.

6. The laundry treating apparatus of claim 5, wherein the connective portion further comprises a receiving channel configured to guide the water from the water receiving portion to the cleaning water channel, the receiving channel having a first end that defines the supply hole and a second end that defines the valve communication hole, and wherein the receiving channel extends in an inclined direction with respect to the top surface of the duct cover.

7. The laundry treating apparatus of claim 6, further comprising a water storage tank spaced from the base and connected to the connective portion, the water storage tank being configured to receive the water from the water collector body, and wherein the connective portion further defines:

a water receiving hole connected to the water receiving portion and configured to receive the water from the water receiving portion, and a water discharge hole connected to the water storage tank and configured to discharge the water received through the water receiving hole toward the water storage tank, the water discharge hole being spaced apart from the water receiving hole and facing away from the water receiving hole.

8. The laundry treating apparatus of claim 7, wherein the connective portion further defines a connective transfer channel that has a first end defining the water receiving hole and a second end defining the water discharge hole, the connective transfer channel being configured to guide the water from the water receiving portion to the water storage tank, and wherein the connective transfer channel and the receiving channel are defined in a single body.

9. The laundry treating apparatus of claim 4, wherein the channel switching valve further comprises a water delivering portion disposed between the water receiving portion and the connective portion and configured to guide the water supplied from the water receiving portion to the connective portion, and wherein the connective portion is coupled to the water delivering portion and configured to receive the water from the water receiving portion through the water delivering portion.

10. The laundry treating apparatus of claim 9, wherein the channel switching valve further comprises a sealing member disposed between the connective portion and the water delivering portion and configured to block the water guided from the water delivering portion from leaking out between the connective portion and the water delivering portion.

11. The laundry treating apparatus of claim 9, further comprising a nozzle cover that is coupled to the top surface of the duct cover and covers the cleaning water channel, wherein the nozzle cover comprises a fastening part that protrudes from a top surface of the nozzle cover and is coupled to the water delivering portion, and wherein the water delivering portion comprises:

a first fastening portion that extends from one side of the water delivering portion and is coupled to the fastening part of the nozzle cover, and a second fastening portion that extends from another side of the water delivering portion and is coupled to the connective portion.

12. The laundry treating apparatus of claim 9, wherein the connective portion comprises a first fixing protrusion that protrudes upward from a top of the connective portion and a second fixing protrusion that protrudes downward from a bottom of the connective portion, and wherein the water delivering portion comprises:

a first fastening portion that extends from one side of the water delivering portion and receives the first fixing protrusion, and a second fastening portion that extends from another side of the water delivering portion and receives the second fixing protrusion.

13. The laundry treating apparatus of claim 4, wherein the cabinet comprises:

a first side panel that defines a first side of the cabinet and faces one side of the drum; and a second side panel that defines a second side of the cabinet and faces another side of the drum, wherein the air flow duct and the duct cover are located closer to the second side panel than to the first side panel, and wherein the connective portion extends from the duct cover toward the first side panel.

14. The laundry treating apparatus of claim 13, wherein the connective portion extends toward the first side panel along an inclined direction relative to an extension direction of the duct cover.

15. The laundry treating apparatus of claim 13, wherein the water collector body is located between the first side panel and the air flow duct, and wherein the channel switching valve is located between the drum and the water collector body and overlaps with the water collector body along a vertical direction.

16. The laundry treating apparatus of claim 1, wherein a top of the water receiving portion is located lower than a bottom of the drum and is spaced apart from the bottom of the drum.

17. The laundry treating apparatus of claim 6, wherein the cleaning water channel comprises a plurality of cleaning water channels, wherein the receiving channel comprises a plurality of receiving channels that are connected to the plurality of cleaning water channels, respectively, and wherein a number of the plurality of receiving channels is equal to a number of the plurality of cleaning water channels.

18. The laundry treating apparatus of claim 17, wherein the channel switching valve further comprises a scroll accommodated in the water receiving portion and configured to selectively supply the water in the water receiving portion to the receiving channel, and wherein the scroll is configured to, based on rotating about an axis, selectively communicate the water receiving portion with one of the plurality of receiving channels.

19. The laundry treating apparatus of claim 18, wherein the water receiving portion comprises:

a valve rotatable shaft coupled to the scroll and configured to rotate the scroll; and a valve driver coupled to the valve rotatable shaft and configured to rotate the valve rotatable shaft, wherein the scroll defines a scroll communication hole, a width of the scroll communication hole being equal to a diameter of one of the plurality of receiving channels, and wherein the scroll communication hole is configured to selectively communicate with one of the plurality of receiving channels based on a rotation angle of the valve rotatable shaft.

20. The laundry treating apparatus of claim 19, wherein the scroll comprises a scroll plate that defines the scroll communication hole and a scroll coupling groove, the scroll coupling groove being defined at a rotation center of the scroll plate and coupled to the valve rotatable shaft.

* * * * *